US010612352B2

(12) United States Patent
Tolman et al.

(10) Patent No.: US 10,612,352 B2
(45) Date of Patent: Apr. 7, 2020

(54) AUTONOMOUS DOWNHOLE CONVEYANCE SYSTEMS AND METHODS USING ADAPTABLE PERFORATION SEALING DEVICES

(71) Applicants: Randy C Tolman, Spring, TX (US); Timothy G. Benish, Conroe, TX (US)

(72) Inventors: Randy C Tolman, Spring, TX (US); Timothy G. Benish, Conroe, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 235 days.

(21) Appl. No.: 15/811,209

(22) Filed: Nov. 13, 2017

(65) Prior Publication Data

US 2018/0135381 A1 May 17, 2018

Related U.S. Application Data

(60) Provisional application No. 62/422,356, filed on Nov. 15, 2016.

(51) Int. Cl.
*E21B 43/25* (2006.01)
*E21B 33/138* (2006.01)
(Continued)

(52) U.S. Cl.
CPC ..... *E21B 43/25* (2013.01); *E21B 33/10* (2013.01); *E21B 33/12* (2013.01); *E21B 33/134* (2013.01);
(Continued)

(58) Field of Classification Search
CPC ..... E21B 43/25; E21B 43/11; E21B 34/10; E21B 34/063; E21B 33/138; E21B 33/10; E21B 43/116; E21B 33/134; E21B 33/12; E21B 43/117; E21B 43/119; E21B 47/09; E21B 43/26
See application file for complete search history.

(56) References Cited

U.S. PATENT DOCUMENTS 6,394,184 B2 5/2002 Tolman et al.
6,543,538 B2 4/2003 Tolman et al.
(Continued)

FOREIGN PATENT DOCUMENTS

WO WO 2011/149597 12/2011
WO WO 2011/150251 12/2011
WO WO 2012/082302 6/2012

OTHER PUBLICATIONS

Bour et al., "*Development of Diverter Systems for EGS and Geothermal Well Stimulation Applications*", DOE Grant DE-EE0002795, "*Temporary Bridging Agents for Use in Drilling and Completion of Engineered Geothermal Systems*", Jan. 2012, Stanford University.
(Continued)

*Primary Examiner* — Wei Wang
(74) *Attorney, Agent, or Firm* — ExxonMobil Upstream Research Company—Law Department

(57) ABSTRACT

Autonomously conveyable and actuatable wellbore completion tool assemblies and methods for using the same, comprising: an onboard controller and location sensing device, a plurality of adaptable perforation sealing devices comprising a primary sealing portion and at least one secondary sealing portion extending radially outward from the primary sealing portion to form a secondary seal in the perforation; an autonomously actuatable transport member for supporting the plurality of adaptable sealing devices during conveyance of the tool assembly within the wellbore, and an on-board controller configured to send an actuation signal to actuate at least release of the plurality of adaptable perforation sealing devices from the transport member, wherein the tool assembly comprises a friable material and self-destructs within the wellbore in response to a signal from the on-board controller that affects self-destruction.

34 Claims, 20 Drawing Sheets

(51) Int. Cl.

| | |
|---|---|
| ***E21B 34/06*** | (2006.01) |
| ***E21B 43/11*** | (2006.01) |
| ***E21B 34/10*** | (2006.01) |
| ***E21B 43/119*** | (2006.01) |
| ***E21B 43/116*** | (2006.01) |
| ***E21B 33/134*** | (2006.01) |
| ***E21B 33/12*** | (2006.01) |
| ***E21B 43/117*** | (2006.01) |
| ***E21B 33/10*** | (2006.01) |
| ***E21B 47/09*** | (2012.01) |
| ***E21B 43/26*** | (2006.01) |

(52) U.S. Cl.

CPC ..... *E21B 33/138* (2013.01); *E21B 34/063* (2013.01); *E21B 34/10* (2013.01); *E21B 43/11* (2013.01); *E21B 43/116* (2013.01); *E21B 43/117* (2013.01); *E21B 43/119* (2013.01); *E21B 43/26* (2013.01); *E21B 47/09* (2013.01)

(56) References Cited

U.S. PATENT DOCUMENTS

| | | | | |
|---|---|---|---|---|
| 7,059,407 | B2 | 6/2006 | Tolman et al. | |
| 7,278,486 | B2 | 10/2007 | Alba et al. | |
| 7,617,558 | B2 | 11/2009 | Boe | |
| 7,703,507 | B2 | 4/2010 | Strickland | |
| 7,814,970 | B2 | 10/2010 | Strickland | |
| 8,037,934 | B2 | 10/2011 | Strickland | |
| 8,162,051 | B2 | 4/2012 | Strickland | |
| 8,272,439 | B2 | 9/2012 | Strickland | |
| 2008/0066917 | A1 | 3/2008 | Lehr et al. | |
| 2009/0248307 | A1 | 10/2009 | Barrow et al. | |
| 2009/0276094 | A1 | 11/2009 | De Guzman et al. | |
| 2009/0283279 | A1 | 11/2009 | Patel et al. | |
| 2009/0301723 | A1 | 12/2009 | Gray | |
| 2011/0035152 | A1 | 2/2011 | Durocher et al. | |
| 2011/0297369 | A1 | 12/2011 | Kumaran et al. | |
| 2013/0062055 | A1 | 3/2013 | Tolman et al. | |
| 2013/0248174 | A1 | 9/2013 | Dale et al. | |
| 2013/0255939 | A1 | 10/2013 | Kumaran et al. | |
| 2015/0090453 | A1* | 4/2015 | Tolman | E21B 33/138 166/297 |
| 2016/0348465 | A1* | 12/2016 | Schultz | E21B 33/138 |
| 2017/0159418 | A1 | 6/2017 | Tolman et al. | |
| 2017/0159419 | A1 | 6/2017 | Tolman et al. | |
| 2017/0159420 | A1 | 6/2017 | Tolman et al. | |

OTHER PUBLICATIONS

Higginson, "Comparing Completions", Oilfield Technology, Aug. 2011, Packers Plus Energy Services, UK.

* cited by examiner

AUTONOMOUS DOWNHOLE CONVEYANCE SYSTEMS AND METHODS USING ADAPTABLE PERFORATION SEALING DEVICES

CROSS REFERENCE TO RELATED APPLICATIONS

This application claims the benefit of U.S. Provisional Application No. 62/422,356, filed Nov. 15, 2016, entitled "Wellbore Tubulars Including Selective Stimulation Ports Sealed with Sealing Devices and Methods of Operating the Same", the disclosure of which is incorporated herein by reference in its entirety.

FIELD OF THE INVENTION

The systems and methods disclosed herein are applicable to the oil and gas industries. This invention relates generally to the field of wellbore completion operations. More specifically, the invention relates to an improved perforation sealing system that is enabled through an autonomous conveyance system.

BACKGROUND OF THE INVENTION

This Background section is intended to introduce various aspects of the art, which may be associated with exemplary embodiments of the present disclosure. This background discussion is provided merely to facilitate a better understanding of the present disclosure as it relates to needs of the prior art. Accordingly, it should be understood that this section should be read in this light and not necessarily as admissions of prior art.

Hydrocarbon wells generally include a wellbore that extends from a surface region and/or that extends within a subterranean formation that includes a reservoir fluid, such as liquid and/or gaseous hydrocarbons. After wellbores are drilled, they are typically cased and then perforated or otherwise provided with an aperture or opening at the hydrocarbon-bearing formation intervals to facilitate fluid flow between the wellbore and formation. After perforating, it's often desirable to stimulate or "treat" the subterranean formation to provide improved flow paths for movement of the hydrocarbons from the reservoir rock to the wellbore. The steps of casing the wellbore with an appropriate tubular configuration, perforating the wellbore, and treating the formation to make it productive are collectively, commonly referred to as "completing" the well.

The perforation apertures may be created by various means, such as by using shaped-charge jet perforating of the casing or providing pre-positioned selectively operable orifices or devices, such as with sliding sleeves, rupturable disks, check valves, and removable port covers. Perforation apertures in the wellbore tubulars may be created (i) in-situ using shaped charges fired from a perforating gun, or (ii) pre-installed or pre-drilled apertures such as orifice devices, sliding sleeves, rupture disks, valves, etc.

Traditional in-situ "perforating" using shaped-charge explosives within a perforating gun is the most common method for creating perforations and is typically done after the wellbore tubular (e.g., casing or liner) is positioned into the wellbore. This is traditionally and typically done using electric wireline or coil tubing for deployment of the perforating guns and making a firing location determination from measuring equipment outputs or readouts located at the surface. Actuation signals to the downhole tool, such as to fire perforating guns or actuate the tool, are traditionally provided or communicated to the tool from the surface.

Technical developments over recent years have enabled deployment of "autonomous" or "smart" tool systems that activate independently from surface control or instruction, relying instead upon on-board programming and sensing to perform an operation. Autonomous tools are provided with on-board controllers and processing capabilities to self-determine from a combination of information collected in-transit within the wellbore and instructions programmed into memory when to actuate a tool or "fire" the perforating charges. Autonomous perforating systems may be deployed on a slick-line (non-electrical wireline), free-fall, self-propelling, and/or pumped along the wellbore.

As discussed above in regard to perforating, over the past decade wellbore completion tools have been developed having on-board controller and location devices that are capable of deployment within a wellbore with on-board ("smart") ability to self-determine the tool's location and to actuate or self-execute a desired function or set of instructions when the tool reaches a determined location or a set of prescribed conditions is met. For example the tools may include a perforating gun fires and perforates the casing when the tool reaches the desired position in the wellbore. Such tools may sometimes be free from tethering from the surface or may be deployed tethered to a wire such as a slick line or coil tubing.

Perforation apertures in the wellbore tubulars may be created (i) in-situ using shaped charges fired from a perforating gun, or (ii) pre-installed or pre-drilled apertures such as orifice devices, sliding sleeves, rupture disks, valves, etc. For purposes herein, apertures created by either method are included as perforations or perforations.

Other autonomous tool developments have included setting bridge plugs, whipstocks, cutting tools, conveying a liquid or even conveying perforating balls within a transport member. At the desired wellbore position, the tool may self-activate to release a liquid or adaptable perforation sealing devices from the transport member or set a conveyed downhole tool.

In autonomous tool operations, the conveyed autonomous tool assembly may be retrieved after use, partially destroyed and partially retrieved, or fully destructed such that no retrieval operation is needed. Fully destructible autonomous tool operations provide the benefit of obviating the need for surface location equipment such as wireline trucks, cranes, and long tool lubricators on wellheads. Fully destructible operations also obviate the need to recover the "brain" or any other measuring or otherwise conveying equipment from within the wellbore, thus saving several days of rig and completion time over the course of a multizone completion operation. Obviating the need to drill out or mill up traditional or autonomously set plugs also greatly reduces the amount of job complexity and risk, completion time, water used, formation damage risks.

The formation may be stimulated by pumping a stimulation fluid through the tubular apertures and into the subterranean formation, such as by pumping an acid into a carbonate type of subterranean formation to etch or dissolve a flow channel through at least a portion of the subterranean formation. Other types of stimulation may include hydraulically fracturing the subterranean formation, such as by supplying a fluid-based fracturing fluid and proppant into a hydraulically induced fracture network.

The completions section of wellbores in both conventional and unconventional reservoirs are generally increasing in length. Whether such wellbores are vertical or horizontal, such wells frequently require the sequential placement of multiple perforation sets and multiple fractures. Each act of perforating and then stimulating is sometimes referred to as a stage. Groups of stages may be performed sequentially, utilizing only perforation sealers isolating the stages. Wellbore plugs are commonly utilized to isolate groups of stages, as convenient or appropriate.

The more the number of completion zones, the more equipment is traditionally required to be included or introduced into the wellbore, and frequently removed therefrom after all zones are completed, such as by drill-out. Use of downhole hardware such as using multiple conventional perforating guns, multiple plugs, etc., increases the time, expense, complexity, and risk of such multi-zone completions. Commonly, the axial length of the hydrocarbon-bearing portion of the subterranean formation encountered by the wellbore requiring completion exceeds the amount of formation that can be effectively stimulated in a single stimulation treatment. Some typical wells may have, for example seventy stages separate into seven groups with six wellbore plugs. More recently, wells are being completed through a producing formation horizontally, with the horizontal portion often extending 5,000 and even 10,000 axial feet through the producing formation. Such completions require performing multiple "stages" or separate completion (perforation and stimulation) treatments to effectively stimulate the totality of hydrocarbon-bearing formation encountered by the wellbore. When multiple stages are required, each stage must be hydraulically isolated from the previous stages to enable the current stimulation treatment fluid to flow into the desired perforations. When one stage is fully treated, it must then be hydraulically isolated from the forthcoming perforation interval and stimulation treatments. In addition to the ball sealers used for hydraulic diversion as discussed above, hydraulic isolation between previously stimulated zones and zones not yet stimulated also may be facilitated using other diversion agents or methods, such as bridge plugs, frac plugs, frac balls, manipulable sleeves, valves, plugging-particulates or flakes, and/or limited entry-perforating. Other exemplary diversion methods are described more fully in U.S. Pat. No. 6,394,184 entitled "Method and Apparatus for Stimulation of Multiple Formation Intervals."

Spherical ball sealers are commonly used for stimulation fluid diversion and are typically a rubber or polymeric ball that's sized slightly larger than the wellbore perforation so as to seat on the perforation. Ball sealers are selectively introduced into the wellbore with the flowing stimulation fluid stream and transported down the wellbore with the stimulation fluid to the perforations. The ball sealers are intended to seat on the perforations, restricting fluid flow into the formation, causing hydraulic pressure to increase within the wellbore and fracture open the formation behind other perforations that had not previously taken stimulation fluid. For desired effectiveness, perforations are intended to be substantially circular in shape and small enough in diameter after receiving stimulation fluid and proppant for the ball to fully seat on, conform, and hydraulically seal the entire perimeter of the perforation shoulder.

However, traditional ball sealers do not always seat as intended and when seated, often do not affect the desired hydraulic seal. One disadvantage of traditional spherical ball sealers is that often perforations that have taken a lot of stimulation fluid and proppant may be severely eroded to a larger diameter or otherwise have a non-circular perimeter. As a result, a ball sealer engaged thereon cannot effect a perfect hydraulic seal. Some perforations may present burrs or a split shape, also resulting in a non-circular or an irregular perforation shoulder. If a ball does seat, there may be some reduction in flow rate through the perforation, but the needed pressure drop from the seating may not occur. Also, ball sealers may become unseated if insufficient hydraulic pressure differential occurs between the wellbore. Also, some perforations may be bypassed altogether by the balls, leaving them open and receiving a full flow of stimulation fluid during subsequent stages.

Improved perforation sealers comprising a spherical core having a plurality of freely moving arms or tentacles extending from the outer surface of the sealer are also recently known. The spherical core portion of such sealers engages the perforation perimeter similar to how a traditional ball sealer seats on a perforation. Often this still may result in an imperfect hydraulic seal on the perforation seat as discussed above, having leakage pathways along the perimeter therewith. The freely moving arms or tentacles however, are intended to flow with fluid movement into the leakage pathways with the seat, thereby further plugging at least an additional portion of the leakage pathway, further reducing the fluid flow leaking through the seat seal. To avoid potential entanglement of the tentacles with each other within the wellbore or snagging on features within the wellbore, the sealers are provided with a removable shell or related temporary confinement feature for the tentacles.

Another useful multiple-zone completion technology relates to autonomously deployable tools, such as for perforating and setting plugs. Such procedures sometimes use a series of alternating perforating guns and plugs to separate completion zones or stages. Autonomous deployment of perforating guns and plugs while pumping the stimulation or fracture treatments may facilitate making perforations and previous zone isolation steps while substantially continuously pumping the stimulation treatments to each subsequent zone without shutting off the pumping other than very brief intermissions. Such processes are known within parts of the industry as the "just-in-time" perforating process. The just-in-time perforating process represents a highly efficient method in that a fracturing fluid may be run into the wellbore with a perforating gun in the hole. As soon as the perfs are shot and fractures are formed, sealing devices are dropped. When the sealing devices seat on the perforations, a gun is shot at the next zone. These steps are repeated until all guns are spent. A new plug 140 is set and the process begins again. This "just-in-time" perforating process reduces flush volumes and offers the ability to manage "screen-outs" along the zones. However, it does require that numerous plugs are then drilled out while exposing the freshly created and fractured zones to the drillout fluids and operation pressures, potentially adversely affecting the completion.

However, need exists for still further improved wellbore perforation sealing technology and/or improved methods to effect a more reliable and effective stimulation fluid diversion system. The art especially needs such reliability improvements that can be economically implemented and provide improved operational reliability. The technology disclosed below addresses one or more of these needs.

SUMMARY OF THE INVENTION

The assemblies and methods described herein have various benefits in the conducting of oil and gas exploration and production activities. In one aspect, the disclosure includes a conveyable tool assembly for use in completing a formation penetrated by a wellbore, the tool assembly being conveyable within the wellbore and autonomously actuatable. The tool assembly comprises a plurality of adaptable perforation sealing devices, a sealing device transport member for supporting the plurality of adaptable sealing devices during autonomous conveyance of the tool assembly within the wellbore, a location sensing device for acquiring measurements related to the location of the tool assembly within the wellbore, and an on-board controller configured to autonomously send a actuation signal within the tool assembly to actuate release of the plurality of adaptable perforation sealing devices the transport member.

Each of the plurality of adaptable perforation sealing devices comprise; (i) a primary sealing portion that seats on a perforation and forms a primary seal with the perforation to at least partially restrict fluid flow through the perforation; and (ii) at least one secondary sealing portion having an engaged end engaged with the primary sealing portion and an unsecured end capable of extending radially outward from the primary sealing portion and able to flex or move freely in a fluid flow stream, the secondary sealing portion being subject to fluid drag to flow toward and at least partially into or through a perforation to direct the adaptable sealing device toward and into contact with the perforation and the secondary sealing portion forming a secondary seal between the primary sealing portion and the perforation to at least partially restrict fluid flow through a leakage pathway between the primary sealing portion and the wellbore wall, such as an edge or seat on the perforation in the wellbore wall.

The plurality of adaptable perforation sealing devices, the transport member, the location sensing device, and the on-board controller are together dimensioned and arranged to be deployed in the wellbore as an autonomous unit; and wherein the transport member, the location sensing device, and the on-board controller are all fabricated from a friable or otherwise destructible material and are together dimensioned and arranged to self-destruct within the wellbore in response to at least one of the actuation signal and a self-destruct signal from the on-board controller.

In some embodiments, the tool assembly may further comprises a friable material that is destructible into pieces forming a debris field within the wellbore, wherein at least a portion of the debris field forms particulates that may create a tertiary or additional measure of sealing between the primary sealing portion and the perforation to further at least partially restrict fluid flow through the leakage pathway between the primary sealing portion and the perforation.

In another aspect, the tool may further comprise a perforating gun supporting perforating charges therewith and the on-board controller is configured to selectively send a fire signal to the perforating charges, and the perforating gun fires the perforating charges and is destructed in response to the fire signal.

The tool assembly of may also include a controller configured to selectively send a actuation signal to cause release of the plurality of adaptable sealing devices from the transport member, separate from the fire signal that causes the perforating gun to fire.

The tool assembly may be fabricated such that the on-board controller is configured to send a destruct signal to cause destruction of the tool assembly in conjunction with the actuation signal.

The actuation signal, the self-destruct signal, and/or the fire signal may be the same signal or independent signals that may be sent by the on-board controller substantially simultaneously, sequentially, or combinations thereof.

In some aspects each of the plurality of adaptable perforation sealing devices comprises a destructible shell that confines the secondary sealing portion in a transport condition during conveyance within the wellbore.

The destructible shell may be destructed in response to a stimulus generated in response to at least one of the actuation signal and the self-destruct signal, or by dissolution during conveyance along the wellbore by the wellbore or stimulation fluid such that the shell is substantially dissolved or eroded prior to the adaptable perforation sealing device arriving at the perforation such that at arrival at or near the perforation, the secondary sealing portions are able to move and flow freely within the wellbore fluid.

At least one of the actuation signal and the self-destruct signal generates creation of the stimulus that causes substantially simultaneous destruction of the shells, the transport member, the location sensing device, and the on-board controller.

Each of the plurality of adaptable perforation sealing devices may be configured such that each of the plurality of adaptable perforation sealing devices do not include a destructible shell to enclose the secondary sealing portions during conveyance within the wellbore and the transport member functions as a common protective destructible shell for the plurality of adaptable sealing devices during conveyance.

In many embodiments, all primary structural components of the tool assembly except the adaptable plugging devices are fabricated from a friable material and any and all components of the tool assembly may be destructed at substantially the same time or at separate times, as determined by the on-board controller, such that eventually all components of the tool assembly are destructed, except for the plugging devices. The tool assembly (including components thereof) may be designed to self-destruct, in whole or in part, in response to a fire or actuation signal sent to a perforating gun. Total destruction of the autonomous tool assembly may take place over multiple destruction events. The tool assembly may be designed to self-destruct in response to a fire signal, an actuation signal, or a self-destruct actuation signal sent to the transport member itself, such as when no perforating gun is present in the tool assembly or when a the adaptable sealing devices are released by a signal separate from a signal that fires a perforating gun or that causes destruction of the tool assembly.

In some embodiments, the tool assembly is designed to actuate destruction of the transport member in response to one actuation signal to cause a designated action, such as release of the adaptable sealing devices from within the transport member. Another actuation signal may be sent by the controller such as to cause another action, such as setting a plug, firing a perforating gun, releasing a fluid from a fluid canister, fire a shockwave-causing device, and/or destruct the controller itself.

The tool assembly including portions thereof, includes a friable material that when destructed forms a debris field of particulates that may also form an additional or "tertiary" seal within the leakage pathway between the primary sealing portion of the adaptable perforation sealing devices and the perforation to at least partially further restrict fluid flow from the wellbore through the perforation along the leakage pathway. Such particulates of any desired geometry that may be effective for the intended function, such as solid granular, irregular, flakes, lenticular pieces, etc., as may be effective at lodging effectively into leakage creases or openings to effect sealing of the same.

In one aspect, the tool assembly additionally includes a power supply, commonly a battery pack but also including other means of on-board stored or provided energy. The power source may provide power to the tool assembly locator, the on-board controller, and the various actuation signals. In this way, the completion assembly may be conveyed or otherwise released from the surface without need of an electric line from the surface.

The tool assembly may also include a safety system. The safety system may be a multi-gated system that prevents premature activation of the perforating gun. In this respect, the safety system comprises control circuitry having one or more electrical switches that are independently operated in response to separate conditions before permitting the second actuation signal to reach the tool.

It is observed that all deployed components of the tool assembly, including but not limited to the transport member, the plurality of adaptable perforation sealing devices, the locator, and the on-board controller are together dimensioned and arranged to be deployed in the wellbore as an autonomous unit. In this application, "autonomous unit" means that the assembly is not immediately controlled from the surface. Stated another way, the tool assembly does not rely upon a signal from the surface to know either its location within the wellbore or when to activate the tool. Preferably, the tool assembly is released into the wellbore without a working line, deploying line, such as coiled tubing, electric line, or slick-line may be used for conveyance, without interfering with the autonomous self-control of the device by the on-board controller. The tool assembly either falls gravitationally into the wellbore, tractors itself, or is pumped downhole. However, a non-electric working line such as slick line may optionally be employed in some applications, such as to control the displacement rate of the tool along the wellbore.

Included are methods for use of the disclosed technology in completing a formation penetrated by a wellbore using a tool assembly conveyable within the wellbore and autonomously actuatable, the method comprising: providing a tool assembly, including; (a) a location sensing device for acquiring measurements related to the location of the tool assembly within the wellbore; (b) a plurality of adaptable perforation sealing devices for sealing a plurality of perforations in the wellbore wall; (c) a transport member for supporting the plurality of adaptable sealing devices during conveyance of the tool assembly within the wellbore; (d) a self-destruct energy source; and (e) an on-board controller configured to send a actuation signal within the tool assembly to actuate release of the plurality of adaptable perforation sealing devices from the transport member; wherein the plurality of adaptable perforation sealing devices, the transport member, the location sensing device, and the on-board controller are together dimensioned and arranged to be deployed in the wellbore as an autonomous unit; wherein each of the plurality of adaptable perforation sealing devices comprise; (i) a primary sealing portion that seats on a perforation in the wellbore and forms a primary seal with the perforation to at least partially restrict fluid flow through the perforation; and (ii) at least one secondary sealing portion having a secured end engaged with the primary sealing portion and an unsecured end capable of extending radially outward from the primary sealing portion, the secondary sealing portion creating fluid drag with the stimulation fluid to direct the adaptable sealing device toward a perforation and for forming a secondary seal between the primary sealing portion and the perforation to at least partially restrict fluid flow through a leakage pathway between the primary sealing portion and the perforation; wherein the tool assembly is prepared and arranged to self-destruct within the wellbore in response to at least one of the actuation signal and a self-destruct signal from the on-board controller; and wherein the tool assembly comprises a friable destructible material that is destructible into pieces forming a debris field within the wellbore, wherein a portion of the debris field forms a tertiary seal between the primary sealing portion and the perforation to further at least partially restrict fluid flow through the leakage pathway between the primary sealing portion and the perforation; deploying the plurality of adaptable perforation sealing devices, the transport member, the location sensing device, and the on-board controller in the wellbore as an autonomously actuatable unit; and sending at least one of the actuation signal and the self-destruct signal from the on-board controller to cause at least one of release of the plurality of adaptable perforation sealing devices and self-destruction of the tool assembly within the wellbore.

The claimed methods may further include providing a perforating gun supporting perforating charges therewith; and autonomously sending a fire signal from the on-board controller to the perforating charges.

The methods may also include configuring the controller to selectively send the actuation signal to cause release of the plurality of adaptable sealing devices from the transport member, separate from the fire signal that causes the perforating gun to fire.

The methods may include wherein the actuation signal and the self-destruct signal are the same signal. For configurations including a perforating gun therewith, the actuation signal, the fire signal, and/or the self-destruct signal, or any combinations thereof may be the same signal or separate distinct signals from the controller.

In many applications, the fracturing fluid begins to be pumped into the wellbore before the first actuation signal is sent to the transport member of the second completion assembly. In many embodiments, all components of the tool assembly except for the plurality of adaptable sealing devices are fabricated from a friable material. The friable components are designed to self-destruct into relatively small pieces of debris. At least a portion of the debris may embed into the secondary sealing portion of the adaptable perforation sealing devices so as to form a tertiary seal between the primary sealing portion and the perforation. A remainder of the debris may also fall harmlessly in the wellbore. Alternatively, the transport members are designed to self-destruct in response to the first actuation signals such that destruction of the respective transport members causes the release of the respective sealing devices.

BRIEF DESCRIPTION OF THE DRAWINGS

So that the present inventions can be better understood, certain exemplary drawings, charts, graphs and/or flow charts are appended hereto. It is to be noted, however, that the drawings illustrate only selected embodiments of the inventions and are therefore not to be considered limiting of scope, for the inventions may admit to other equally effective embodiments and applications.

FIG. 18A presents a wellbore having been lined with a string of production casing. Annular packers are placed along the wellbore to isolate selected subsurface zones. The zones are identified as "A," "B" and "C." An autonomous perforating gun has been dropped into the wellbore.

FIG. 18B shows Zone A having received the autonomous perforating gun. The perforating gun includes a plug as part of a perforating assembly. The plug has been set autonomously adjacent a packer below Zone A.

FIG. 18C shows Zone A having been perforated. The autonomous perforating gun has disintegrated and is no longer visible. Simultaneously, a fracturing fluid is being pumped into the wellbore, with a new autonomous perforating gun being released into the wellbore behind the fracturing fluid.

FIG. 18D shows the fracturing fluid having been pumped through the perforations in Zone A. Artificial fractures have been induced in the subsurface formation along Zone A. Simultaneously, the autonomous perforating gun of FIG. 6C has fallen to a location along Zone B.

FIG. 18E shows that ball sealers have landed in the perforations along Zone A. Additionally, the perforating gun of FIG. 6D has fired, creating fractures along Zone B. A new fracturing fluid is now being pumped in the wellbore in anticipation of treating Zone B. The perforating gun of FIG. 6D has disintegrated.

FIG. 18F shows the fracturing fluid of FIG. 18E now being pumped into the perforations along Zone B. Artificial fractures are being formed along Zone B. Simultaneously, a new autonomous fracturing gun has been released into the wellbore in anticipation of creating perforations along Zone C.

DETAILED DESCRIPTION

Figure 1:
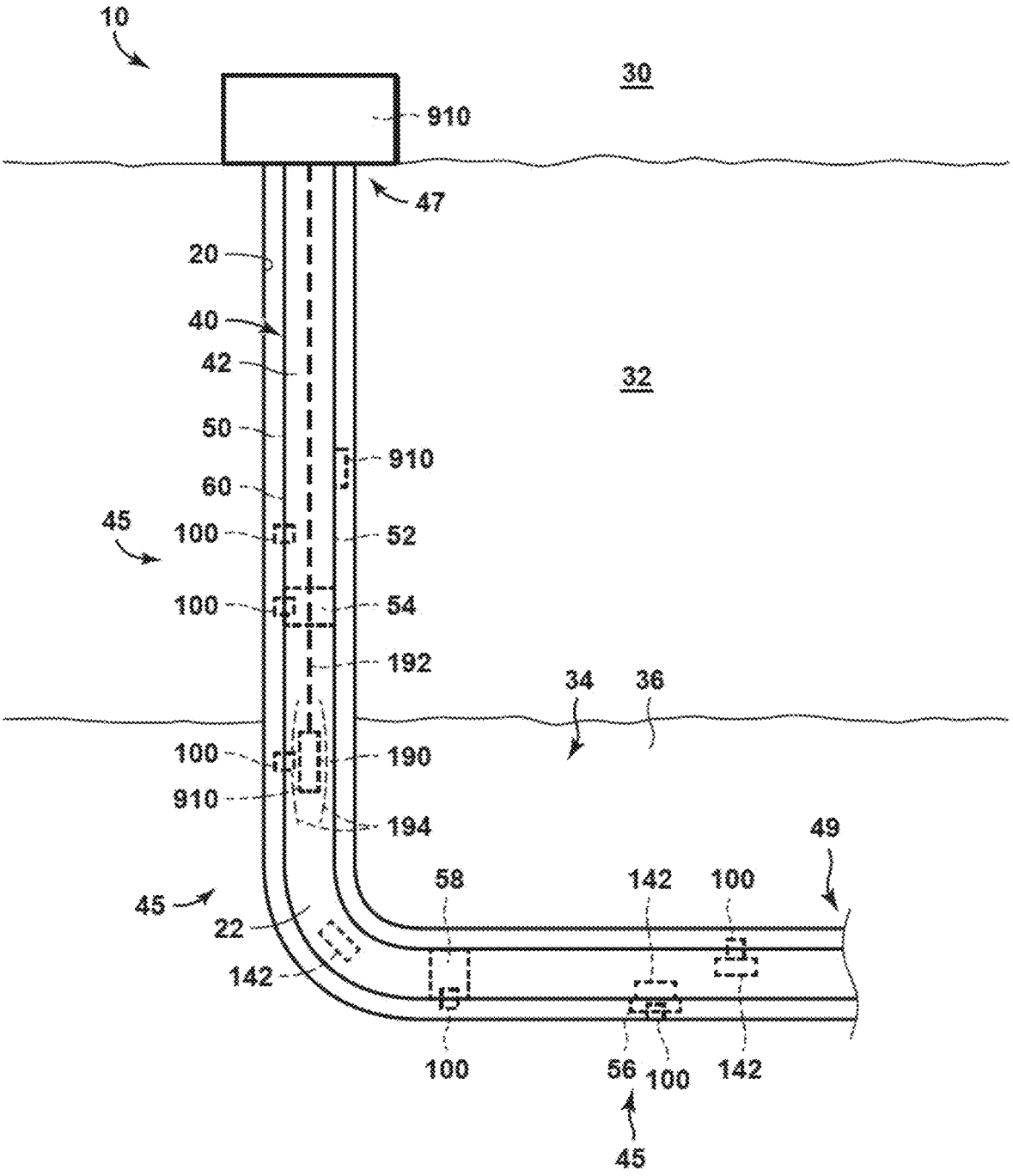
FIG. 1 is a schematic representation of examples of a hydrocarbon well that may include and/or utilize selective stimulation ports, wellbore tubulars, and/or methods according to the present disclosure.

The inventions are described herein in connection with certain exemplary general and specific embodiments. However, to the extent that the following detailed description is specific to a particular embodiment or a particular use, such is intended to be illustrative for disclosure and teaching purposes only and is not to be construed as limiting the scope of the included embodiments or improvements.

Definitions

As used herein, the term "hydrocarbon" refers to an organic compound that includes primarily, if not exclusively, the elements hydrogen and carbon. Hydrocarbons may also include other elements, such as, but not limited to, halogens, metallic elements, nitrogen, oxygen, and/or sulfur. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions or at ambient conditions (15° C. to 20° C. and 1 atm pressure). Hydrocarbon fluids may include, for example, oil, natural gas, coalbed methane, shale oil, pyrolysis oil, pyrolysis gas, a pyrolysis product of coal, and other hydrocarbons that are in a gaseous or liquid state.

As used herein, the terms "produced fluids" and "production fluids" refer to liquids and/or gases removed from a subsurface formation, including, for example, an organic-rich rock formation. Produced fluids may include both hydrocarbon fluids and non-hydrocarbon fluids. Production fluids may include but are not limited to oil and other hydrocarbon fluids, natural gas, pyrolyzed shale oil, synthesis gas, a pyrolysis product of coal, carbon dioxide, hydrogen sulfide and water (including steam).

As used herein, the term "fluid" refers to gases, liquids, and combinations of gases and liquids, as well as to combinations of gases and solids, combinations of liquids and solids, and combinations of gases, liquids, and solids.

As used herein, the term "gas" refers to a fluid that is in its vapor phase at 1 atm and 15° C.

As used herein, the term "oil" refers to a hydrocarbon fluid containing primarily a mixture of condensable hydrocarbons.

As used herein, the term "subsurface" refers to geologic strata occurring below the earth's surface.

As used herein, the term "formation" refers to any definable subsurface region. The formation may contain one or more hydrocarbon-containing layers, one or more non-hydrocarbon containing layers, an overburden, and/or an underburden of any geologic formation.

The terms "zone" or "zone of interest" refers to a portion of a formation containing hydrocarbons. Alternatively, the formation may be a water-bearing interval.

For purposes of the present patent, the term "production casing" includes a liner string or any other tubular body fixed in a wellbore along a zone of interest, which may or may not extend to the surface.

The term "friable" means any material that is easily crumbled, powdered, pulverized, and/or otherwise shattered or broken into small pieces or particles that do not require subsequent mechanical milling or drilling to further reduce the size of the pieces or particles to enable removal from the wellbore, such that remaining pieces are small enough not to adversely delay future completion or production operations. The term "friable" includes but is not limited to, for example, frangible and rigid materials, such as ceramics and cast materials such as cast metals and alloys, that may be created through destruction of a portion of the autonomous tool assembly, such as by impact or shock due to explosive charge.

As used herein, the term "wellbore" refers to a hole in the subsurface made by drilling or insertion of a conduit into the subsurface. A wellbore may have a substantially circular cross section, or other cross-sectional shapes. As used herein, the term "well," when referring to an opening in the formation, may be used interchangeably with the term "wellbore."

The term "perforation" as used herein, is defined broadly to include any of a variety of apertures in a wellbore wall, including not only perforations created in-situ, using shaped charges and perforating guns and by abrasive jetting nozzles, but also includes for example, perforations created in wellbore casing before the casing is installed in the wellbore, such as apertures used with sliding sleeves, frac ports, insert perforation conduits, erosion resistant (e.g., titanium) inserts, subsurface stimulation ports (SSP's), that enable stimulation fluid flow from inside of a wellbore conduit to the subterranean formation.

Exemplary Embodiments

The disclosed apparatus and systems include an autonomously deliverable well-completion tool assembly that include a delivery system for effectively transporting a plurality of adaptable perforation sealing devices along a wellbore for autonomous release downhole in the wellbore, typically above or in proximity to a recently stimulated set of wellbore perforations that the adaptable sealing devices are intended to seal. Disclosed are various aspects and embodiments of the improved autonomously delivered tool assemblies and methods for use thereof that may also deploy a perforating gun along with the plurality of improved adaptable perforation sealing devices for creating a new set of wellbore perforations in conjunction with or substantially in conjunction with release of the adaptable sealing devices to seal the previously existing wellbore perforations.

In still other aspects, embodiments of the disclosed tool assemblies may be sequentially, autonomously deployed into the wellbore for perforating and then sealing existing stimulated perforations post fracture-stimulation, such as by deployment of a separate such tool assembly for each perforating and stimulation stage. In other aspects, a tool assembly may be autonomously deployed into the wellbore during or near the end of a fracture stimulation job for sealing-off or isolating a set of recently stimulated perforations, setting a bridge plug, deploying a frac ball or plug, and/or opening or creating new perforations for the next stimulation treatment. The presently disclosed technology may facilitate improved completion reliability and effectiveness in isolating perforations and properly diverting stimulation treatment fluid as compared to previously known conventional methods.

The Figures provide examples of various apparatus, systems, and methods related to the present disclosure, such as may be useful in completing hydrocarbon wells, according to the present disclosure. In the provided Figures, elements or components that serve a similar or at least substantially similar purpose are labeled with like numbers in each of the Figures and these elements may not be repeatedly discussed in full detail herein with reference to each of the Figures. Similarly, all elements may not be labeled in each of the Figures, but reference numerals associated therewith may be utilized herein for consistency. Elements, components, and/or features that are discussed herein with reference to one or more of the Figures may be included in and/or utilized with any of the Figures without departing from the scope of the present disclosure. In general, elements that are likely to be included in a particular embodiment are illustrated in solid lines, while elements that are optional are illustrated in dashed lines. However, elements that are depicted in solid lines may not be essential and in some embodiments may be omitted without departing from the disclosed scope.

Conventionally created perforations such as may be created by shaped charges or by abrasive-fluid-jets are two examples of the types of perforations that may be sealed by the adaptable perforation sealing devices according to the present disclosure. The wellbore illustrated in FIG. 1 is an exemplary schematic representation of a hydrocarbon well 10 that includes another type of perforation 100 system that may be sealed by the adaptable perforation sealing devices of this disclosure. The perforations of the exemplary FIGS. 1 and 2 may include a rupturable disk, and are referred to herein as "selective stimulation ports" (SSP or SSPs) 100. Selective stimulation ports 100 are a more recent and complex technical development than the more conventional shaped charge perforations and abrasive-fluid-jet perforations, but all of three types of perforations (and others, such as orifices, apertures, openings, and perforations used with sliding sleeves, frac valves, etc.) are also applicable to the presently disclosed tool assemblies, methods, and systems, utilizing adaptable perforation sealing devices.

Figure 2:
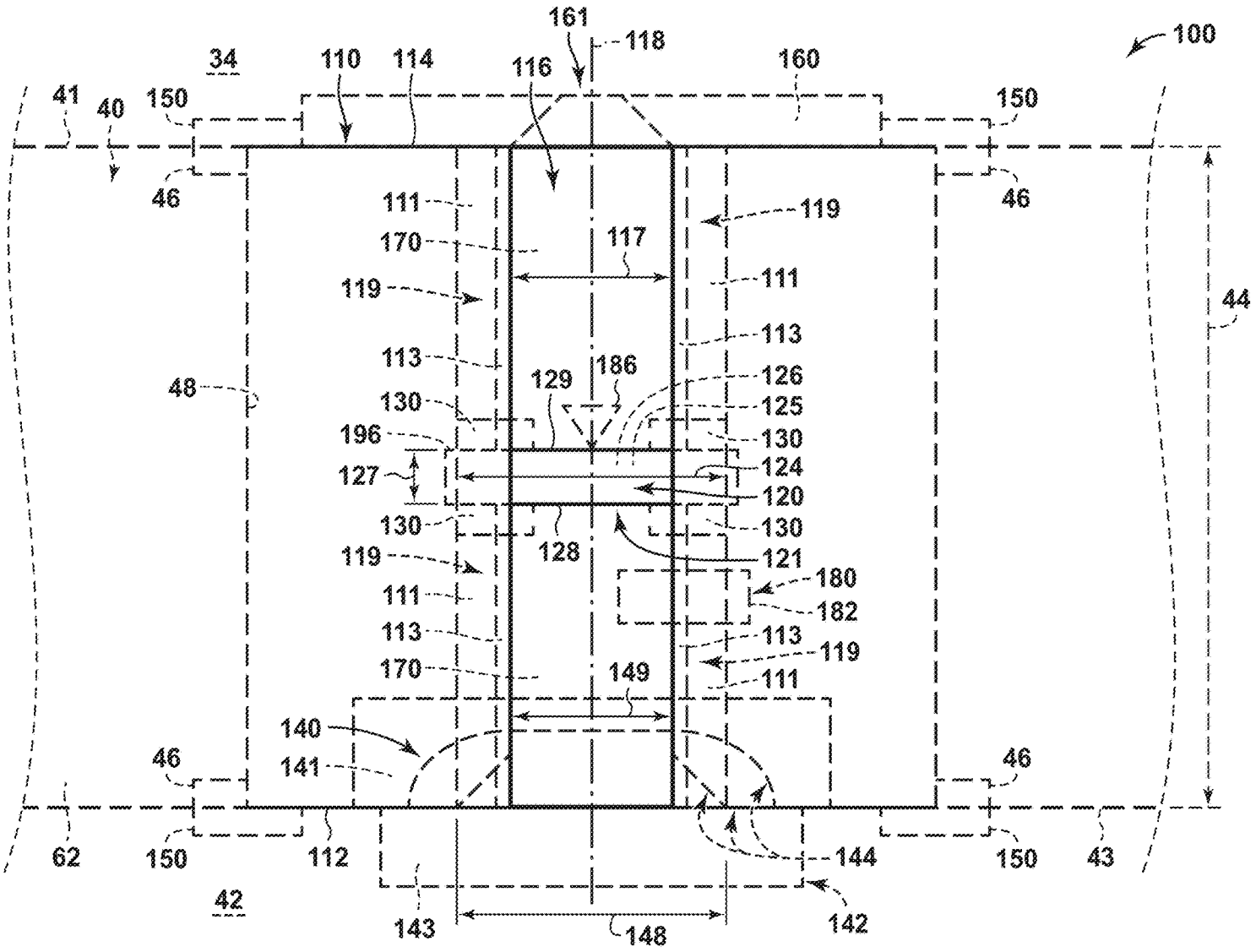
FIG. 2 is a schematic representation of selective stimulation ports according to the present disclosure.

In the illustrated FIGS. 1 and 2 example, a hydrocarbon well 10 may include a wellbore 20 that extends from a surface region 30, along a subsurface region 32, along a subterranean formation 34 of the subsurface region 32, and/or between the surface region and the subterranean formation, and even beyond the subterranean formation 34 and into another subsurface region or subsurface formation. Subterranean formation 34 may include a reservoir fluid 36 therein, such as a liquid hydrocarbon and/or a gaseous hydrocarbon, and hydrocarbon well 10 may be utilized to produce, pump, and/or convey the reservoir fluid from the subterranean formation and/or to the surface region.

Hydrocarbon well 10 further includes wellbore tubular 40, which extends within wellbore 20 and defines a tubular conduit 42. Wellbore tubular 40 includes a plurality of SSPs 100, which are discussed in more detail herein. SSPs 100 are illustrated in dashed lines in FIG. 1 to indicate that the SSPs may be operatively attached to and/or may form a portion of any suitable component of wellbore tubular 40. In addition, one or more SSP 100 is associated with, is in mechanical contact with, and/or is sealed by a corresponding sealing device 142. As discussed in more detail below, after release from the autonomously deployable tool assembly according to the present disclosure, an adaptable sealing device 142 may be flowed, via tubular conduit 42, into contact with a given SSP 100. Thus, and as illustrated in FIG. 1, hydrocarbon well 10 and/or tubular conduit 42 thereof may include both sealing devices 142 that are seated upon and/or in contact with corresponding SSPs 100, and sealing devices 142 that are present within the tubular conduit but not necessarily in contact with a corresponding SSP 100.

As also illustrated in FIG. 1 and discussed in more detail herein, in one embodiment, a hydrocarbon well 10 may include one or more perforation sealing device compartments 910 or other types of perforations or perforation-providing device, such as a sliding sleeve device or another type of operable perforation set (in some embodiments). Perforation sealing device compartments 910 (or other types of perforations as may be used in other embodiments) may be present within subsurface region 30, with the wellbore including an upper section 47 and a lower section 49, may be operatively attached to wellbore tubular 40. Wellbore tubular 40 may include and/or be any suitable tubular that may be present, located, and/or extended within wellbore 20. As examples, wellbore tubular 40 may include and/or be a casing string 50 and/or inter-casing tubing 60, which may be configured to extend within the casing string. SSPs 100 may be configured to be operatively attached to wellbore tubular 40, such as to casing string 50 and/or inter-casing tubing 60, prior to the wellbore tubular being located, placed, and/or installed within wellbore 20.

When wellbore tubular 40 includes casing string 50, SSPs 100 may be operatively attached to any suitable portion of the casing string. As examples, and as illustrated, one or more SSPs 100 may be operatively attached to one or more of a casing segment 52 of the casing string, such as a sub, or pup, joint of the casing string, a casing collar 54 of the casing string, a blade centralizer 56 of the casing string, and/or a sleeve 58 that extends around an outer surface of the casing string.

SSPs 100 may be operatively attached to wellbore tubular 40 in any suitable manner. As examples, SSPs 100 may be operatively attached to wellbore tubular 40 via any suitable mechanism, examples of which include one or more of a threaded connection, a glued connection, a press-fit connection, a welded connection, and/or a brazed connection.

As illustrated in dashed lines in FIG. 1, hydrocarbon well 10 also may include and/or have associated therewith an optional shockwave generation device 190. Shockwave generation device 190 may be configured to generate a shockwave 194 within tubular conduit 42 and/or within a wellbore fluid 22 that extends within the tubular conduit.

Shockwave generation device 190 may include and/or be any suitable structure that may, or may be utilized to, generate the shockwave within tubular conduit 42. As an example, shockwave generation device 190 may be an umbilical-attached shockwave generation device 190 that may be operatively attached to, or may be positioned within tubular conduit 42 via, an umbilical 192, such as a wireline, a tether, tubing, and/or coiled tubing. As a preferred example, shockwave generation device 190 may be an autonomously deployable shockwave generation device that may be flowed into and/or within tubular conduit 42 without an attached umbilical, such as via gravity fall, pumped, and/or tractored. As yet another example, the shockwave generation device may form a portion of one or more SSPs 100 and may be referred to as a shockwave generation structure 180, as discussed in more detail herein with reference to FIG. 2. As additional examples, shockwave generation device 190 may include an explosive charge, such as a length of primer cord and/or a blast cap. Primer cord also may be referred to herein as detonation cord and/or detonating cord and may be configured to explode and/or detonate, thereby generating shockwave 194.

Methods for perforating and stimulating (together, "completing") multiple subterranean intervals (zones) along a wellbore are also provided herein. The wellbore may have been drilled and provided with one or more strings of casing, liners, or other wellbore "tubulars." The presently disclosed methods may include deploying or otherwise releasing a series of completion tool assemblies into the wellbore. An initial autonomously or conventionally deployed or actuated perforating gun may perforate a first set of perforations in a first zone of the wellbore. Thereby, the first zone may be stimulated or otherwise treated, such as by acid and/or fracturing. A tool assembly according to the present disclosure subsequently may be deployed, such as near the end of the stimulation treatment, to isolate the first set of perforations such that another zone may be perforated and stimulated (completed). To accomplish this isolation of the first perforations, a first completion assembly in accordance with the presently disclosed apparatus, techniques, methods, and systems may be autonomously deployed. In this respect, an exemplary assembly may include an autonomously actuatable transport member containing a plurality of adaptable sealing devices, a location sensing device, and an on-board controller or computer, and on-board power. The assembly may also include a perforating gun and/or a bridge plug, frac plug, or other wellbore isolation device. The on-board controller is configured to send an actuation signal that ultimately causes release of the adaptable perforation sealers, and if present, firing of the perforating gun, when the completion assembly has reached a designated location. All components of the tool assembly are preferably destructible, such as by being fabricated from friable or otherwise destructible materials and components. In this way, the first zone is hydraulically isolated by the adaptable perforation sealers and the casing may be perforated along a second zone in the wellbore in preparation for simulating the second zone. Firing the perforating gun may be accompanied by destruction of the entire assembly or just the gun portion, either contemporaneously with firing the perforating guns or subsequent thereto. Similarly, actuating release of the adaptable sealing devices may affect destruction of the transport member, which in turn may affect simultaneously releasing all or a portion of the sealing devices into the wellbore. The sealing devices fall then flow within the wellbore with the stimulation fluid until the sealing devices encounter a perforation of sealing device seat to seat on and thereby hydraulically isolate the first zone perforations below the second zone.

The presently disclosed method also includes pumping a fracturing fluid into the wellbore behind the autonomous completion tool assembly. The method then includes further pumping the fracturing fluid through the perforations in the second zone, thereby creating fractures in a surrounding formation. Preferably, the fracturing fluid comprises a proppant such as sand.

In one aspect, the fracturing fluid begins to be pumped into the wellbore before the first actuation signal is sent to the transport member of the first completion assembly. This expedites the completion process.

In some embodiments, the method may include the steps of releasing a second completion assembly into the wellbore, sealing the perforations in the second zone using sealing devices, pumping a fracturing fluid into the wellbore behind the second completion assembly, perforating a third zone above the second zone, and further pumping the fracturing fluid through the perforations in the third zone, thereby creating additional fractures in a surrounding formation. In this instance, the second completion assembly may also include a perforating gun (optionally), a transport member containing a plurality of adaptable sealing devices that are dimensioned to seal perforations, a location sensing device for sensing the location of the perforating gun within the wellbore based on the spacing of casing collars along the wellbore, and an on-board controller. Here, the on-board computer may be configured to (i) send a first actuation signal to the transport member to release the sealing devices when the locator has recognized a third selected location of the completion assembly, wherein the sealing devices then seal perforations existing in the second zone below the third selected location, and (ii) send a second actuation signal to the perforating gun to cause one or more detonators to fire when the locator has recognized a fourth selected location of the completion assembly, thereby perforating the casing at the fourth selected location as a third zone.

FIGS. 2 through 7 provide examples of SSPs 100 according to the present disclosure. FIGS. 2 through 7 may be more detailed illustrations of SSPs 100 of FIG. 1, and any of the structures, functions, and/or features that are discussed and/or illustrated herein with reference to any of FIGS. 2 through 7 may be included in and/or utilized with SSPs 100 of FIG. 1 without departing from the scope of the present disclosure. Similarly, any of the structures, functions, and/or features that are discussed and/or illustrated herein with reference to hydrocarbon wells 10 and/or wellbore tubulars 40 of FIG. 1 may be included in and/or utilized with SSPs 100 of FIGS. 2 through 7 without departing from the scope of the present disclosure.

As illustrated collectively by FIGS. 2 through 7, SSPs 100 may include an SSP body 110 including a conduit-facing region 112, which is configured to face toward tubular conduit 42 when SSP 100 is installed within wellbore tubular 40 and/or within a tubular body 62 thereof. SSPs 100 also may include a formation-facing region 114, which is configured to face toward subterranean formation 34 when the SSP is installed within the wellbore tubular and the wellbore tubular extends within the subterranean formation. SSP and/or SSP body 110 thereof includes and/or defines an SSP conduit 116, which extends between conduit-facing region 112 and formation-facing region 114. Additionally or alternatively, SSP conduit 116 may be referred to herein as extending between an external surface 41 of tubular body 62 and an internal surface 43 of the tubular body, and the inner surface of the tubular body may be referred to herein as defining tubular conduit 42. As discussed in more detail herein, SSP conduit 116 may selectively establish a fluid flow path between tubular conduit 42 and subterranean formation 34.

Figure 3:
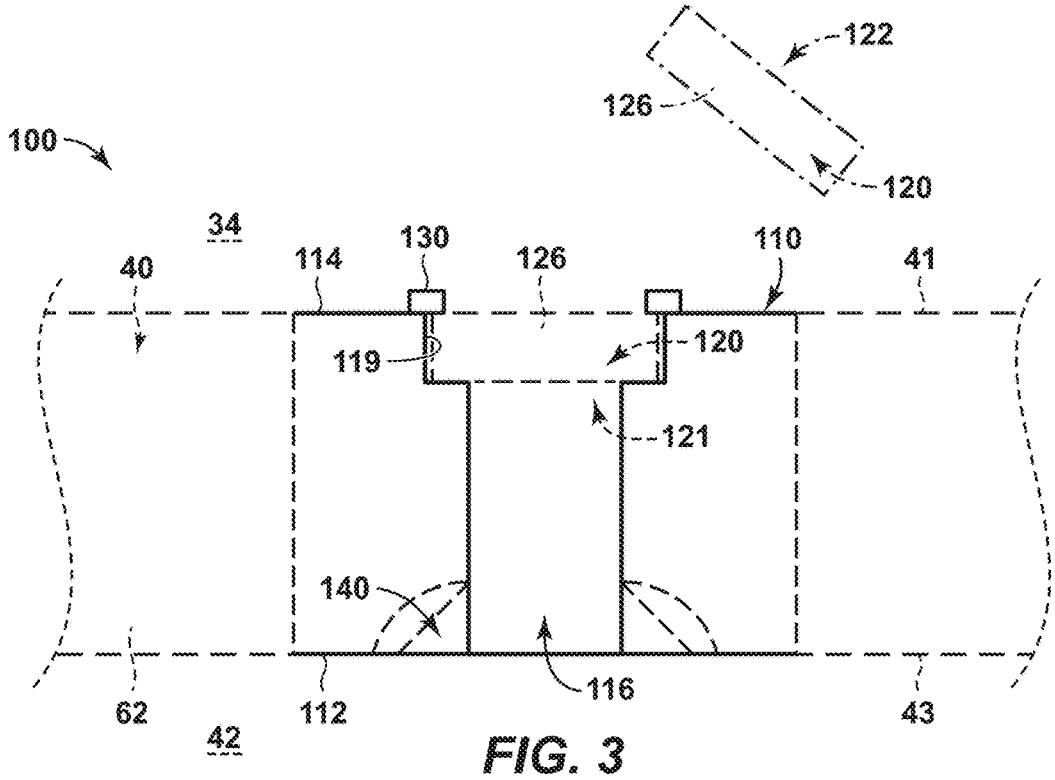
FIG. 3 is a less schematic cross-sectional view of selective stimulation ports according to the present disclosure.
Figure 4:
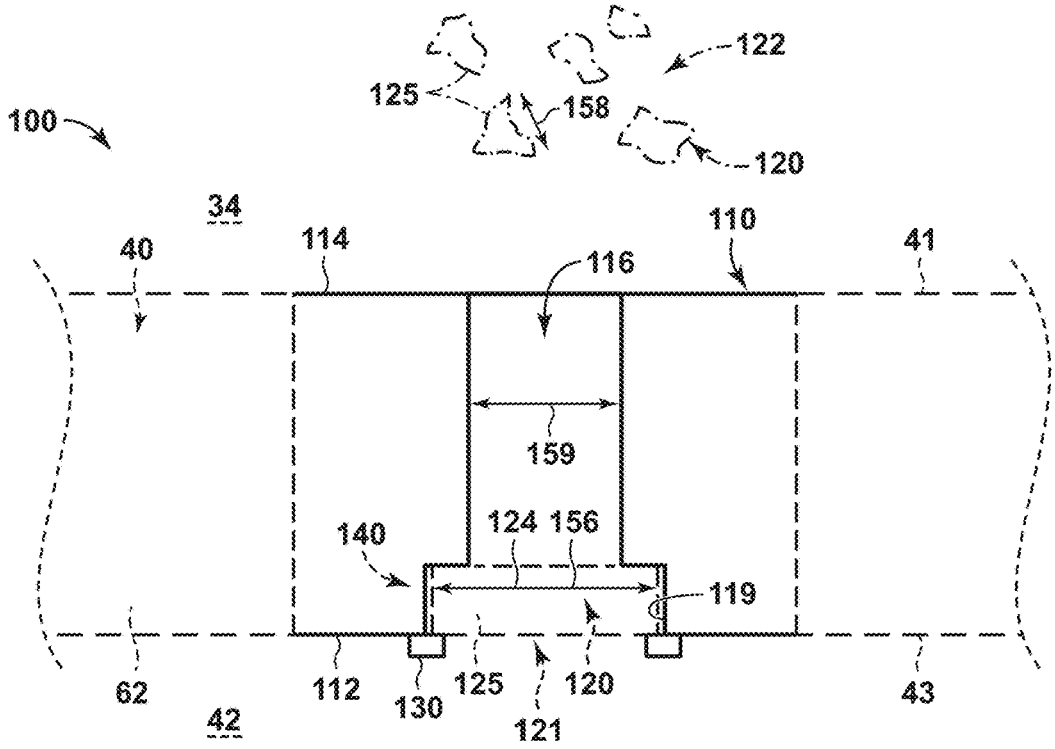
FIG. 4 is another less schematic cross-sectional view of selective stimulation ports according to the present disclosure.

SSP 100 also may include an isolation device 120. Isolation device 120 may extend within and/or across SSP conduit 116 and may be configured to selectively transition, or to be selectively transitioned, from a closed state 121, as illustrated in FIGS. 2 through 4 and 7, to an open state 122, as illustrated in FIGS. 3 through 4. When isolation device 120 is in closed state 121, the isolation device restricts, blocks, and/or occludes fluid flow within the SSP conduit, through the SSP conduit, and/or between tubular conduit 42 and subterranean formation 34 via the SSP conduit. Conversely, and when isolation device 120 is in open state 122, the isolation device permits, facilitates, does not restrict, does not block, and/or does not occlude the fluid flow within the SSP conduit, through the SSP conduit, and/or between tubular conduit 42 and subterranean formation 34 via the SSP conduit. Transitioning isolation device 120 from the closed state to the open state also may be referred to herein as transitioning SSP 100 from the closed state to the open state and/or as transitioning SSP conduit 116 from the closed state to the open state.

Isolation device 120 may be configured to transition from the closed state to the open state responsive to, or responsive to experiencing, a shockwave that has greater than a threshold shockwave intensity. A shockwave that has greater than the threshold shockwave intensity may be referred to herein as a threshold shockwave, a triggering shockwave, and/or a transitioning shockwave. The shockwave may be generated by a shockwave generation structure 180, which may be present within and/or may form a portion of SSP 100 and is illustrated in FIG. 2, and/or by a shockwave generation device 190, which may be separated and/or distinct from SSP 100 and is illustrated in FIG. 1. The shockwave may be generated within a wellbore fluid 22 and may be propagated from the shockwave generation device or the shockwave generation structure to the SSP via the wellbore fluid, as illustrated in FIG. 1. Examples of the wellbore fluid include reservoir fluid 36 and/or a stimulant fluid, as discussed in more detail herein.

SSP 100 further may include a retention device 130, as illustrated in FIGS. 2 through 4 and 7. Retention device 130 may be configured to couple, or operatively couple, isolation device 120 to SSP body 110, such as to retain the isolation device in the closed state prior to receipt of the threshold shockwave. Retention device 130 optionally may be configured to permit and/or facilitate transitioning of isolation device 120 from the closed state to the open state responsive to receipt of the threshold shockwave.

Figure 7:
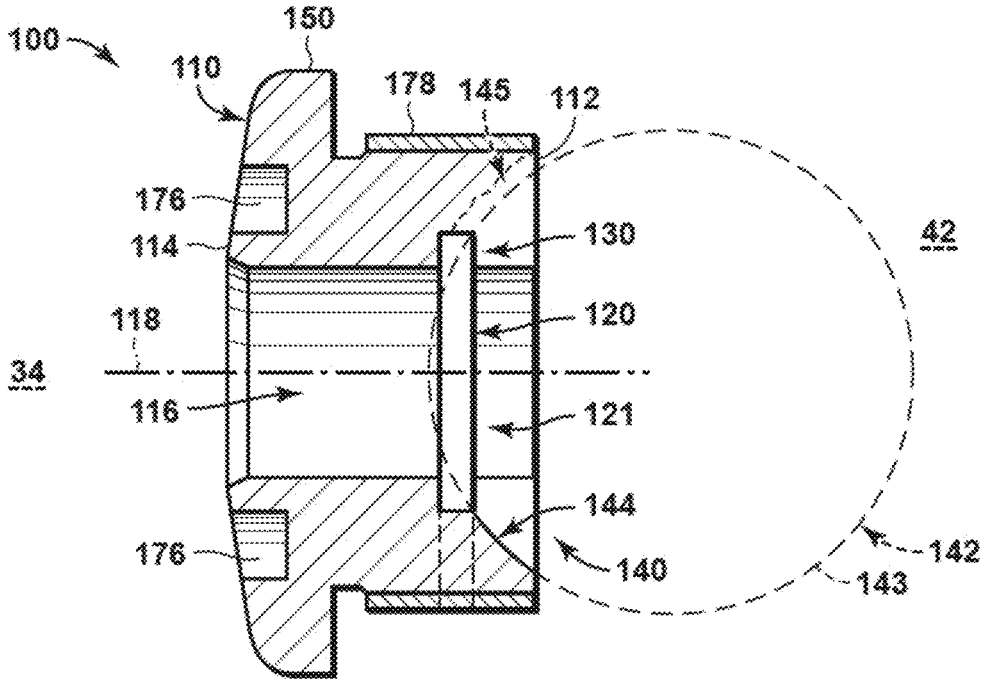
FIG. 7 is a cross-sectional view of the selective stimulation port of FIGS. 5 through 6 taken along line 7-7 of FIG. 6.

SSP 100 includes a sealing device seat 140, as illustrated in FIGS. 2 through 5 and 7. Sealing device seat 140 may be defined by conduit-facing region 112 of SSP body 110. In addition, sealing device seat 140 may be shaped to form a fluid seal 144 with a sealing device 142, as illustrated in FIGS. 2 and 7. The sealing device may be positioned on and/or in contact with the sealing device seat, such as to form the fluid seal, by flowing, via tubular conduit 42, into engagement with the sealing device seat. When the sealing device is engaged with the sealing device seat to form the fluid seal, the sealing device restricts, or selectively restricts, fluid flow from tubular conduit 42 to subterranean formation 34 via SSP conduit 116.

As discussed in more detail herein, wellbore tubulars 40 may have one or more SSPs 100 operatively attached thereto prior to the wellbore tubular being located, placed, and/or positioned within the wellbore. The SSPs may be in the closed state during operative attachment to the wellbore tubular and/or while the wellbore tubular is positioned within the wellbore. Subsequently, shockwave generation structure 180 of FIG. 2 and/or shockwave generation device 190 of FIG. 1 may be utilized to generate the shockwave within the wellbore fluid that extends within the tubular conduit and/or that extends in fluid communication with the isolation device. The shockwave may propagate within the wellbore fluid and/or to the SSP and may be received and/or experienced by at least a portion of the one or more SSPs.

However, the shockwave also is attenuated, is dampened, and/or decays as it propagates within the wellbore fluid. Thus, the shockwave will only have greater than the threshold shockwave intensity within a specific region of the wellbore tubular, and the one or more SSPs will only transition from the closed state to the open state if the one or more SSPs is located within this specific region of the wellbore tubular (i.e., if the shockwave has greater than the threshold shockwave intensity when the shockwave reaches, or contacts, the one or more SSPs). Thus, individual, selected, and/or specific SSPs 100 may be transitioned from the closed state to the open state without transitioning, or concurrently transitioning, other SSPs that are outside, or that are not within, the specific region of the wellbore tubular. Such a configuration may permit SSPs 100, according to the present disclosure, to be more selectively actuated, via the shockwave, when compared to more universally applied pressure spikes, which may act upon an entirety of a length of the wellbore tubular.

The shockwave may be attenuated, within the wellbore fluid, at any suitable (non-zero) shockwave attenuation rate. As examples, the shockwave attenuation rate may be at least 1 megapascal per meter (MPa/m), at least 2 MPa/m, at least 4 MPa/m, at least 6 MPa/m, at least 8 MPa/m, at least 10 MPa/m, at least 12 MPa/m, at least 14 MPa/m, at least 16 MPa/m, at least 18 MPa/m, or at least 20 MPa/m.

The shockwave also may have any suitable (non-zero) shockwave intensity, which also may be referred to herein as a peak shockwave pressure and/or as a maximum shockwave pressure. As examples, the shockwave intensity may be at least 100 megapascals (MPa), at least 110 MPa, at least 120 MPa, at least 130 MPa, at least 140 MPa, at least 150 MPa, at least 160 MPa, at least 170 MPa, at least 180 MPa, at least 190 MPa, at least 200 MPa, at least 250 MPa, at least 300 MPa, at least 400 MPa, or at least 500 MPa.

Similarly, the shockwave may have any suitable duration, which also may be referred to herein as a maximum duration, a shockwave duration, and/or a maximum shockwave duration. Examples of the maximum duration include durations of less than 1 second, less than 0.9 seconds, less than 0.8 seconds, less than 0.7 seconds, less than 0.6 seconds, less than 0.5 seconds, less than 0.4 seconds, less than 0.3 seconds, less than 0.2 seconds, less than 0.1 seconds, less than 0.05 seconds, or less than 0.01 seconds. The maximum duration may be a maximum period of time during which the shockwave has greater than the threshold shockwave intensity within the wellbore tubular. Additionally or alternatively, the maximum duration may be a maximum period of time during which the shockwave has a shockwave intensity of greater than 68.9 MPa (10,000 pounds per square inch) within the wellbore tubular.

With the above in mind, the shockwave may exhibit greater than the threshold shockwave intensity over only a fraction of a length of the wellbore tubular and only for a brief period of time. As examples, the shockwave may exhibit greater than the threshold shockwave intensity over a maximum effective distance of 1 meter, 2 meters, 3 meters, 4 meters, 5 meters, 6 meters, 7 meters, 8 meters, 10 meters, 15 meters, 20 meters, or 30 meters along a length of the tubular conduit. Stated another way, the shockwave may have a peak shockwave intensity proximate an origination point thereof (i.e., proximate the shockwave generation device, the shockwave generation structure, and/or a shockwave generation source thereof). The threshold shockwave intensity may be less than, or less than a threshold fraction of, the peak shockwave intensity, and an intensity of the shockwave may be less than the threshold shockwave intensity at distances that are greater than the maximum effective distance from the origination point.

The shockwave generation structure and/or the shockwave generation device may be configured such that the shockwave emanates symmetrically, or at least substantially symmetrically, therefrom. Stated another way, the shockwave generation structure and/or the shockwave generation device may be configured such that the shockwave emanates isotropically, or at least substantially isotropically, for short distances, and for detailed study may be considered to diffuse radially as it transmits or emanates radially therefrom. Stated yet another way, the shockwave generation structure and/or the shockwave generation device may be configured such that the shockwave is symmetric, or at least substantially symmetric, within a given transverse cross-section of the wellbore tubular.

SSP 100 and/or SSP body 110 thereof may include any suitable structure that may have, include, and/or define conduit-facing region 112, formation-facing region 114, and/or SSP conduit 116. In addition, SSP 100 and/or SSP body 110 thereof may be formed from any suitable material, and the SSP body may be formed from a different material than a material of wellbore tubular 40, than a material of a majority of wellbore tubular 40, and/or than a material that comprises a portion of wellbore tubular 40 that is operatively attached to SSP 100 and/or to SSP body 110 thereof.

It is within the scope of the present disclosure that SSP 100 and/or SSP body 110 thereof may be a single-piece, or monolithic. Alternatively, it also is within the scope of the present disclosure that SSP 100 and/or SSP body 110 thereof may be a composite that may be formed from a plurality of distinct, separate, and/or chemically different components.

As illustrated in dashed lines in FIG. 2, SSP 100 and/or SSP body 110 thereof may be separate from, distinct from, and/or may be formed from a different material than wellbore tubular 40. Under these conditions, SSP body 110 may be configured to be operatively attached to the wellbore tubular with the SSP body extending through a tubular aperture 48 that may be defined within the wellbore tubular and/or that may extend between tubular conduit 42 and an external surface 41 of the wellbore tubular. In such a configuration, SSP 100 and/or SSP body 110 thereof may include a projecting region 150 that may be configured to project past tubular aperture 48. The projecting region may project transverse, or perpendicular to, a central axis 118 of SSP conduit 116. Stated another way, at least a portion of SSP 100 and/or SSP body 110 thereof may have a maximum outer diameter that is greater than an inner diameter of tubular aperture 48. In such a configuration, wellbore tubular 40 may define a recess 46 that may be configured to receive projecting region 150.

Additionally or alternatively, SSP 100 and/or SSP body 110 thereof also may be at least partially defined by wellbore tubular 40 and/or by any suitable component thereof. As examples, SSP 100 and/or SSP body 110 thereof may be partially, or even completely, defined by casing string 50, casing segment 52, casing collar 54, blade centralizer 56, sleeve 58, and/or inter-casing tubing 60 of FIG. 1.

As illustrated in FIG. 2, SSP 100 and/or SSP body 110 thereof may be configured such that the SSP does not extend into tubular conduit 42 and/or such that the SSP does not extend, or project, past internal surface 43 of wellbore tubular 40 that defines tubular conduit 42. Stated another way, conduit-facing region 112 and/or sealing device seat 140 of SSP 100 may be flush with internal surface 43 and/or may be recessed within tubular aperture 48, when present. Thus, SSP 100 may not block and/or restrict fluid flow within tubular conduit 42 and/or the presence of SSP 100 may not change a transverse cross-sectional area for fluid flow within tubular conduit 42.

Stated yet another way, a transverse cross-sectional area of a portion of the tubular conduit that includes one or more SSPs may be at least a threshold fraction of a transverse cross-sectional area of a portion of the tubular conduit that does not include an SSP, or any SSPs. Examples of the threshold fraction of the transverse cross-sectional area include threshold fractions of at least 80 percent, at least 85 percent, at least 90 percent, at least 92.5 percent, at least 95 percent, at least 96 percent, at least 97 percent, at least 98 percent, or at least 99 percent of the transverse cross-sectional area.

As discussed in more detail herein, conventional stimulation methods may utilize a shape-charge perforation device to create, generate, and/or define one or more perforations within a casing string that extends within a subterranean formation. As also discussed, such perforations may not be symmetrical, may not be round, and/or may not form a fluid-tight seal with sealing device 142. In addition, and as also discussed, stimulation of the subterranean formation may include flowing a stimulant fluid that may include particulate material through the perforations, which may be abrasive to the perforations, and/or flowing a stimulant fluid that may include a corrosive material through the perforations, which may corrode the perforations. Additionally or alternatively, long-term flow of the reservoir fluid through the perforations also may corrode the perforations. Thus, flow of the stimulant fluid through the perforations further may change the shape of the perforations. This change in shape further may decrease an ability for the perforations to form a fluid-tight seal with the sealing device and/or may cause an increase in a cross-sectional area for fluid flow through the perforations, thereby increasing a flow rate of the stimulant fluid through the perforations for a given pressure drop thereacross. Either situation may be detrimental to, may decrease a reliability of, and/or may increase a complexity of stimulation operations that utilize perforations created by shape-charge perforation devices.

With this in mind, SSPs 100 according to the present disclosure may be at least partially erosion-resistant and/or corrosion-resistant, or at least more erosion-resistant and/or corrosion-resistant than wellbore tubular 40. As an example, SSP body 110 may include and/or be an erosion-resistant SSP body that may be configured to resist erosion by the particulate material. As a more specific example, the SSP body may include an erosion-resistant material that is more resistant to erosion than a material forming a portion of the wellbore tubular to which the SSP is attached. The erosion-resistant material may form at least a portion of any suitable region and/or component of SSP body 110. As examples, the erosion-resistant material may form at least a portion of conduit-facing region 112, formation-facing region 114, sealing device seat 140, and/or an internal portion of SSP body 110 that defines SSP conduit 116.

It is within the scope of the present disclosure that the erosion-resistant material may form and/or define the entire, or an entirety of, SSP body 110. Alternatively, it also is within the scope of the present disclosure that the erosion-resistant material may form only a portion, a subset, or less than an entirety of the SSP body and/or that the erosion-resistant material may be different from a material of a remainder of the SSP body. As an example, the erosion-resistant material may include and/or be an erosion-resistant sleeve 111 that is operatively attached to the SSP body and/or an erosion-resistant coating 113 that covers at least a portion of the SSP body, as illustrated in FIG. 2. As another example, the erosion-resistant material may include and/or be an erosion-resistant layer, coating, and/or ring that is operatively attached to and/or forms all or a portion of sealing device seat 140.

SSP 100 and/or SSP body 110 thereof additionally or alternatively may include and/or be a corrosion-resistant SSP and/or a corrosion-resistant SSP body that may be configured to resist corrosion by, within, or while in contact with, the stimulant fluid, such as a stimulant fluid that includes, or is, an acid. As a more specific example, the SSP body may include a corrosion-resistant material that is more resistant to corrosion than a material forming a portion of the wellbore tubular to which the SSP is attached. The corrosion-resistant material may form at least a portion of any suitable region and/or component of SSP body 110. As examples, the corrosion-resistant material may form at least a portion of conduit-facing region 112, formation-facing region 114, sealing device seat 140, and/or an internal portion of SSP body 110 that defines SSP conduit 116.

It is within the scope of the present disclosure that the corrosion-resistant material may form and/or define the entire, or an entirety of, the SSP body. Alternatively, it is also within the scope of the present disclosure that the corrosion-resistant material may form only a portion, a subset, or less than an entirety of the SSP body and/or that the corrosion-resistant material may be different from a material of a remainder of the SSP body. As an example, the corrosion-resistant material may include and/or be a corrosion-resistant sleeve 111 that is operatively attached to the SSP body and/or a corrosion-resistant coating 113 that covers at least a portion of the SSP body. As another example, the corrosion-resistant material may include and/or be a corrosion-resistant layer, coating, and/or ring that is operatively attached to and/or forms all or a portion of sealing device seat 140.

Examples of the erosion-resistant material, of the corrosion-resistant material, and/or of other materials that may be included within SSP body 110 include one or more of a nitride, a nitride coating, a boride, a boride coating, a carbide, a carbide coating, a tungsten carbide, a tungsten carbide coating, a self-hardening alloy, a work-hardening alloy, high manganese work-hardening steel, a ceramic, a high strength steel, a diamond-like material, a diamond-like coating, a heat-treated material, a magnetic material, and/or a radioactive material. When SSP body 110 includes and/or is formed from the magnetic material and/or the radioactive material, shockwave generation device 190 of FIG. 1 may be configured to detect and/or determine a proximity between SSP 100 and the shockwave generation device by detecting the presence of, or proximity to, the magnetic material and/or the radioactive material.

Whether or not SSP 100 and/or SSP body 110 thereof includes and/or is formed from the erosion-resistant material and/or the corrosion-resistant material, the SSP and/or the SSP body still may erode and/or corrode, at least to some extent, during utilization thereof. Stated another way, SSP 100 and/or SSP body 110 thereof may erode and/or corrode to a lesser extent when compared to a perforation that might be formed within wellbore tubular 40; however, erosion and/or corrosion of the SSP and/or of the SSP body still may be finite, detectable, and/or significant enough to impact, or decrease a reliability of, sealing between sealing device seat 140 and a sealing device. As such, and as discussed in more detail herein with reference to FIGS. 8 through 11 and 16, SSPs 100 disclosed herein may be utilized with a sealing device 142, in the form of a sealing assembly 320, that includes both a primary sealing portion 350 and a secondary sealing portion 370, and optionally a tertiary sealing particulates 380 (See FIG. 10) such as by fabricating at least a portion of the tool from a material that fragments into granular or desired sized or shaped particulates.

The autonomously delivered adaptable perforation sealing devices of this disclosure may be suitable for use with any stimulation fluid and with substantially any perforation type, such as the SSP's discussed in the present examples. The perforation may include an aperture (including a conduit or orifice that extends between the wellbore conduit-facing region and the formation-facing region and/or that may be configured to convey a fluid between the wellbore tubular conduit (e.g., casing or liner) and the subterranean formation when isolation device 120 is in the open state or when the perforation has otherwise been opened to flow.

Isolation device 120 may include and/or be any suitable structure that may extend within SSP conduit 116, which may selectively restrict fluid flow through the SSP conduit, and/or which may be configured to selectively transition from the closed state to the open state responsive to the threshold shockwave. In general, isolation device 120 may be adapted, configured, designed, and/or constructed only to exhibit a single, or irreversible, transition from the closed state to the open state. As examples, and as discussed in more detail herein, isolation device 120 may be configured to break apart, to be destroyed, to be displaced from, and/or to irreversibly separate from a remainder of SSP 100 and/or from SSP body 110 upon transitioning from the closed state to the open state.

Isolation device 120 may include and/or be formed from any suitable material. As examples, the isolation device may include and/or be formed from a magnetic material and/or a radioactive material and/or acid soluble material. Additional examples of materials of isolation device 120 are disclosed herein. When isolation device 120 includes and/or is formed from the magnetic material and/or the radioactive material, these materials may be detected by shockwave generation device 190, as discussed herein.

As discussed, isolation device 120 may be configured to transition from the closed state to the open state responsive to the threshold shockwave and examples of the threshold shockwave and the threshold shockwave intensity are disclosed herein. Isolation device 120 also may be configured to remain in the closed state, or to resist transitioning from the closed state to the open state, during, or despite, a static pressure differential thereacross. This static pressure differential may have a significant magnitude, and examples of the static pressure differential, which also may be referred to herein as a threshold static pressure differential, include pressure differentials of at least 40 MPa, at least 45 MPa, at least 50 MPa, at least 55 MPa, at least 60 MPa, at least 65 MPa, at least 68 MPa, at least 68.9 MPa, at least 70 MPa, at least 75 MPa, at least 80 MPa, at least 85 MPa, at least 90 MPa, at least 95 MPa, or at least 100 MPa.

Isolation device 120 may be positioned, located, and/or present at any suitable location within SSP 100 and/or within SSP conduit 116 thereof. As an example, and as illustrated in FIG. 2, isolation device 120 may be positioned within a central portion of SSP conduit 116, proximal a midpoint of a length of SSP conduit 116, and/or such that the isolation device is offset from conduit-facing region 112 and also from formation-facing region 114. As another example, and as illustrated in FIG. 3, isolation device 110 may be aligned with and/or proximal formation-facing region 114. As yet another example, and as illustrated in FIG. 4, isolation device 120 may be aligned with and/or proximal conduit-facing region 112. Under these conditions, isolation device 120 may protect sealing device seat 140 from abrasion and/or corrosion while in closed state 121.

Isolation device 120 also may have any suitable isolation device thickness 127, as illustrated in FIG. 2. As an example, isolation device thickness 127 may be less than a wellbore tubular thickness 44 of wellbore tubular 40. Both isolation device thickness 127 and wellbore tubular thickness 44 may be measured in a direction that is parallel to central axis 118 of SSP conduit 116.

As illustrated in FIGS. 2-4, SSP body 110 may include and/or define an isolation device recess 119, which may be configured to receive isolation device 120. Isolation device recess 119 may extend from conduit-facing region 112 of SSP body 110, as illustrated schematically in FIG. 2 and less schematically in FIG. 4. Additionally or alternatively, isolation device recess 119 also may extend from formation-facing region 114 of SSP body 110, as illustrated schematically in FIG. 2 and less schematically in FIG. 3. When SSP body 110 includes isolation device recess 119, retention device 130 may be configured to at least temporarily retain the isolation device within the isolation device recess, as also illustrated in FIGS. 2-4.

Isolation device 120 also may have and/or define any suitable shape. As an example, a shape of an outer perimeter of isolation device 120 may be complementary to, or may correspond to, a transverse cross-sectional shape of isolation device recess 119, when present, and/or to a transverse cross-sectional shape of SSP conduit 116. As another example, and as illustrated in FIG. 2, isolation device 120 may include a conduit-facing side 128 and a formation-facing side 129, and the conduit-facing side and/or the formation-facing side may be planar, at least substantially planar, arcuate, partially spherical, partially parabolic, partially cylindrical, and/or partially hyperbolic. Stated another way, isolation device 120 may have a non-constant thickness as measured in a direction that extends between conduit-facing region 112 and formation-facing region 114 of SSP body 110 and/or as measured in a direction that is parallel to central axis 118.

In general, the shape of the isolation device may be selected such that the isolation device is shaped to resist at least a threshold static pressure differential between conduit-facing side 128 and formation-facing side 129 without damage thereto. Examples of the threshold static pressure differential are disclosed herein.

An example of isolation device 120 is an isolation disk 126, as illustrated in FIGS. 2-3. As illustrated in dashed lines in FIG. 3, isolation disk 126 may be configured to be retained within SSP 100 by retention device 130 when the isolation device is in closed state 121. However, and as illustrated in dash-dot lines, isolation disk 120 may be configured separate from a remainder of SSP 100 and/or to be displaced or otherwise conveyed into subterranean formation 34 in an intact, or at least substantially intact, state when the isolation device transitions to open state 122. This may include the isolation disk being conveyed from formation-facing region 114 of SSP body 110 and/or being conveyed from a formation-facing end of SSP conduit 116, with the formation-facing end of the SSP conduit being defined by formation-facing region 114. Isolation disk 126 may include any suitable material and/or materials of construction, examples of which include a metallic isolation disk that may be formed from one or more of steel, stainless steel, cast iron, a metal alloy, brass, and/or copper. When SSPs 100 include isolation disk 126 of FIGS. 2-3, and as discussed in more detail herein, retention device 130 may be configured to selectively release the isolation disk from the SSP responsive to the threshold shockwave.

Another example of isolation device 120 is a frangible isolation device 120 that is formed from a frangible material. The frangible material may be configured to break apart, to be destroyed, and/or to disintegrate responsive to, responsive to experiencing, and/or responsive to receipt of the threshold shockwave. Such an isolation device also may be referred to herein as a frangible disk 125 and/or as a frangible isolation disk 125 and is illustrated in FIGS. 2 and 4. Examples of the frangible material include a glass, a tempered glass, a ceramic, a frangible magnetic material, a frangible radioactive material, a frangible ceramic magnet, a frangible alloy, and/or an acrylic.

Additionally or alternatively, isolation device 120 may include and/or be formed from an explosive material that is configured to detonate and/or explode responsive to, responsive to experiencing, and/or responsive to receipt of the threshold shockwave. An isolation device 120 with this explosive material may be referred to as an explosive isolation device 120. Examples of explosive material that may be utilized include a solid explosive material, a brittle explosive material, a frangible explosive material, and/or a solid rocket fuel. The explosive material also may be referred to herein as an accelerant that accelerates stimulation of the subterranean formation due to the resulting explosion and generation of gases that promote greater fracturing initiation and/or stimulation of the subterranean formation.

As discussed, frangible isolation devices 120, such as frangible disks 125, may be configured to break apart responsive to receipt of the threshold shockwave. As an example, and as illustrated in FIG. 4, such isolation devices may comprise a single piece prior to receipt of the threshold shockwave (as illustrated in dashed lines) and may comprise a plurality of spaced-apart pieces subsequent to receipt of the threshold shockwave (as illustrated in dash-dot lines). As another example, and when the isolation device is in closed state 121 (i.e., prior to receipt of the threshold shockwave), the isolation device may define a first maximum dimension 156, such as an outer diameter 124. Conversely, and when the isolation device is in open state 122 (i.e., subsequent to receipt of the threshold shockwave), the isolation device may define a second maximum dimension 158 that is less than the first maximum dimension. As further illustrated in FIG. 4, and while in closed state 121, outer diameter 124 of isolation device 120 may be greater than a minimum outer diameter 159 of SSP conduit 116. However, when in open state 122, second maximum dimension 158 may be less than minimum outer diameter 159.

Returning to FIG. 2, and as illustrated in dashed lines, SSP 100 also may include a sealing structure 196. Sealing structure 196 may be configured to restrict fluid flow within SSP conduit 116 and past isolation device 120 when the isolation device is in closed state 121. As examples, sealing structure 196 such as a gasket or O-ring may be configured to form a fluid seal between isolation device 120 and SSP body 110 and/or between isolation device 120 and retention device 130.

Retention device 130 may include any suitable structure that may be adapted, configured, shaped, and/or selected to couple an isolation device to the SSP body and/or to retain the isolation device in the closed state prior to receipt of the threshold shockwave. It is within the scope of the present disclosure that, responsive to receipt of the threshold shockwave, retention device 130 may be configured to release isolation device 120 from SSP 100, such as when isolation device 120 includes isolation disk 126 of FIGS. 2-3. Under these conditions, retention device 130 may change, transition, and/or be deformed upon receipt of the threshold shockwave. As an example, retention device 130 may include at least one shear pin that shears, upon receipt of the threshold shockwave, to release the isolation device. As another example, retention device 130 may include at least one snap ring and corresponding groove, and the snap ring may be displaced from the groove, upon receipt of the threshold shockwave, to release the isolation device. As yet another example, retention device 130 may include a threaded retainer, and the threaded retainer may fail, upon receipt of the threshold shockwave, to release the isolation device.

Sealing device seat 140 may include any suitable structure that may be defined by conduit-facing region 112 of SSP body 110 and/or that may be adapted, configured, designed, constructed, and/or shaped to form the fluid seal with the sealing device. In addition, sealing device seat 140 may have a preconfigured, pre-established, and/or preselected geometry, such as when the geometry of the sealing device seat is established prior to SSP 100 being operatively attached to wellbore tubular 40 and/or prior to the wellbore tubular being located, installed, and/or positioned within the subterranean formation. Sealing device seat 140 may have, define, and/or include any suitable shape, and the sealing device seat is illustrated in dashed lines in FIGS. 2-3 to illustrate several of these potential shapes.

As an additional example, and as illustrated in FIG. 2, the sealing device seat may converge, within SSP body 110, from a first diameter 148, which is defined in conduit-facing region 112 of SSP body 110, to a second diameter 149, which is defined within SSP body 110. The first diameter may be greater than the second diameter, and the second diameter may approach, or be, an outer diameter 117 of SSP conduit 116, which also may be referred to herein as an SSP conduit diameter, or average diameter, 117. However, this is not required to all embodiments.

Figure 8:
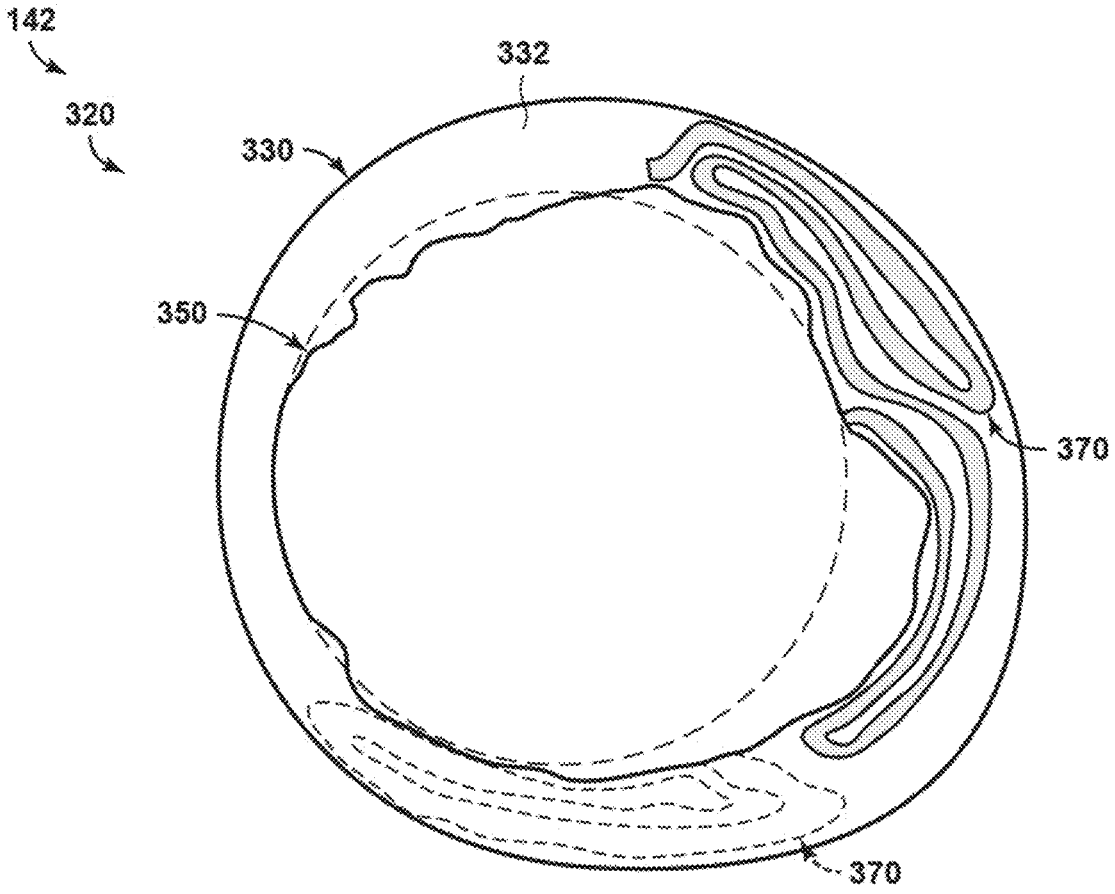
FIG. 8 is a schematic representation illustrating examples of a sealing assembly according to the present disclosure.

As illustrated in FIG. 2, sealing device 142 may be operatively positioned and/or engaged with sealing device seat 140 to form fluid seal 144, such as the adaptable perforation sealing devices 320 as described herein and illustrated in FIG. 8. An example of sealing device 142 includes a ball sealer 143 and/or an adaptable perforation sealing device 320, which is discussed in more detail below. Either way, a selected seating surface 140 may be provided and for convenience purposes may be referred to herein as a ball sealer seat 141 or just seat 141. Seat 141 may have a seat radius of curvature that is equal to or substantially equal to a radius of a primary portion of adaptable perforation sealer 320.

As discussed, SSPs 100 may include and/or be associated with autonomously shockwave generation structure 180, which may be adapted, configured, designed, and/or constructed to generate the shockwave. Shockwave generation structure 180 may include and/or be any suitable structure. As examples, shockwave generation structure 180 may include a mechanical shockwave generation structure, such as may be configured to mechanically generate the shockwave, a chemical shockwave generation structure, such as may be configured to chemically generate the shockwave, and/or an explosive shockwave generation structure, such as may be configured to explosively generate the shockwave. When SSPs 100 include shockwave generation structure 180, the SSPs further may include a triggering device 182, which may be configured to actuate the shockwave generation structure, such as to cause the shockwave generation structure to generate the shockwave. Examples of triggering device 182 include any suitable wireless, or wirelessly actuated, triggering device, remote, or remotely actuated, triggering device, and/or wired triggering device.

As illustrated in dashed lines in FIG. 2, SSP 100 further may include a transition assist structure 186. Transition assist structure 186 may be configured to assist and/or facilitate isolation device 120 transitioning from the closed state to the open state responsive to experiencing the threshold shockwave and may include any suitable structure. As an example, transition assist structure 186 may include and/or be a point load, on isolation device 120 that is configured to initiate failure of the isolation device responsive to receiving the threshold shockwave. As also illustrated in dashed lines in FIG. 2, SSP 100 may include a barrier material 170. Barrier material 170 may extend at least partially within SSP conduit 116 and may be configured to remain within the SSP conduit during installation of wellbore tubular 40 into the subterranean formation. Such a configuration may protect SSP 100 and/or isolation device 120 thereof from damage during the installation and/or may prevent foreign material from entering at least a portion of the SSP conduit during the installation. In addition, barrier material 170 also may be configured to automatically separate, such as by dissolving, from SSP 100 and/or from SSP conduit 116 thereof responsive, or subsequent, to fluid contact with the wellbore fluid.

As illustrated in dashed lines in FIG. 2, some embodiments of an SSP 100 may include an exit nozzle 160. Nozzle 160 also may be referred to herein as a restriction 161 and may be configured to generate a fluid jet at formation-facing region 114 of SSP body 110 and/or at a formation-facing end of SSP conduit 116. The fluid jet may be generated responsive to fluid flow from tubular conduit 42 and/or into subterranean formation 34 via the SSP conduit. FIG. 3 illustrates a perforation embodiment having an externally mounted, dischargeable or removable sealing device 120, while FIG. 4 illustrates a perforation embodiment having an internal-surface mounted, dischargeable or removable perforation isolation device 120. The presently disclosed autonomously deliverable tools may be useful for providing adaptable perforation sealing devices that seal either of such embodiments.

Figure 5:
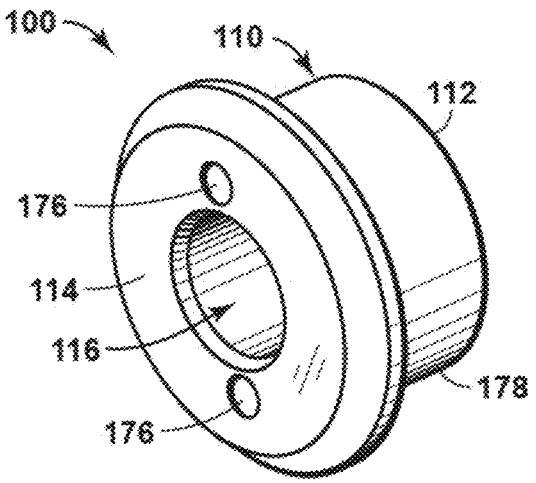
FIG. 5 is a less schematic profile view of a selective stimulation port according to the present disclosure.
Figure 6:
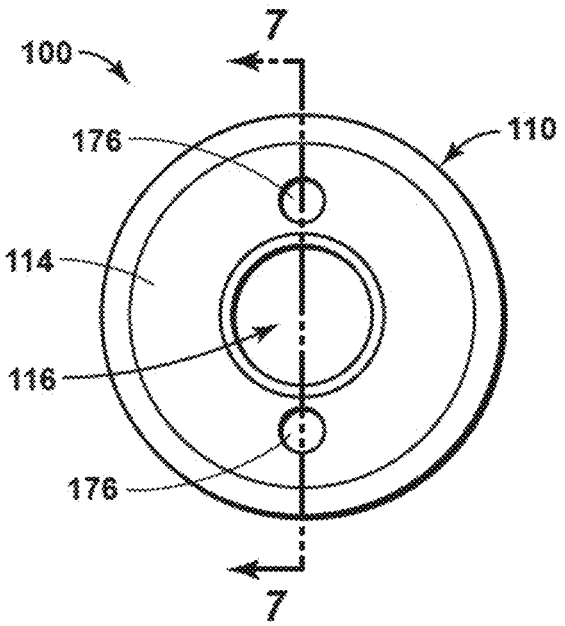
FIG. 6 is a view of formation-facing side of selective stimulation port of FIG. 5.

FIG. 5 is a less schematic profile view of a selective stimulation port (SSP) 100 according to the present disclosure, while FIG. 6 is a view of a formation-facing side of the SSP of FIG. 5 and FIG. 7 is a cross-sectional view of the SSP of FIGS. 5 through 6 taken along line 7-7 of FIG. 6. SSP 100 of FIGS. 5 through 7 may include and/or be a more detailed illustration of SSPs 100 of FIGS. 1 through 4, and any of the structures, functions, and/or features discussed herein with reference to any of FIGS. 1 through 4 may be included in and/or utilized with SSP 100 of FIGS. 5 through 7 without departing from the scope of the present disclosure. Similarly, any of the structures, functions, and/or features of SSP 100 of FIGS. 5 through 7 may be included in and/or utilized with SSPs 100 of FIGS. 1 through 4 without departing from the scope of the present disclosure.

As illustrated in FIGS. 5 through 7, SSP 100 includes an SSP body 110 that defines an SSP conduit 116. SSP body 110 has a conduit-facing region 112 and an opposed formation-facing region 114. SSP body 110 may also include a projecting region 150, which projects from SSP body 110 in a direction that is away from, or perpendicular to, a central axis 118 of SSP conduit 116.

In some embodiments, SSP 100 may include a tool-receiving portion 176, which may be configured to receive a tool during operative attachment of the SSP to a wellbore tubular, and an attachment region 178, which may be configured to interface with the wellbore tubular when the SSP is operatively attached to the wellbore tubular. As an example, attachment region 178 may include threads, and SSP 100 may be configured to be rotated, via receipt of the tool within tool-receiving portion 176, to permit threading of the SSP into the wellbore tubular. As perhaps illustrated most clearly in FIG. 7, SSP 100 further includes a sealing device seat 140, which may be configured to receive a sealing device 142, and an isolation device 120. In FIG. 7, isolation device 120 is illustrated in closed state 121.

Figure 9:
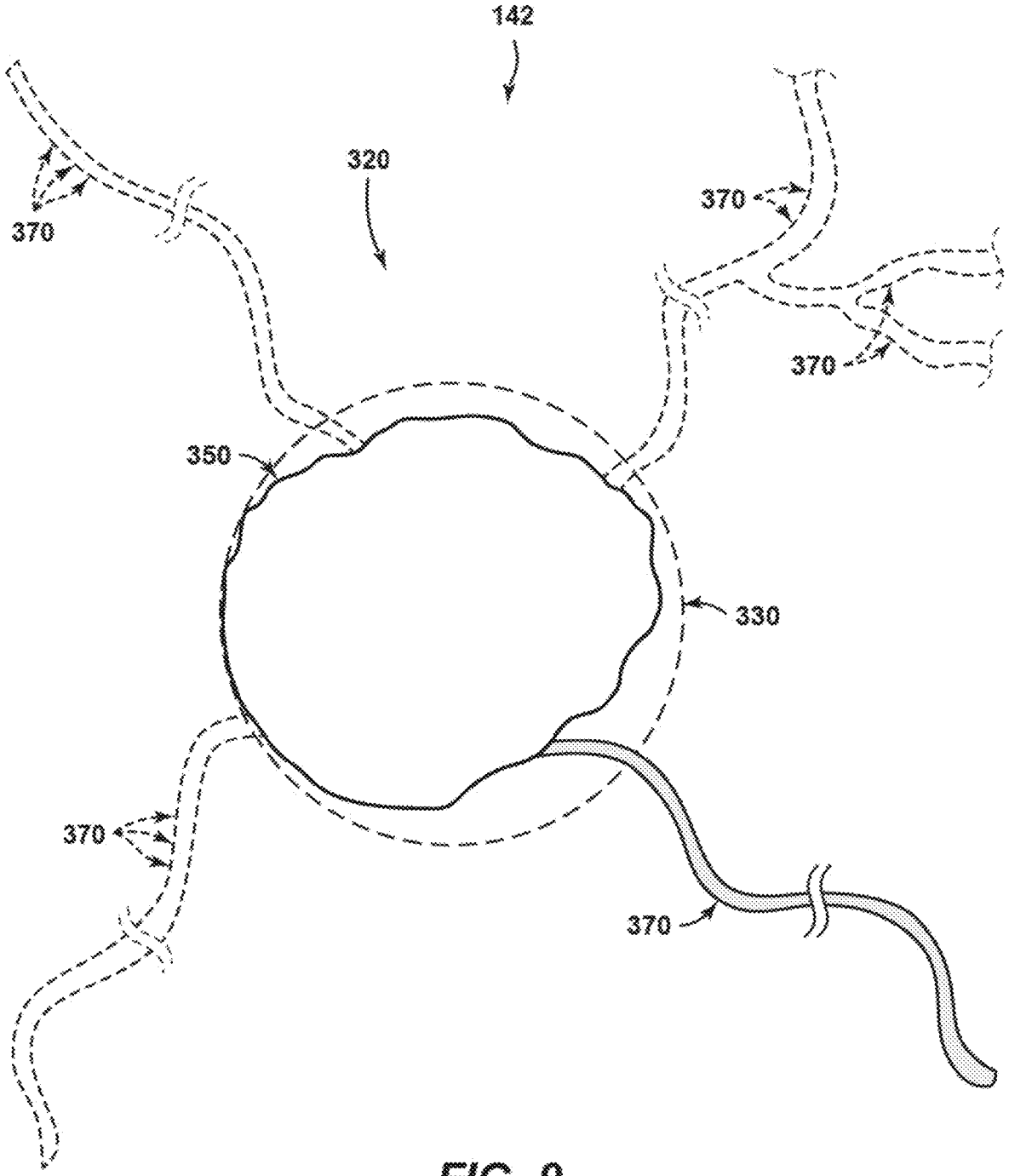
FIG. 9 is another schematic representation illustrating examples of a sealing assembly according to the present disclosure.
Figure 10:
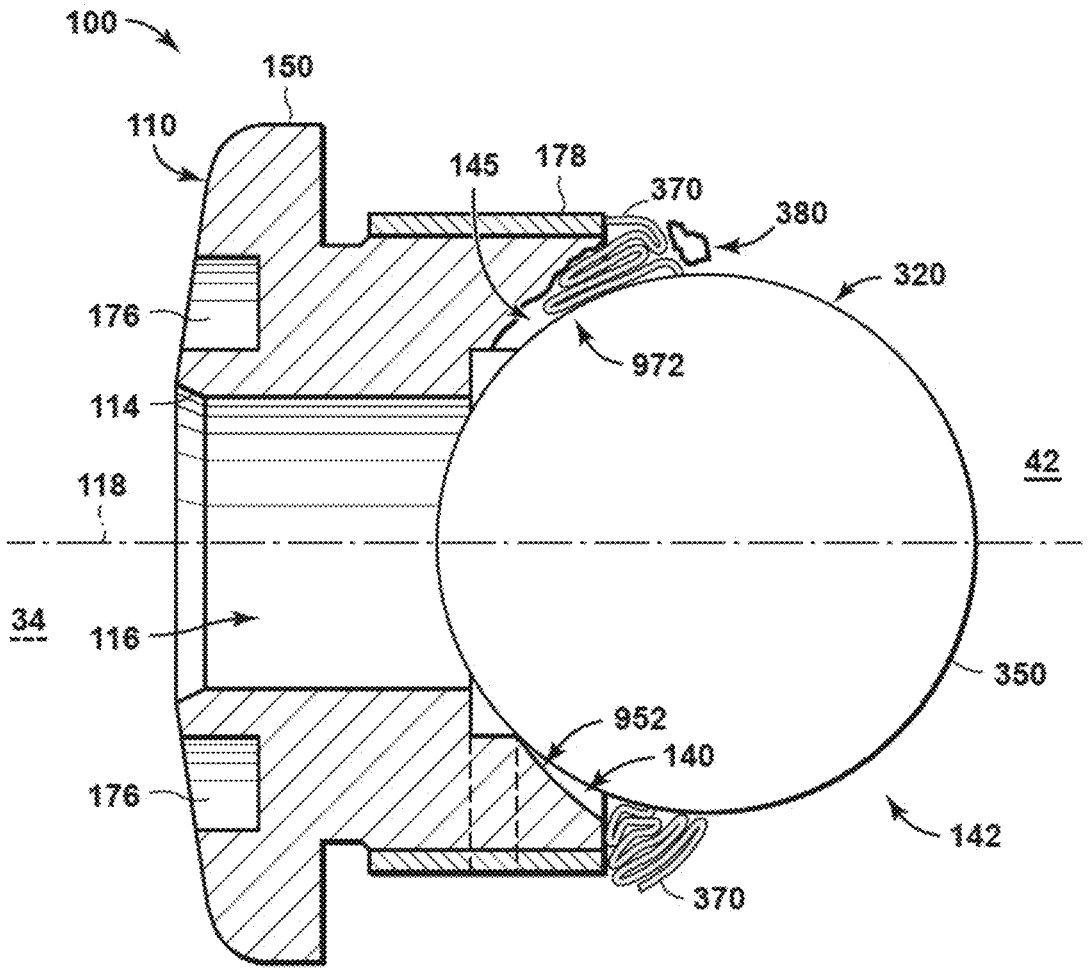
FIG. 10 is a schematic representation of a sealing assembly seated upon a sealing device seat of a selective stimulation port, according to the present disclosure.

FIGS. 8 through 10 provide examples of an adaptable sealing device 142, which also may be referred to herein as a sealing device 320 that may be included in and/or utilized with the wellbore tubulars and/or methods according to the present disclosure. More specifically, FIG. 8 is a schematic representation illustrating examples of a sealing assembly 320 that includes sealing device 320, FIG. 7 is a schematic representation illustrating examples of adaptable perforation sealing device 320, and FIG. 10 is a schematic representation of adaptable perforation sealing device 320 seated upon a sealing device seat 140 of a selective stimulation port 100, according to the present disclosure. As illustrated in FIGS. 8 through 10, adaptable perforation sealing devices 320 include a primary sealing portion 350 and a secondary sealing portion 370, which extends from primary sealing portion 350. Adaptable perforation sealing device 320 may, but is not required in all embodiments to, form a portion of a sealing assembly 320 that includes both sealing device 320 and a shell 330. Shell 330 defines an enclosed volume 332 and sealing device 320, including both primary sealing portion 350 and secondary sealing portion 370 thereof, is positioned within the enclosed volume. Shell 330 may be configured to encapsulate, retain, or house sealing device 320 within an enclosed volume 332 to avoid entanglement of the secondary sealing portions with other pods within the autonomously deployed carrier or container. An external force or stimuli, such as an explosive force that affects destroying the sealing device transport vehicle may be utilized to affect releasing the sealing devices 320. In other embodiments, exposing the shells 330 to a threshold wellbore hydrostatic pressure or enabling a relatively rapid dissolution of the shells 330 in the wellbore fluid, etc., similarly may effect fracture or disintegration of the shells 330.

As an example, adaptable perforation sealing devices 320 may include a shell 330, and/or that are autonomously transported within vehicle, canister, or container may be easier to handle, transport, and/or autonomously inject into the wellbore tubular when compared to sealing devices 320 that are not canister or container enclosed within a corresponding shell 330. The presence of shell 330 may permit a cluster or grouping of permit one or more sealing assemblies 320 to be packed into an autonomous tool assembly, discharged as a group or in subgroups, and introduced within the wellbore tubular without the one or more sealing devices 320 thereof becoming entangled with one another. As another example, shell 330 may prevent premature contact between the wellbore fluid and the sealing device, either to isolate the devices from wellbore hydrostatic pressure or to prevent dissolution of the shell. In some embodiments, the shell may be more properly described as a coating than a confining sphere. Either way, the terms relating to a shell, as used herein, applies broadly to all such embodiments that prevent premature entanglement of secondary sealing portions, regardless of whether more of a coating or an actual confining housing.

Examples of the release stimulus may include one or more of a fluid shear force experienced by the shell, a fluid shear force experienced by the shell that exceeds a threshold fluid shear force, fluid contact between the shell and an acidic solution, fluid contact between the shell and the acidic solution for greater than a threshold solution contact time, fluid contact between the shell and water, fluid contact between the shell and water for greater than a threshold water contact time, fluid contact between the shell and a hydrocarbon fluid, fluid contact between the shell and the hydrocarbon fluid for greater than a threshold hydrocarbon fluid contact time, receipt of a shockwave by the shell, receipt of a shockwave with greater than a threshold shockwave intensity by the shell, receipt of a mechanical force by the shell, receipt of the mechanical force with greater than a threshold force intensity by the shell, receipt of a pressure force by the shell, and/or receipt of the pressure force with greater than a threshold pressure intensity by the shell.

Shell 330 may include and/or be formed from any suitable material and/or materials. As examples, shell 330 may include one or more of an acid-soluble material, a water-soluble material, a hydrocarbon-soluble material, a nylon, a polyglycolic acid (PGA), a polylactic acid (PLA), and/or a frangible material. Similarly, shell 330 may have any suitable material property and/or properties. As examples, shell 330 may be rigid, flexible, compliant, resilient, and/or frangible. In addition, shell 330 may have and/or define any suitable shape. As examples, shell 330 may be spherical, at least partially spherical, and/or hollow spherical.

Subsequent to being separated, or released, from enclosed volume 332 of shell 330, primary sealing portion 350 and secondary sealing portion 370 may be operatively attached to one another. However, at least a portion of secondary sealing portion 370 may be configured to move and/or flow at least partially independently from primary sealing portion 350. This is illustrated in FIG. 9, where secondary sealing portions 370 extend from primary sealing portion 350 to an extent that is greater than the extent to which secondary sealing portions 370 extend from primary sealing portion 350 in FIG. 8.

As illustrated in FIG. 10, primary sealing portion 350 may be seated on a corresponding sealing device seat 140 of a corresponding SSP 100 and forms a primary seal 952 with the sealing device seat. The primary seal at least partially, or even completely, restricts fluid flow through an SSP conduit 116 of the SSP.

However, as discussed herein, the primary fluid seal may be imperfect and/or may permit some fluid flow therepast, such as from tubular conduit 42 into subterranean formation 34. As an example, a leakage pathway 145 may extend between primary sealing portion 350 and sealing device seat 140 and may permit fluid communication between tubular conduit 42 and subterranean formation 34. The leakage pathway may be present due to a variety of factors. As an example, primary sealing portion 350 may be misshapen, may not have a shape that corresponds to, or complements, sealing device seat 140, and/or may be deformed. As another example, a foreign object, such as particulate material, may extend between at least a portion of primary sealing portion 350 and sealing device seat 140, thereby preventing formation of a complete and/or uniform fluid seal 144. As yet another example, sealing device seat 140 may be misshapen, may not have a shape that corresponds to, or complements, primary sealing portion 350, may be deformed, may be corroded, such as by a corrosive reservoir fluid, and/or may be eroded, such as by an erosive mixture, slurry, and/or proppant.

Under these conditions, secondary sealing portion 370 may form a secondary seal 972 between primary sealing portion 350 and sealing device seat 140. This secondary seal may at least partially block, seal, and/or restrict fluid flow through leakage pathway 145, thereby decreasing, or even eliminating, fluid flow from tubular conduit 42 into subterranean formation 34 via SSP conduit 116.

Primary sealing portion 350 may include any suitable structure that may be adapted, configured, designed, constructed, and/or sized to form the primary fluid seal with sealing device seat 140. As examples, primary sealing portion 350 may include and/or be a bulbous primary sealing portion, an at least partially spherical primary sealing portion, and/or an egg-shaped primary sealing portion. FIGS. 8 through 9 illustrate primary sealing portion 350 in both solid and dashed lines to illustrate that a variety of shapes, including more bulbous, as illustrated in solid lines, and/or more circular/spherical, as illustrated in dashed lines, are within the scope of the present disclosure.

In general, primary sealing portion 350 is configured to form primary fluid seal 952 with sealing device seat 140 and to resist extrusion, or flow, through SSP conduit 116. As an example, primary sealing portion 350 may have and/or define a primary sealing portion effective radius, sealing device seat 140 may have and/or define a seat radius of curvature, and the primary sealing portion effective radius may be at least substantially similar to, or greater than, the seat radius of curvature. As another example, primary sealing portion 350 may be larger than SSP conduit 116 such that the primary sealing portion is sized to resist flow, or extrusion, through the SSP conduit.

It is within the scope of the present disclosure that primary sealing portion 350 may be formed from any suitable material and/or materials and/or that the primary sealing portion may have, or exhibit, any suitable material property and/or properties. As examples, primary sealing portion 350 may include and/or be formed from one or more of an acid-soluble material, a water-soluble material, a hydrocarbon-soluble material, a nylon, a polyglycolic acid (PGA), a polylactic acid (PLA), and/or a frangible material. As additional examples, primary sealing portion 350 may be rigid, compliant, resilient, and/or flexible.

Secondary sealing portion 370 may include any suitable structure that may be adapted, configured, designed, constructed, and/or sized to form the secondary fluid seal between the primary sealing portion and the sealing device seat and/or to resist the fluid flow through the leakage pathway. As examples, and as perhaps best illustrated in FIG. 9, secondary sealing portions 370 may be elongate, tentacular, fibrous, dendritic, branched, and/or tendrilous.

In addition to packing around the perimeter of the perforation opening to arrest hydraulic leakage between the primary portion and the perimeter of the perforation, the secondary sealing portions 370 also serve to effect sealing by the adaptable perforation sealing device on a perforation by hydrodynamically interacting with the stimulation fluid through creating fluid drag and guiding the adaptable perforation sealing device from within the wellbore flow stream toward a perforation. As at least a portion of the secondary sealing portions flow within the wellbore, at least a few of them will become subject to fluid drag and dragged into and through perforation, where the fluid velocity is greatly accelerated relative to the wellbore flow velocity, thereby hydrodynamically creating a pulling force upon the sealing device toward the perforation. This hydrodynamic "guiding" function is recognized and defined herein as an included component of the perforation seating and sealing action by the adaptable perforation sealing devices.

In order to avoid the secondary sealing portions 370 becoming drawn into multiple adjacent or proximal perforations, it may be desirable to limit the radial length of a few, or some, or a substantial portion or even all of the secondary sealing portions so that such portions may not extend simultaneously into adjacent perforations or to at least limit the number or extent of such opposing forces such that the device may be preferentially draw toward one perforation as compared to other adjacent or proximally located perforations. It will be appreciated that secondary portion lengths, shapes, hydrodynamic responsiveness, surface area, cross-sectional shape, material, etc., may selectively vary widely according to the intended perforation design, density, or usage.

It is within the scope of the present disclosure that sealing device 320 may include any suitable number of secondary sealing portions 370. As examples, sealing device 320 may include a single secondary sealing portion 370, a plurality of secondary sealing portions 370, at least 2, at least 3, at least 4, at least 6, at least 8, at least 10, or more than 10 secondary sealing portions 370. Similar to primary sealing portion 350, secondary sealing portion 370 may include and/or be formed from one or more of an acid-soluble material, a water-soluble material, a hydrocarbon-soluble material, a nylon, a polyglycolic acid (PGA), a polylactic acid (PLA), and/or a frangible material.

It is within the scope of the present disclosure that secondary sealing portion 370 may have and/or define any suitable size, dimension, and/or dimension relative to a dimension of primary sealing portion 350. As an example, a ratio of a maximum dimension of secondary sealing portion 370 to a maximum dimension of primary sealing portion 350 may be at least 0.1, at least 0.2, at least 0.4, at least 0.6, at least 0.8, at least 1, at most 1, at most 2, at most 4, at most 6, at most 8, at most 10, at most 15, at most 20, and/or more than 20. Examples of the maximum dimension of the primary sealing portion include a diameter of the primary sealing portion, an effective diameter of the primary sealing portion, and a diameter of a sphere that has the same volume as that of the primary sealing portion. Examples of the maximum dimension of the secondary sealing portion include a maximum distance that the secondary sealing portion may extend from the primary sealing portion, an average of the maximum distance that each of the plurality of secondary sealing portions extends from the primary sealing portion, an elongate length of the secondary sealing portion, and/or an average of the elongate length of each of the plurality of secondary sealing portions.

As another example, a ratio of a volume of the primary sealing portion to a volume of the secondary sealing portion may be at least 1, at least 2, at least 4, at least 10, at least 20, at least 30, at least 40, at most 500, at most 400, at most 300, at most 200, at most 100, and/or at most 50. As yet another example, a surface area to volume ratio of the secondary sealing portion may be at least 1, at least 2, at least 4, at least 6, at least 8, at least 10, at least 15, at least 20, or more than 20 times larger than a surface area to volume ratio of the primary sealing portion.

It is within the scope of the present disclosure that primary sealing portion 350 and secondary sealing portion 370 may be defined by a single, unitary, and/or monolithic body. As an example, the primary sealing portion and the secondary sealing portion may be molded and/or extruded from a single, or common, material and/or materials. As another example, an elongate body may define at least a portion of both the primary sealing portion and the secondary sealing portion, with the elongate body being knotted and/or otherwise wrapped around itself to define the primary sealing portion. Alternatively, it is also within the scope of the present disclosure that the secondary sealing portion may be operatively attached to the primary sealing portion to form and/or define the sealing device.

Adaptable perforation sealing devices 320 disclosed herein are described as being utilized to seal a wide variety of perforation types, including but not limited to SSPs 100, shaped-charge jet perforations, abrasive-fluid-jet perforations, sliding sleeve type perforations, and any other wellbore wall aperture. It is within the scope of the present disclosure that sealing devices 320 additionally or alternatively may be utilized to seal one or more other fluid conduits that extend between tubular conduit 42 and subterranean formation 34. As an example, and subsequent to being utilized to stimulate the subterranean formation, one or more SSPs 100 may be damaged such that the one or more SSPs no longer includes a corresponding sealing device seat 140. Under these conditions, sealing devices 320 still may be utilized to seat upon a remainder of the damaged SSP and/or to seal the SSP conduit that is associated with the damaged SSP.

As another example, and subsequent to being utilized to stimulate the subterranean formation, one or more SSPs or other perforation "devices" may (unintentionally or intentionally) physically separate from wellbore tubular 40 leaving behind a corresponding tubular aperture 48 as the perforation, which is illustrated in FIG. 2. Under these conditions, sealing devices 320 may be utilized to seal such tubular aperture.

As yet another example, one or more perforations may be formed within wellbore tubular 40, and sealing devices 320 may be utilized to seal the one or more perforations. As another example, a portion of tubular conduit 40 may fail and/or rupture, and sealing devices 320 may be utilized to seal the failed and/or ruptured tubular conduit.

It is also within the scope of the present disclosure that adaptable perforation sealing devices 320 may be included in and/or utilized with other and/or additional structures and/or methods that may form a portion of a hydrocarbon well other than the exemplary hydrocarbon well 10 of FIG. 1. Examples of such additional structures and/or methods are disclosed in U.S. Provisional Patent Application No. 62/262,034 (also published as U.S. Appl. Publication No. 2017/0159419) and Ser. No. 62/262,036 (also published as U.S. Appl. Publication No. 2017/0159418), which were filed on Dec. 2, 2015, and U.S. Provisional Patent Application No. 62/263,069 (also published as U.S. Appl. Publication No. 2017/0159420), which was filed on Dec. 4, 2015, and the complete disclosures of which are hereby incorporated by reference.

Figure 11:
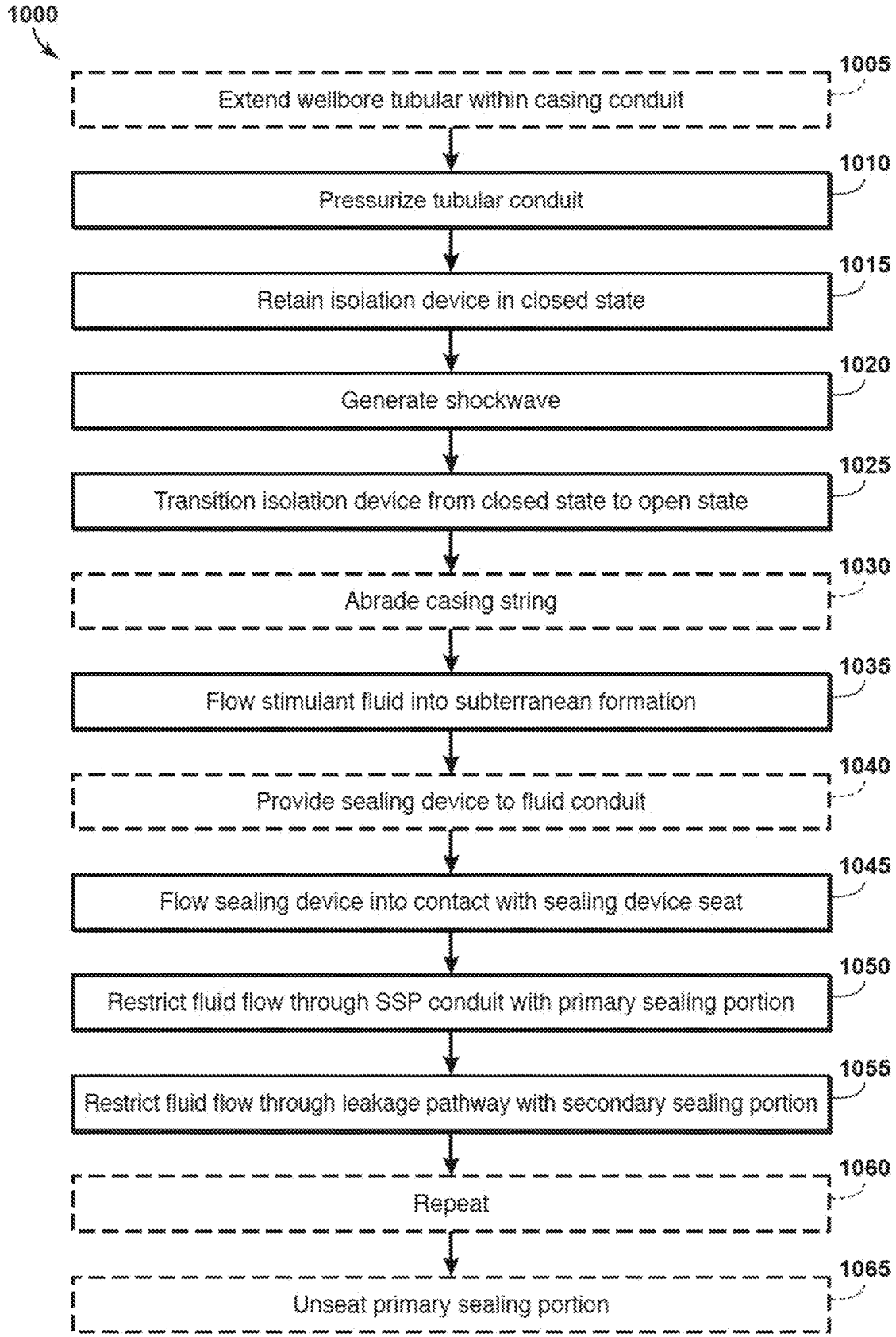
FIG. 11 is a flowchart depicting methods, according to the present disclosure, of stimulating a subterranean formation.

FIG. 11 is a flowchart depicting exemplary methods 1000, according to the present disclosure, of stimulating a subterranean formation. Methods 1000 may be performed with and/or may utilize wellbore tubulars 40, selective stimulation ports 100, and autonomously delivered adaptable perforation sealing devices 320, which are disclosed herein. FIGS. 12 through 17 provide an exemplary schematic wellbore and tool assembly cross-sectional views of stages or portions of a process flow for stimulating a subterranean formation 34 utilizing wellbore tubulars 40, selective stimulation ports 100, an autonomously delivered tool assembly that releases a plurality of adaptable perforation sealing devices 320, according to the methods 1000 of FIG. 11, as well as the processes, systems, and apparatus according to the present disclosure.

Figure 12:
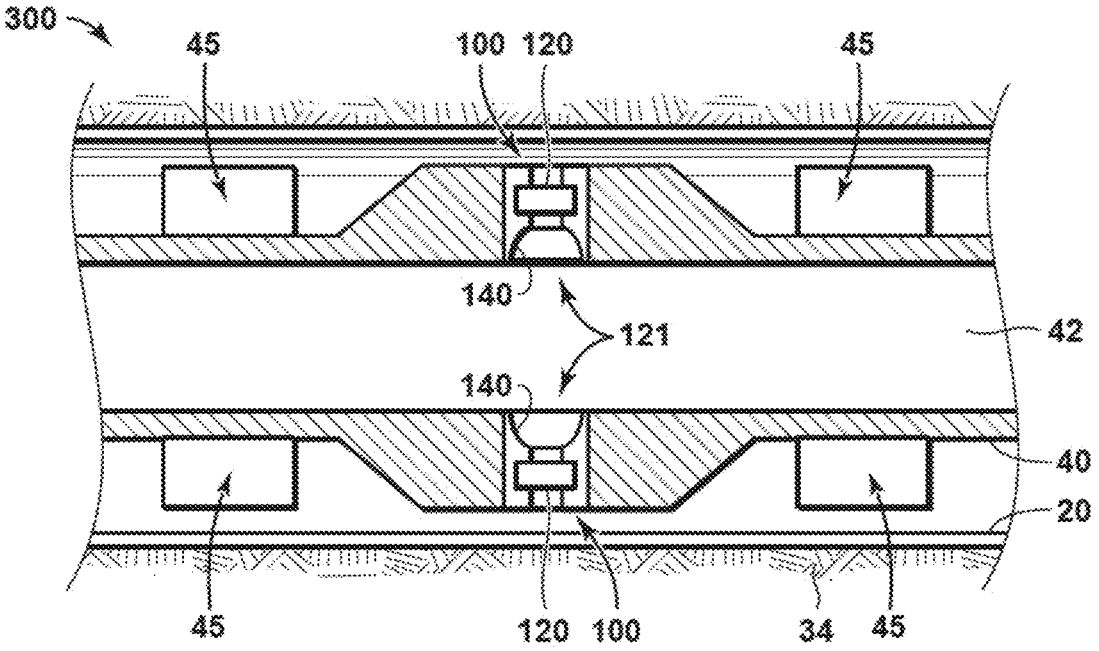
FIG. 12 is a schematic cross-sectional view of a portion of a process flow for stimulating a subterranean formation utilizing the selective stimulation ports, wellbore tubulars, sealing devices, and/or methods according to the present disclosure.
Figure 13:
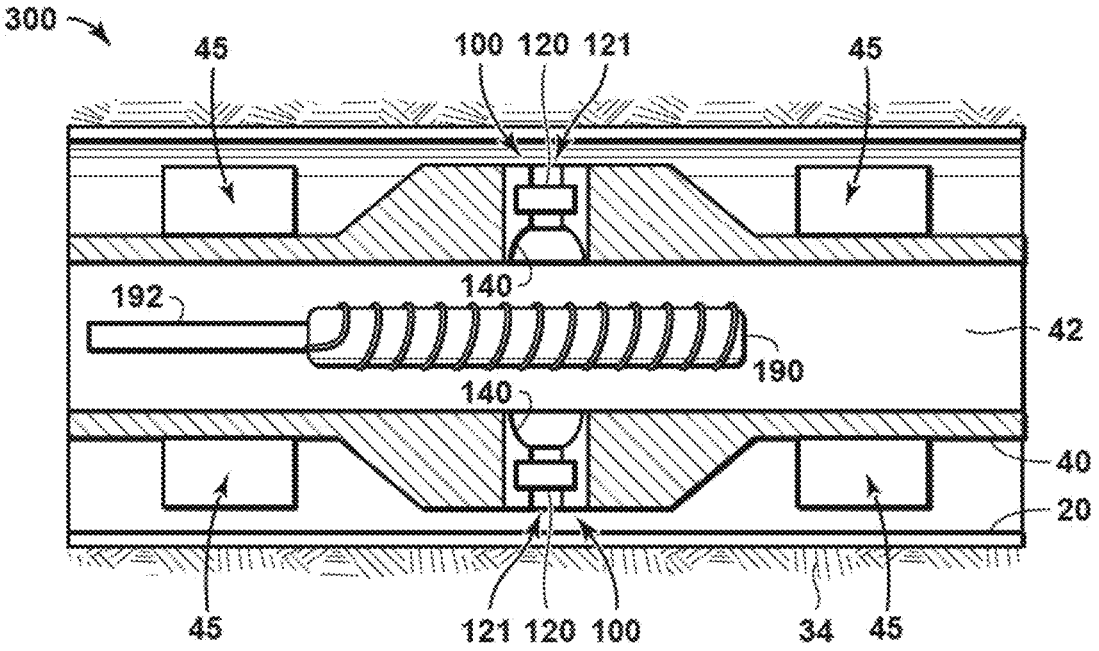
FIG. 13 is a schematic cross-sectional view of a portion of the process flow for stimulating the subterranean formation utilizing the selective stimulation ports, wellbore tubulars, sealing devices, and/or methods according to the present disclosure.
Figure 14:
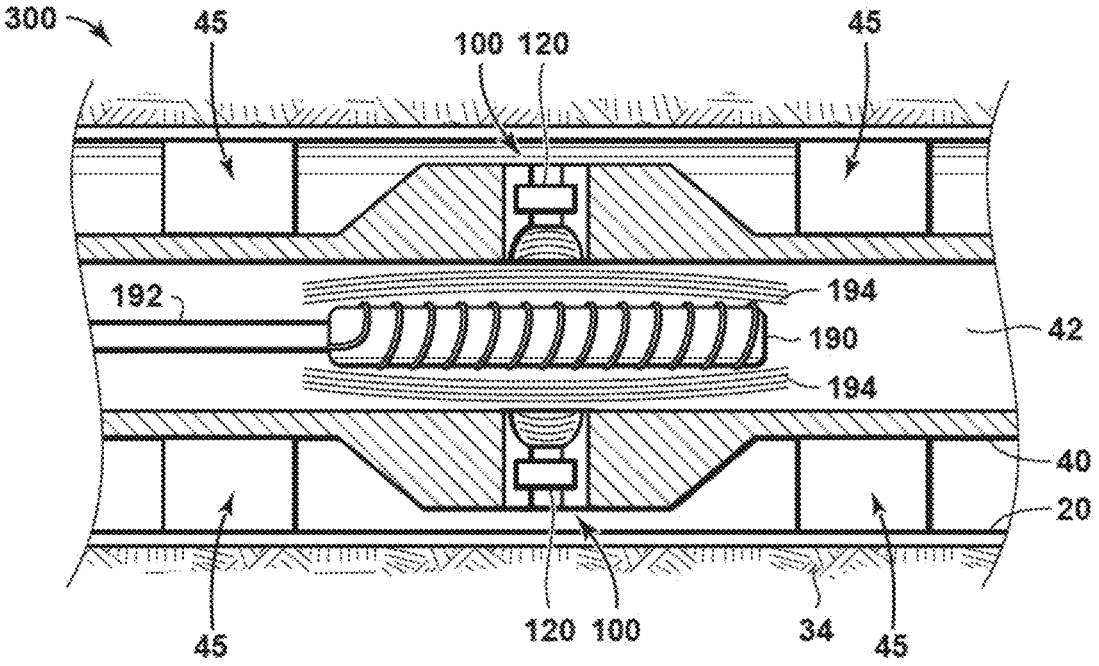
FIG. 14 is a schematic cross-sectional view of a portion of the process flow for stimulating the subterranean formation utilizing the selective stimulation ports, wellbore tubulars, sealing devices, and/or methods according to the present disclosure.

Beginning with FIG. 12, methods 1000 may include extending a wellbore tubular within a casing conduit at 1005 and include pressurizing a tubular conduit at 1010, retaining an isolation device in a closed state at 1015, as illustrated by isolation device 120. FIG. 13 illustrates a shockwave generation tool 190, attached to and controlled by an autonomous tool assembly (not depicted in FIG. 13) via extension 192 (optional, so that actuation of device 190 may not undesirably damage components of autonomous delivery tool assembly or sealing devices). In FIG. 14, shockwave generation tool 190 is generating a shockwave 194, consistent with method flowchart FIG. 11 at box 1020 to transition the isolation device 120 from the closed state to an open state at flowchart box 1025. Note that the exemplary embodiments of FIGS. 12 through 17 illustrate an SSP 100 assembly that is delivered in wellbore 20 on tubing string 40, with SSP provided on a tubing conveyed tool assembly. Isolation device 120 may comprise an explosive or shaped charge that when activated by shockwaves 194, can create additional casing perforation 38. Alternatively, an abrasive fluid may be pumped through flowpath 116 to create additional casing perforation 38. Thereafter, packer elements 45 may be set or enlarge, as illustrated in FIGS. 14 through 17, and the formation 34 stimulated through SSP 100 and perforation 38. Correspondingly, the methods 1000 of FIG. 11 may further include abrading, cutting, bursting, or otherwise opening a perforation 38 in casing string at FIG. 11 box 1030. Box 1030 may further include flowing a stimulation fluid 70 into a subterranean formation 34 at 1035, and may include autonomously releasing an adaptable perforation sealing device 350 from a tool assembly, as disclosed herein, to the tubular conduit at perforation seat 1040. Methods 1000 further include flowing the sealing device into contact with a sealing device seat 140 at box 1045, restricting fluid flow through an SSP conduit with a primary sealing portion at box 1050, and restricting fluid flow through a leakage pathway with a secondary sealing portion at box 1055. Methods 1000 further may include repeating at least a portion of the methods at box 1060 and/or unseating the primary sealing portion from the sealing device seat 140 at box 1065.

Extending the wellbore tubular within the casing conduit at FIG. 11, box 1005 may include extending the wellbore tubular within a casing conduit that is defined by a casing string that extends within the subterranean formation. The casing string may be preexisting, may be present within the subterranean formation prior to the extending at 1005, and/or previously may have been utilized to stimulate the subterranean formation and/or to produce reservoir fluids from the subterranean formation. The wellbore tubular may include one or more SSPs.

Pressurizing the tubular conduit at box 1010 may include setting packer elements 45 to enable pressurizing the tubular conduit 42 with a stimulant fluid 70 and/or pressurizing the tubular conduit 42 to at least a threshold pressure. When methods 1000 include the extending at box 1005, the pressurizing at box 1010 may include pressurizing the tubular conduit with a stimulant fluid that includes an abrasive material to create additional casing perforation 38.

Retaining the isolation device in the closed state at box 1015 may include retaining the isolation device in the closed state during the pressurizing at box 1010. Stated another way, the retaining at box 1015 may include resisting fluid flow from the tubular conduit and into the subterranean formation, via the SSP conduit of the SSP, during the pressurizing at 1010 and/or prior to the generating at 1020. This is illustrated in FIG. 12, with SSP 100 being in closed state 121 during pressurization of tubular conduit 42.

Generating the shockwave at 1020 may include generating the shockwave within a wellbore fluid that extends within the tubular conduit. In addition, the generating at 1020 may include generating within a region of the tubular conduit that is proximal the SSP such that a magnitude of the shockwave, as received by the SSP, is greater than a threshold shockwave intensity that is sufficient to transition the isolation device of the SSP from the closed state to the open state (i.e., such that the SSP receives and/or experiences the threshold shockwave). This is illustrated in FIG. 14 by the generation of a shockwave 194 with shockwave generation device 190.

The generating at 1020 may be accomplished in any suitable manner. As an example, the generating at 1020 may include detonating an explosive charge within the tubular conduit. The explosive charge may be associated with and/or may form a portion of the shockwave generation device, which is separate from the SSP, as illustrated in FIGS. 13 through 14. Additionally or alternatively, the explosive charge may be associated with and/or may form a portion of a shockwave generation structure, which forms a portion of the SSP and is illustrated in FIG. 2 at 180. As another example, the generating at 1020 may include actuating a triggering device, such as a blast cap. The actuating may include remotely actuating and/or wirelessly actuating the triggering device.

When the generating at 1020 includes generating with the shockwave generation device, the shockwave generation device may be located within the tubular conduit such that the shockwave has greater than the threshold shockwave intensity within the wellbore fluid that extends within the tubular conduit and in contact with the isolation device. In addition, the shockwave may have less, may have decayed to less, and/or may have been attenuated to less than the threshold shockwave intensity at a distance that is greater than a maximum effective distance from the shockwave generation device. Examples of the maximum effective distance are disclosed herein.

It is within the scope of the present disclosure that the generating at 1020 may include generating such that the shockwave emanates at least substantially symmetrically from the shockwave generation device and/or such that the shockwave emanates at least substantially isotropically from the shockwave generation device. Additionally or alternatively, the generating at 1020 may include generating such that the shockwave is symmetrical, or at least substantially symmetrical, within a given transverse cross-section of the tubular conduit and/or such that the shockwave has a constant, or at least substantially constant, magnitude within the given transverse cross-section of the tubular conduit at a given point in time.

The shockwave may have any suitable maximum shockwave pressure and/or maximum shockwave duration that is sufficient to transition the isolation device from the closed state to the open state but insufficient to cause damage to the wellbore tubular. Examples of the maximum shockwave pressure and/or of the maximum shockwave duration are disclosed herein.

The generating at 1020 further may include propagating the shockwave within the wellbore fluid. As examples, the propagating may include propagating the shockwave from the shockwave generation device, propagating the shockwave to the SSP, propagating the shockwave to the isolation device of the SSP, and/or propagating the shockwave in and/or within the wellbore fluid.

As discussed, the shockwave may be attenuated during propagation. As an example, the shockwave may be attenuated by and/or within the wellbore fluid. This may include dissipating at least a portion of the shockwave within the wellbore fluid and/or absorbing energy from the shockwave with the wellbore fluid. The shockwave may be attenuated at any suitable attenuation rate, examples of which are disclosed herein.

Transitioning the isolation device from the closed state to the open state at 1025 may include transitioning to permit fluid communication between the tubular conduit and the subterranean formation via the SSP conduit. The transitioning at 1025 may be at least partially responsive to the generating at 1020. As an example, the transitioning may be initiated and/or triggered by receipt of the threshold shockwave with and/or by the isolation device.

The transitioning at 1025 may be accomplished in any suitable manner. As an example, the transitioning at 1025 may include shattering a frangible disk that defines at least a portion of the isolation device. As another example, the transitioning at 1025 may include displacing an isolation disk, which defines at least a portion of the isolation device, from the SSP conduit. The displacing may include shearing a pin that retains the isolation disk within the SSP conduit and/or defeating a clip that retains the isolation device within the SSP conduit.

When methods 1000 include the extending at 1005, methods 1000 further may include abrading the casing string at 1030. The abrading at 1030 may include abrading the casing string with the stimulant fluid and/or with the abrasive material, such as to form a hole in the casing string and/or to establish fluid communication between the casing conduit and the subterranean formation via the hole that is formed in the casing string during the abrading at 1030.

Figure 15:
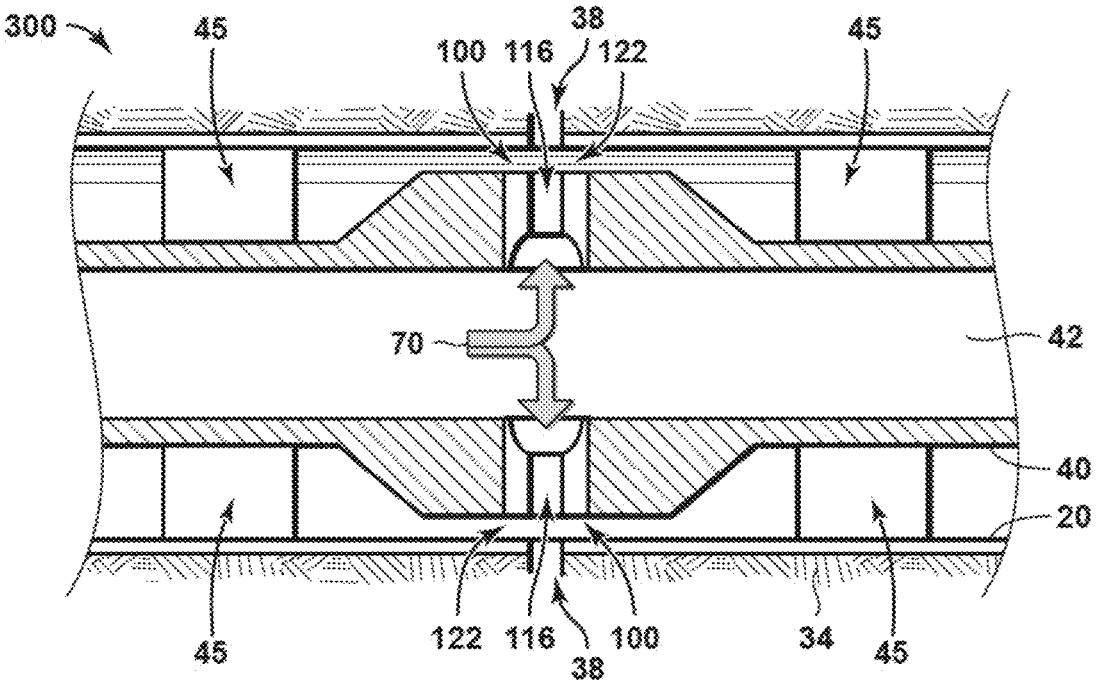
FIG. 15 is a schematic cross-sectional view of a portion of the process flow for stimulating the subterranean formation utilizing the selective stimulation ports, wellbore tubulars, sealing devices, and/or methods according to the present disclosure.

Flowing the stimulant fluid into the subterranean formation at 1035 may include may include flowing the stimulant fluid, via the SSP conduit, from the tubular conduit and/or into the subterranean formation, such as to stimulate the subterranean formation. The flowing at 1035 is illustrated in FIG. 15, with stimulant fluid 70 flowing into subterranean formation 34 via SSP conduit 116. The flowing at 1035 further may include accelerating the stimulant fluid, such as via and/or utilizing a nozzle of the SSP.

When methods 1000 include the extending at 1005, the flowing at 1035 further may include flowing such that the stimulant fluid and/or the abrasive material impinges upon an inner casing surface of the casing string, such as to permit and/or facilitate the abrading at 1030. Under these conditions, the flowing the stimulant fluid into the subterranean formation may be subsequent, or responsive, to the abrading at 1030 and/or subsequent to formation of the hole during the abrading at 1030. Stated another way, and when methods 1000 include the extending at 1005 and/or the abrading at 1030, the flowing the stimulant fluid into the subterranean formation at 1035 may include flowing through and/or via the hole that is formed during the abrading at 1030.

Providing the sealing device to the tubular conduit at 1040 may include providing the sealing device, or positioning the sealing device within the tubular conduit, in any suitable manner. As an example, the providing at 1040 may include providing the sealing device from a surface region. As another example, the providing at 1040 may include providing the sealing device from a sealing device compartment.

When the providing at 1040 includes providing the sealing device from the sealing device compartment, the sealing device compartment may be present in any suitable portion and/or region of the hydrocarbon well. As an example, the sealing device compartment may be located and/or positioned within the surface region and selectively may be utilized to introduce a sealing device into the tubular conduit. As another example, the sealing device compartment may be operatively attached to the shockwave generation device and may be configured to selectively release the sealing device from the shockwave generation device. As yet another example, the sealing device compartment may be operatively attached to, or may form a portion of, the wellbore tubular.

It is within the scope of the present disclosure that the providing at box 1040 may include providing a sealing assembly, such as sealing assembly 320 of FIGS. 8 through 10, that includes both the sealing device and a shell. As discussed herein, the shell may define an enclosed volume and the sealing device initially may be contained within the enclosed volume. Under these conditions, the providing at box 1040 further may include applying a release stimulus to the shell to release the sealing device from the shell. Examples of the release stimulus are disclosed herein.

Flowing the sealing device into contact with the sealing device seat at box 1045 may include flowing any suitable sealing device, such as sealing device 320 of FIGS. 8 through 10, via and/or along a length of the tubular conduit and into contact and/or engagement with the sealing device seat of the SSP. This is illustrated in FIG. 15. Therein, a sealing device 142 is illustrated as flowing into contact and engaging with a sealing device seat 140 of SSP 100. The flowing at box 1045 may include flowing within and/or via the stimulant fluid and/or may be performed subsequent to performing the flowing at 1035 for at least a threshold stimulation time.

Figure 16:
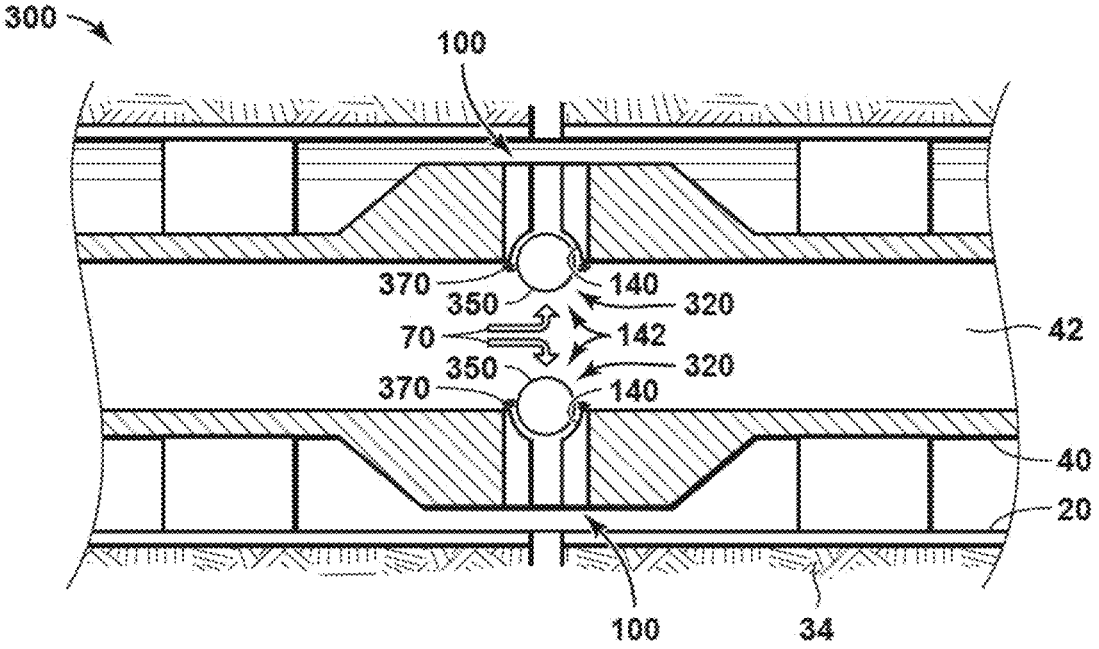
FIG. 16 is a schematic cross-sectional view of a portion of the process flow for stimulating the subterranean formation utilizing the selective stimulation ports, wellbore tubulars, and/or methods according to the present disclosure.

As discussed in more detail herein with reference to FIGS. 8 through 10, the sealing device may include a primary sealing portion and a secondary sealing portion that extends from the primary sealing portion. The primary sealing portion may be configured to seat upon the sealing device seat, and the restricting at 1050 may include at least partially restricting fluid flow through the SSP conduit with the primary sealing portion. The at least partially restricting fluid flow may include one or more of seating the primary sealing portion on the sealing device seat, mechanically contacting the primary sealing portion with the sealing device seat, and/or deforming the primary sealing portion via physical contact with the sealing device seat. This is illustrated in FIG. 16, where primary sealing portion 350 of sealing device 320 is seated upon sealing device seat 140 and forms at least a partial fluid seal with the sealing device seat 140.

Restricting fluid flow through the leakage pathway with the secondary sealing portion at 1055 may include blocking and/or occluding, with the secondary sealing portion, a leakage pathway that extends between the primary sealing portion and the sealing device seat. The restricting at box 1055 may include one or more of flossing the secondary sealing portion into a gap between the primary sealing portion and the sealing device seat, compressing the secondary sealing portion between the primary sealing portion and the sealing device seat, and/or mechanically contacting at least a first region of the secondary sealing portion with the sealing device seat and also mechanically contacting at least a second region of the secondary sealing portion with the primary sealing portion. This is illustrated in FIG. 16, where secondary sealing portion 370 extends across a gap and/or leakage pathway between primary sealing portion 350 and sealing device seat 140.

Repeating at least a portion of the methods at 1060 may include repeating any suitable portion of methods 1000 in any suitable order and/or in any suitable manner. As an example, the SSP may be a first SSP of a plurality of spaced-apart SSPs that are spaced-apart along a longitudinal length of the wellbore tubular. Under these conditions, the repeating at box 1060 may include repeating at least the pressurizing at box 1010, the retaining at box 1015, the generating at box 1020, the transitioning at box 1025, the flowing at box 1035, the flowing at box 1045, the restricting at box 1050, and the restricting at box 1055 to stimulate a portion of the subterranean formation that is proximal, or associated with, a second SSP of the plurality of spaced-apart SSPs. This may include selectively transitioning the second SSP from the closed state to the open state without transitioning another SSP of the plurality of spaced-apart SSPs from the closed state to the open state. Stated another way, the repeating at box 1060 may include repeating without stimulating a portion of the subterranean formation that is proximal, or associated with, a third SSP of the plurality of spaced-apart SSPs.

Figure 17:
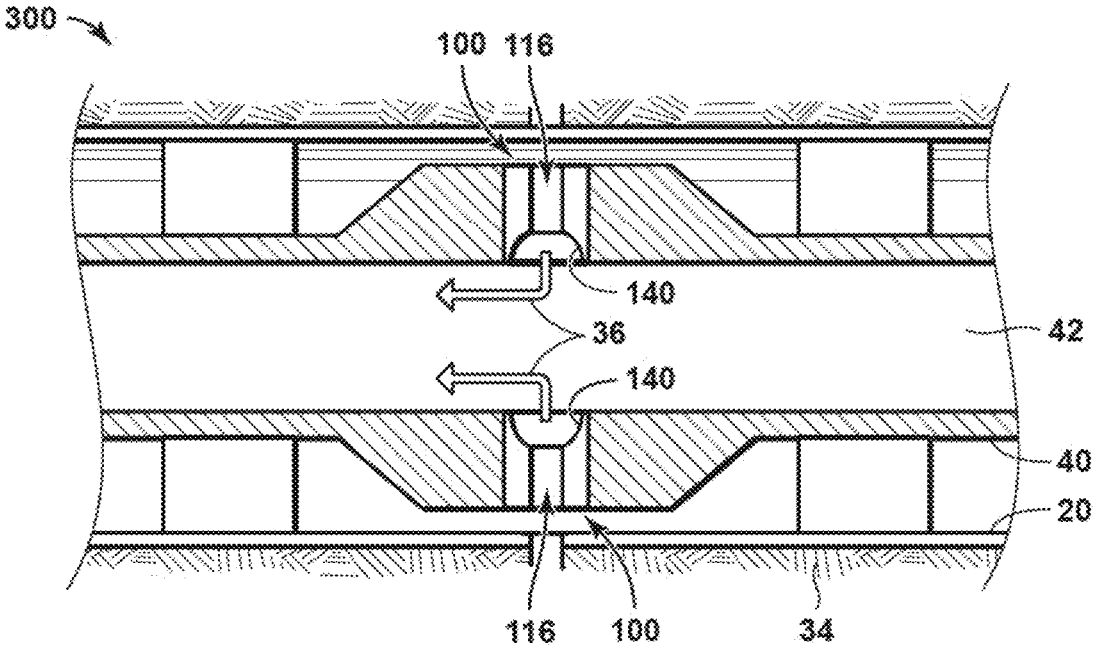
FIG. 17 is a schematic cross-sectional view of a portion of the process flow for stimulating the subterranean formation utilizing the selective stimulation ports, wellbore tubulars, sealing devices, and/or methods according to the present disclosure.

Unseating the primary sealing portion from the sealing device seat at 1065 may include separating the sealing device from the sealing device seat, such as to permit and/or facilitate production of a reservoir fluid from the subterranean formation. This is illustrated in FIG. 17, with sealing device 320 of FIG. 15 having been separated from sealing device seat 140 and reservoir fluid 36 flowing into tubular conduit 42 via SSP conduit 116.

The unseating at box 1065 may be accomplished in any suitable manner. As an example, the restricting at box 1050 and the restricting at box 1055 may include seating the primary sealing portion of the sealing device seat via application of a seating pressure differential between the tubular conduit and the subterranean formation. The seating pressure differential may be such that the pressure within the tubular conduit is greater than the pressure within the subterranean formation, thereby providing a pressure force for seating of the primary sealing portion against the sealing device seat.

Under these conditions, the unseating at box 1065 may include unseating via application of an unseating pressure differential between the tubular conduit and the subterranean formation. The unseating pressure differential may be such that the pressure within the tubular conduit is less than the pressure within the subterranean formation, thereby providing a pressure force for the unseating. It is within the scope of the present disclosure that the primary seating portion may remain seated on the sealing device seat unless a magnitude of the unseating pressure differential is greater than a threshold unseating pressure differential. Examples of the threshold unseating pressure differential include unseating pressure differentials that are at least 2.5%, at least 5%, at least 7.5%, at least 10%, at least 15%, at most 30%, at most 25%, at most 20%, and/or at most 15% of the seating pressure differential.

It is within the scope of the present disclosure that hydrocarbon wells 10, wellbore tubulars 40, SSPs 100, sealing devices 142, sealing assemblies 320, and/or sealing devices 320, which are disclosed herein, may be utilized in any suitable manner, including those that are in addition to, or alternative to methods 1000. As an example, a hydrocarbon well may include a plurality of longitudinally spaced-apart SSPs, all of which may be in the open state. Under these conditions, one or more sealing devices 320 may be deployed into tubular conduit 42 to seal one or more SSPs 100. In general, the deployed sealing devices preferentially may seal SSPs 100 with greater fluid flow rates therethrough, and a stimulant fluid subsequently may be provided to the tubular conduit to stimulate one or more portions of the subterranean formation that are proximal to, or associated with, one or more SSPs 100 that were not sealed by the autonomously deployed adaptable perforation sealing devices 320.

As another example, a plurality of adaptable perforation sealing devices 320 may be deployed to seal all of the open SSPs 100. Subsequently, a perforation device, such as a shape-charge perforation gun, may be deployed within the tubular conduit and may be utilized to create one or more perforations within the tubular conduit. Portions of the subterranean formation associated with these one or more perforations then may be stimulated via flow of a stimulant fluid through the perforations.

FIGS. 18A through 18F present an exemplary series of side views of a lower portion of a wellbore 600. The wellbore 600 is undergoing a completion procedure for multiple zones or stages that uses the presently disclosed autonomous completion assemblies 670 in a unique seamless procedure. Of interest in many applications, the autonomously deployed completion assemblies 670 may include a perforating gun portion 650 and a transport member container 720 portion for transporting a plurality of the adaptable perforation sealing devices 760 (seen best in exemplary FIGS. 18D and 19). The transport member 720 holds a plurality of adaptable sealing devices 760. The adaptable perforation sealing devices 760 are released from the transport member 720 shortly before or simultaneously with charges being detonated by the perforating gun 750.

Figure 18A:
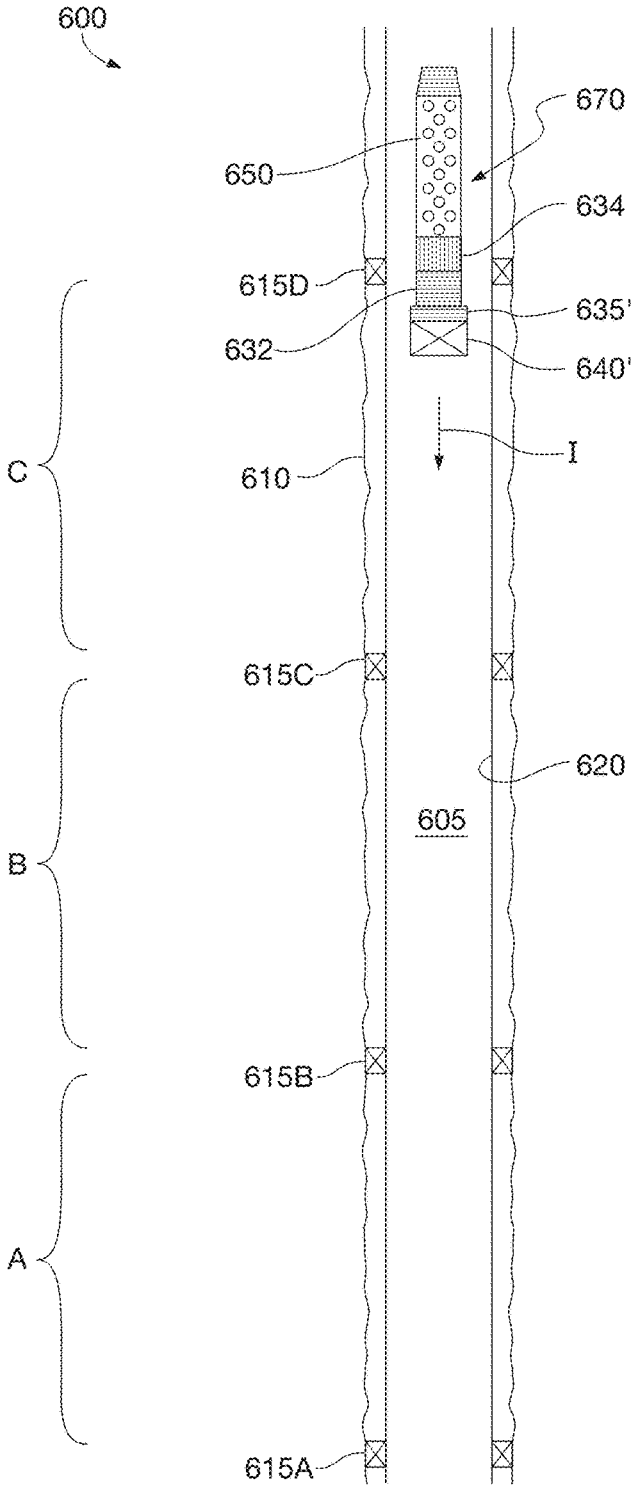
FIGS. 18A through 18F present a series of side views of a lower portion of a wellbore. The wellbore is undergoing a completion procedure that uses autonomous completion assemblies and ball sealers in a novel seamless procedure.

Referring first to exemplary FIG. 18A, FIG. 18A presents a portion of a wellbore 600, such as but not limited to an extended-length horizontal wellbore. Wellbore 600 is lined with a string of production casing 620. The production casing 620 provides a bore 605 for the transport of fluids into and out of the wellbore 600 during completion operations. Production casing 620 resides within a surrounding subsurface formation 610. Annular packers are again placed along the casing 620 to isolate selected subsurface zones, identified as "A," "B" and "C." The packers are designated as 615A, 615B, 615C, and 615D.

Figure 18B:
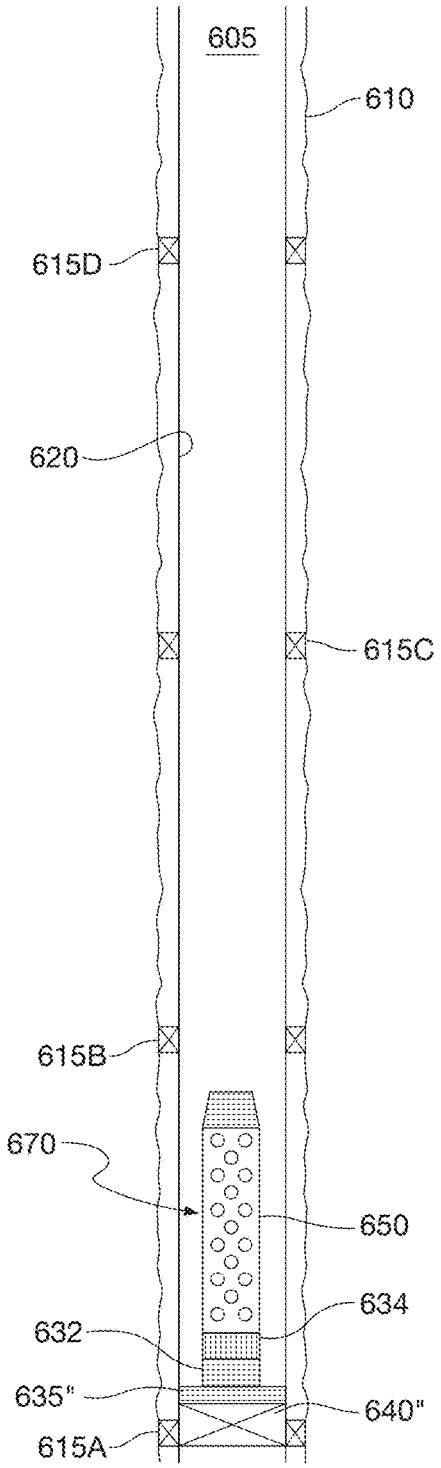

To complete wellbore 600, Zones A, B and C are each perforated. In FIG. 18B, a perforating gun 650 has been released into throughbore 605 for the purpose of perforating Zone A. In one aspect, the perforating gun 650 may be run into the wellbore using a wireline (not depicted). In this arrangement, the wireline 455 and connected perforating gun 450 and plug 440A of FIG. 6B may be used. However, it may be preferred, as depicted in FIGS. 18A and 18B, that the perforating gun 650 be part of an autonomously deployable assembly 670 (gravity fall, pumped, and/or tractored along the wellbore).

The autonomous perforating assembly 670 is designed to be released into the wellbore 600 and to be self-actuating. In this respect, the assembly does not require a wireline and need not otherwise be mechanically tethered or electronically connected to equipment external to the wellbore. The delivery method may include gravity, pumping, and tractor delivery.

The autonomous assembly 670 first includes a location sensing device 632. The locator 632 measures magnetic flux as the assembly 670 falls through the wellbore 600. Anomalies in magnetic flux are interpreted as casing collars residing along the length of the casing string 620. The assembly 670 is aware of its location in the wellbore 600 by counting collars along the casing string 620 as the assembly 670 moves downward through the wellbore 600.

The assembly 670 also includes a plug body 640. The plug body 640 defines an elastomeric sealing element. The sealing element is mechanically expanded in response to a shift in a sleeve or other means as is known in the art for mechanically or hydraulically set tools. In one embodiment, the plug body plug body 640 is actuated by squeezing the sealing element using a sleeve or sliding ring; in another aspect, the plug body 640 is actuated by forcing the sealing element outwardly along wedges (not depicted).

In the view of FIG. 6A, the plug body 640 is in its run-in position, indicated as 640'. However, when actuated the plug body 640 expands into a set position, indicated in FIG. 18B as 640".

The autonomous assembly 670 also includes an on-board controller 634. The on-board controller 634 is programmed to send at least two signals. A first signal is sent to the plug body 640 when the assembly 670 has reached a selected location along the wellbore 600. In the case of FIG. 18B, that location is a depth that is adjacent to the packer 615A, or that is otherwise somewhere along Zone A. A second signal is sent to the perforating gun 650 after the plug 640A has been set.

It is observed that the autonomous assembly 670 may include a small set of slips 635. The slips 635 ride outwardly from the assembly 670 along wedges (not depicted) spaced radially around the assembly 670. The slips 635 may be urged outwardly along the wedges in response to a shift in a sleeve or other means as is known in the art. The slips 670 extend radially to "bite" into the casing 620 when actuated. Examples of existing plugs with suitable slip designs are the Smith Copperhead Drillable Bridge Plug and the Halliburton Fas Drill® Frac Plug. In this manner, the assembly 670 is secured in position. In this instance, the first signal that is sent to the plug 640A is also used to actuate the slips 635.

Applicant has previously caused to be filed a patent application entitled "Autonomous Downhole Conveyance System." That application published as U.S. Patent Publ. No. 2013/0248174. That application provided details concerning the actuation of slips and an associated plug for an autonomous downhole assembly. That application is incorporated herein by reference in its entirety.

In FIG. 18A, the autonomous assembly 670 is depicted in its run-in (or pre-actuated) position. In this position, the slips 635' and the plug 640' are in their run-in position. The assembly 670 in its pre-actuated position is falling in the wellbore 600 according to arrow "I."

FIG. 6B illustrates the autonomous assembly 670 having reached its destination. The on-board controller 634 has sent a signal causing the slips 635" and the associated plug 640" to move into their set (or actuated) position. The slips 635" and plug 640" are set along the production casing 620 at a location adjacent packer 615A.

Figure 18C:
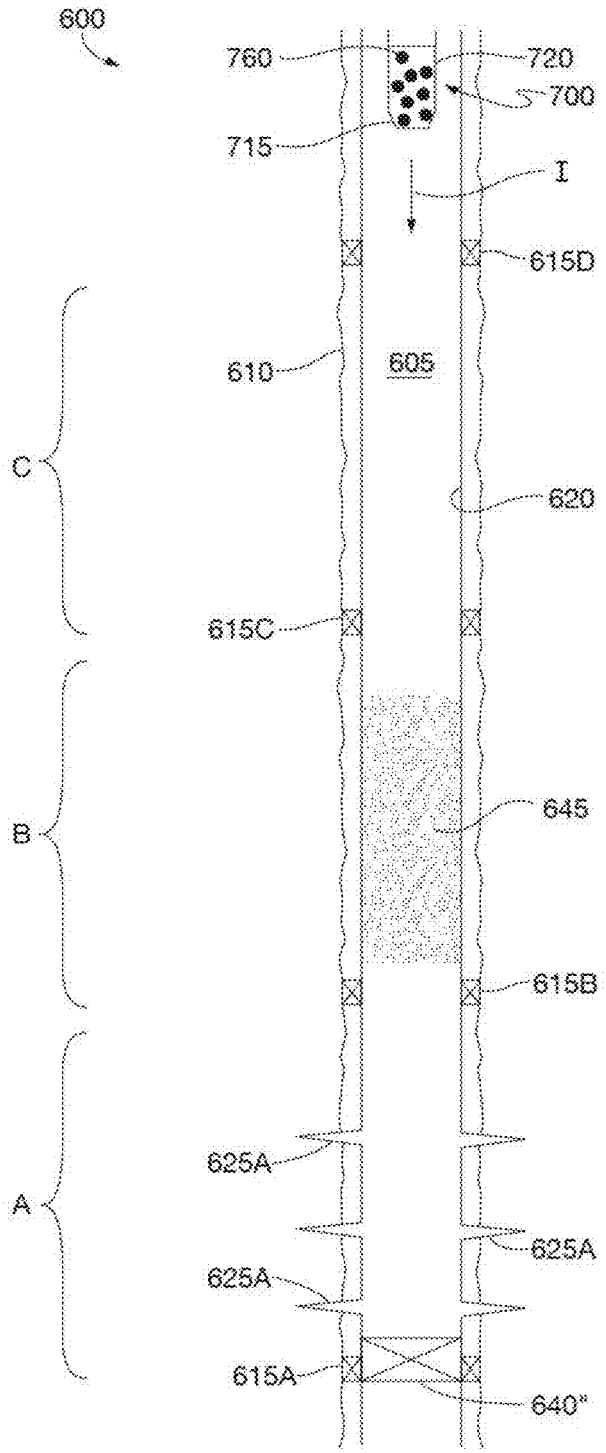

FIG. 18C illustrates Zone A having been perforated. The perforating gun 650 has disintegrated and is no longer visible. Simultaneously, or immediately thereafter, a fracturing fluid 645 is being pumped into the wellbore 600, with a new autonomous completion assembly 700 being released into the wellbore 600 behind the fracturing fluid 645. A leading tip 715 of the assembly 700 is visible in FIG. 18C.

FIG. 7 is a side view of the autonomous completion assembly 700 of FIG. 18C (and FIG. 18D), in one embodiment. The completion assembly 700 is used for perforating a zone along a wellbore without being tethered to or receiving wired instructions from the surface.

Figure 19:
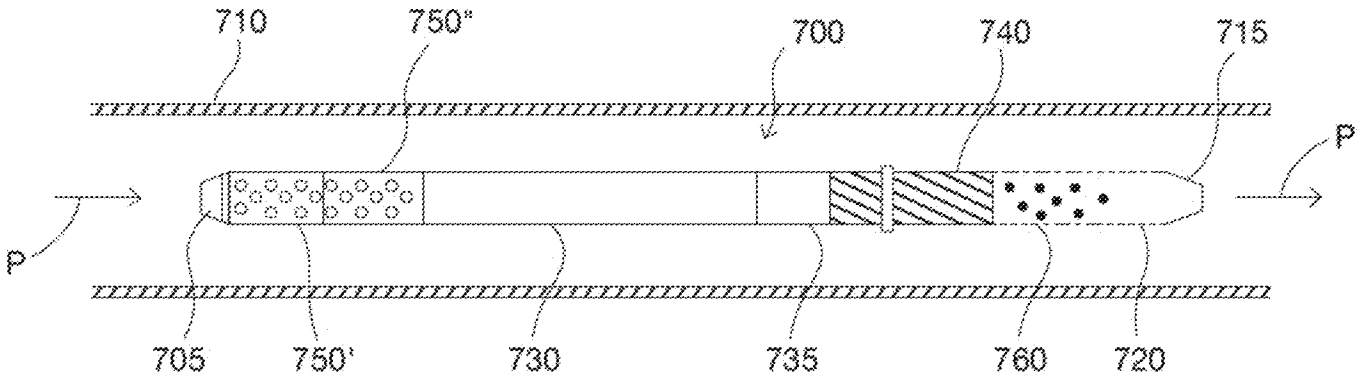
FIG. 19 is a side view of an autonomous completion assembly of the present invention, in one embodiment. The completion assembly is used for perforating a zone along a wellbore without being electrically or optically engaged with the surface or receiving communicated instructions from the surface.

As with the autonomous perforating assembly 670 of FIG. 18B, the autonomous completion assembly 700 includes a perforating gun 750. In the arrangement of FIG. 19, the assembly 700 includes two separate perforating guns, indicated at 750' and 750". This reserves the ability of the assembly to fire separate sets of charges in response to separate activation signals.

The autonomous assembly 700 defines an elongated body having a leading end 715 and a trailing end 705. The entire assembly 700 is preferably fabricated from a material that is frangible or destructible to particulate-type debris. In this respect, it is designed to disintegrate when charges associated with the perforating guns 750 are detonated.

The autonomous assembly 700 also includes a location sensing device 740, known in the industry as a "CCL." The CCL senses the location of the casing collars as it moves down the casing string 620. While FIG. 19 presents the position locator 740 as a CCL for sensing casing collars, it is understood that other sensing arrangements may be employed in the completion assembly 700. For example, the position locator may be a radio frequency detector, and the sensed objects may be radio frequency identification tags, or "RFID" devices. In this arrangement, the tags may be placed along the inner diameters of selected casing joints, and the position locator will define an RFID antenna/reader that detects the RFID tags.

The CCL 740 measures magnetic flux as the assembly 700 falls through the wellbore 600. Anomalies in magnetic flux are interpreted as casing collars residing along the length of the casing string 620. The assembly 700 is aware of its location in the wellbore 600 by counting collars along the casing string 620 as the assembly 700 moves downward through the wellbore 600.

The autonomous assembly 700 also includes a transport member 720. The transport member 720 may be configured to hold a plurality of adaptable sealing devices 760. In some embodiments, the transport member 720 or an additional transport member may additionally holds a treating fluid such as an acid or a blocking material such as a resin.

The autonomous assembly 700 also includes an on-board controller 730. The on-board controller 730 is programmed to send at least two signals. A first signal is sent to the transport member 720 when the assembly 670 has reached a selected location along the wellbore 600. That signal causes the adaptable perforation sealing devices 760 to be released. This may be done, for example, by opening a valve. A second signal is sent to the perforating gun 750.

The autonomous assembly 700 may also include a power supply 735. The power supply 735 may be, for example, one or more lithium batteries, or battery pack. The power supply 735 will reside in a housing along with the on-board controller 730. The perforating gun 750, the location device 740, the on-board controller 730 and the power supply 735 are together dimensioned and arranged to be deployed in a wellbore as an autonomous unit.

Figure 18D:
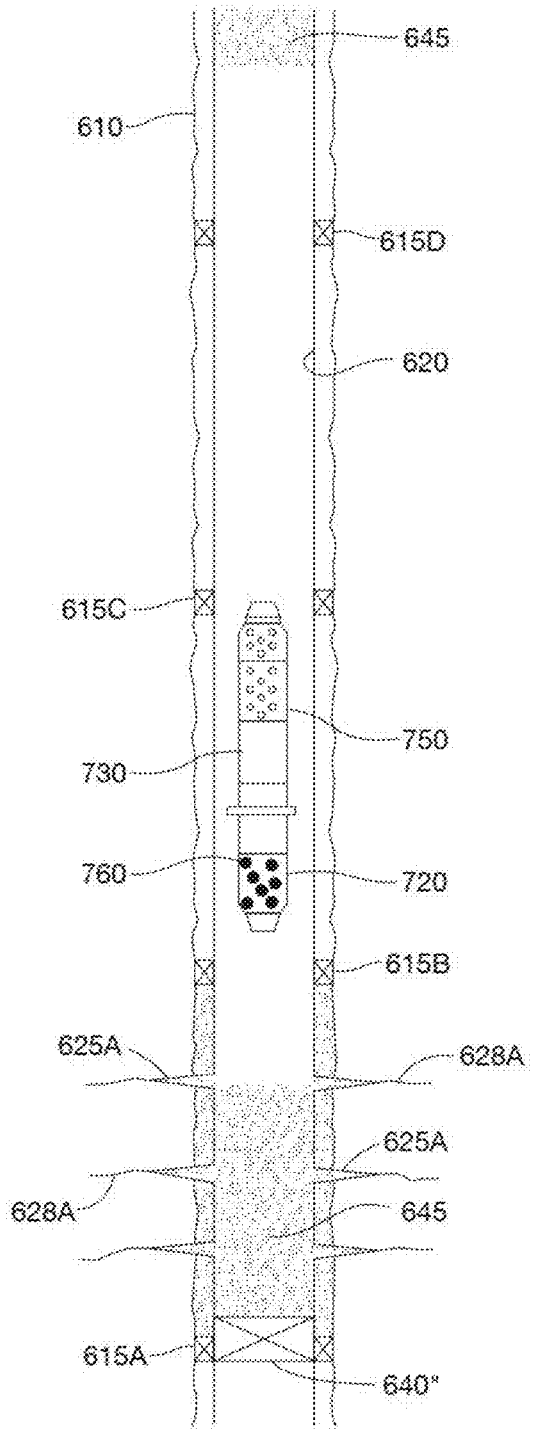

Referring now to FIG. 18D, FIG. 18D illustrates the fracturing fluid 645 having been pumped through the perforations in Zone A. Artificial fractures 628A have been induced in the subsurface formation 610 along Zone A. Simultaneously, the autonomous completion assembly 700 of FIG. 6C has fallen to a location along Zone B. The assembly 700 is in position to fire a new set of perforations, seamlessly.

It is again observed that the autonomous assembly 700 is designed to be frangible. Thus, after the firing step in FIG. 18D, the assembly 700 will no longer be visible. A new completion assembly will be dropped for Zone B.

Figure 18E:
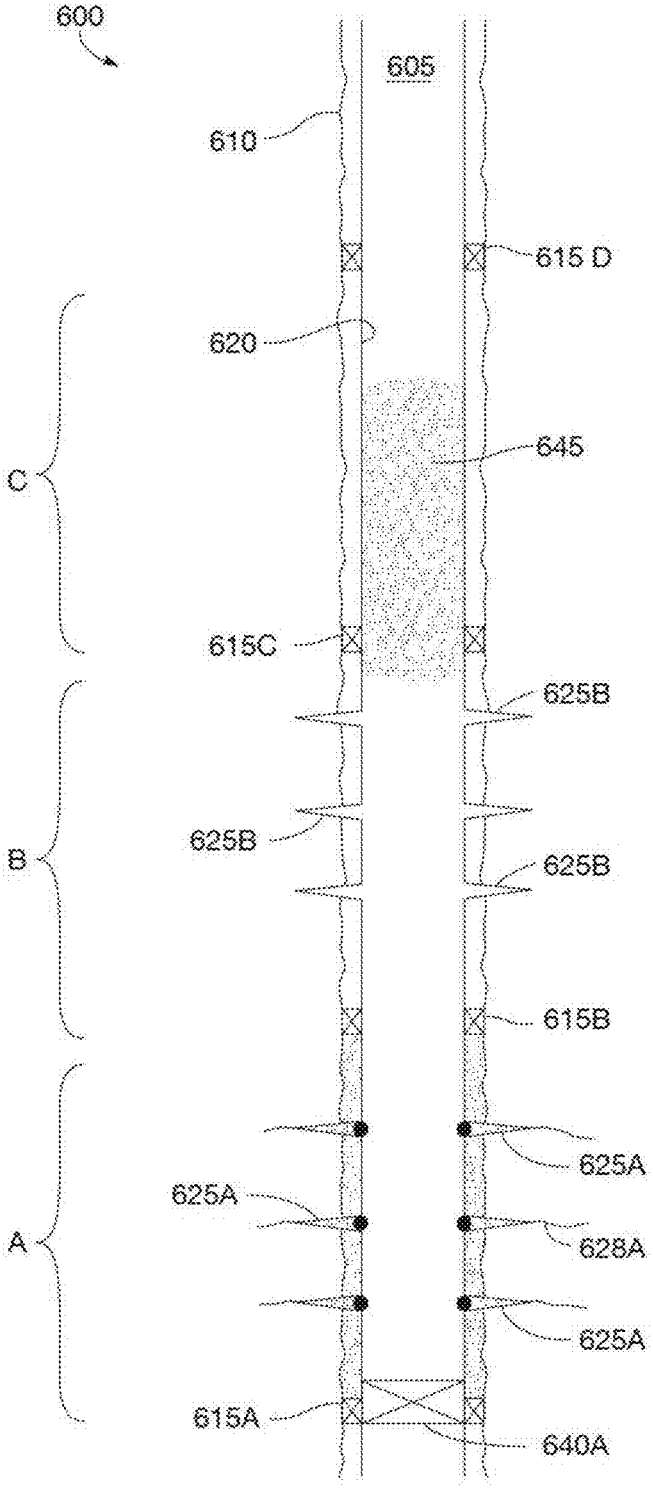

FIG. 18E illustrates an exemplary next step in a multi-zone completion process. Here, the adaptable perforation sealing devices 760 from the assembly 700 of FIG. 18D (that is no longer present) have landed or seated on the perforations 625A along Zone A. Additionally, the perforating gun 700 of FIG. 6D has fired, creating fractures 625B along Zone B. A new fracturing fluid 645 is now being pumped in the wellbore 600 in anticipation of treating Zone B.

Figure 18F:
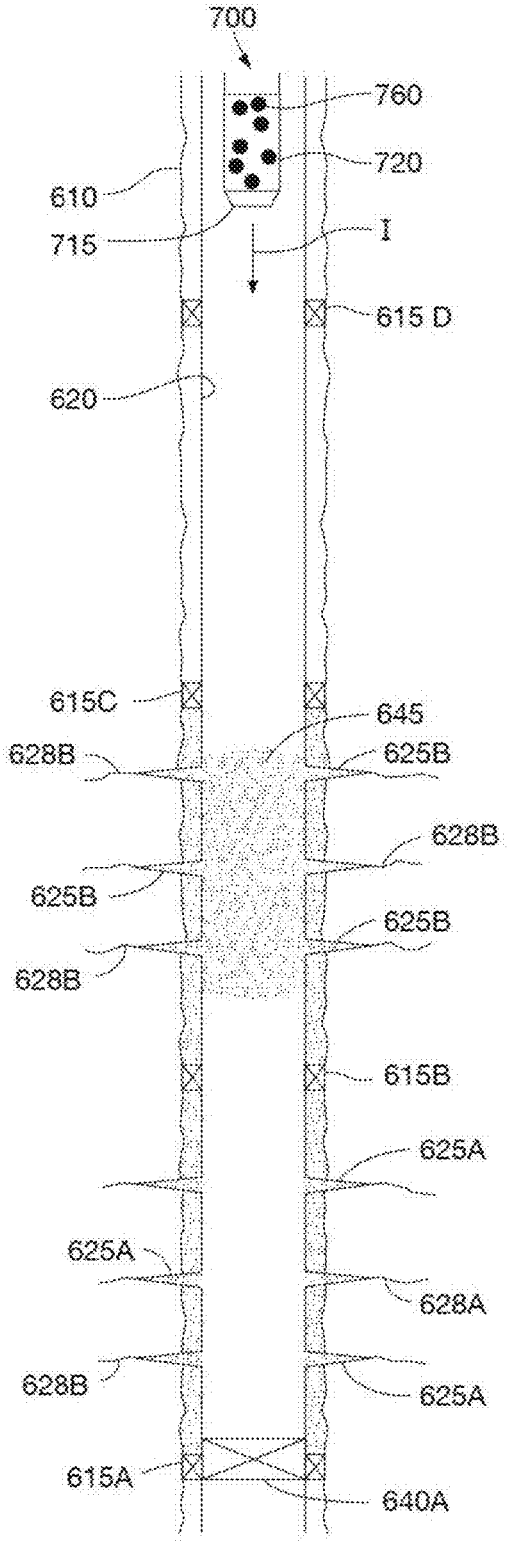

FIG. 18F illustrates the fracturing fluid 645 of FIG. 18E now being pumped into the perforations 625B along Zone B. Artificial fractures 628B are being formed along Zone B. Simultaneously, a new autonomous completion assembly 700 has been released into the wellbore 600 in anticipation of creating perforations along Zone C.

It can be seen that the completion assembly 700 allows for the perforation and fracturing of multiple zones along a wellbore without requiring work stoppage to pull or to change out tools. The completion assembly 700 is autonomous, meaning that it is not electrically controlled from the surface for receiving activation signals.

The completion assembly 700 is typically provided with a location determining algorithm and/or data set comprising information pertaining to the wellbore and/or subsurface features. Such algorithm allows the tool to accurately track or self-locate, such as by utilizing casing collar spacing, en route to a selected location downhole. U.S. patent application Ser. No. 13/989,726 filed on Dec. 27, 2010 discloses a method of actuating a downhole tool in a wellbore, published as U.S. Patent Publ. No. 2013/0255939, entitled "Method for Automatic Control and Positioning of Autonomous Downhole Tools".

U.S. Patent Publ. No. 2013/0255939 discloses and discusses the tool-locating algorithm. According to that disclosure, the operator will first acquire a CCL data set from the wellbore. This is preferably done using a casing collar locator and/or optionally a gamma-ray detector tool. The casing collar locator is run into a wellbore on a wireline or electric line to detect magnetic anomalies along the casing string. The CCL data set correlates continuously recorded magnetic signals with measured depth. More specifically, the depths of casing collars may be determined based on the length and speed of the wireline pulling a CCL logging device. In this way, a first CCL log for the wellbore is formed.

The disclosure also includes selecting a location within the wellbore for actuation of an actuatable tool. In exemplary completion assembly 700, two separately actuatable tools are provided. These are a transport member that releases adaptable perforation sealing devices into the wellbore and a perforating gun that detonates charges. The controller may actuate both devices simultaneously, or individually. Complete tool destruction may be provided in conjunction with actuation of both tools simultaneously, or during actuation of the last tool to be actuated, as desired. Complete tool destruction may occur all at once or in separate stages by tool component, as desired.

In practice, a first CCL log data set and/or a gamma ray log data set, and/or a wellbore position or location marker data set, such as radioactive signals, may be downloaded into a processor. For convenience, the processor is typically part of the on-board controller 730. The on-board controller 730 processes the depth signals generated by the casing collar locator 740. In one aspect, the on-board controller 730 may compare the generated signals from the position locator 740 with a pre-determined physical signature obtained for wellbore objects from the prior CCL log.

The on-board controller 730 is programmed to continuously record magnetic signals as the autonomous tool 700 traverses the casing collars. In this way, a second CCL log is formed. The processor, or on-board controller 730, transforms the recorded magnetic signals of the second CCL log by applying a moving windowed statistical analysis. Further, the processor incrementally compares the transformed second CCL log with the first CCL log during deployment of the downhole tool to correlate values indicative of casing collar locations. This is preferably done through a pattern matching algorithm. The algorithm correlates individual peaks or even groups of peaks representing casing collar locations. In addition, the processor is programmed to recognize the selected location in the wellbore, and then send an activation signal to the actuatable wellbore device or tool when the processor has recognized the selected location.

In some instances, the operator may have access to a wellbore diagram providing exact information concerning the spacing of downhole markers such as the casing collars. The on-board controller 216 may then be programmed to count the casing collars, thereby determining the location of the tool as it moves downwardly in the wellbore.

In some instances, the production casing 620 may be pre-designed to have so-called short joints, that is, selected joints that are only, for example, 15 feet, or 20 feet, in length, as opposed to the "standard" length selected by the operator for completing a well, such as 30 feet. In this event, the on-board controller 730 may use the non-uniform spacing provided by the short joints as a means of checking or confirming a location in the wellbore as the completion assembly 700 moves through the casing 620.

In one embodiment, the method further comprises transforming the CCL data set for the first CCL log. This also is done by applying a moving windowed statistical analysis. The first CCL log is downloaded into the processor as a first transformed CCL log. In this embodiment, the processor incrementally compares the second transformed CCL log with the first transformed CCL log to correlate values indicative of casing collar locations.

In one embodiment, the algorithm interacts with an on-board accelerometer. An accelerometer is a device that measures acceleration experienced during a freefall. An accelerometer may include multi-axis capability to detect magnitude and direction of the acceleration as a vector quantity. When in communication with analytical software, the accelerometer allows the position of an object to be confirmed.

Additional details for the tool-locating algorithm are disclosed in U.S. Patent Publ. No. 2013/0255939, referenced above. That related, co-pending application is incorporated by reference herein in its entirety.

It is also desirable with the autonomous completion assembly 700 to include various safety features that prevent the premature actuation or firing of the perforating guns 750', 750". These are in addition to the locator device 730 and the on-board controller 740 described above. Preferably, each autonomous completion assembly 700 utilizes at least two, and preferably at least three, safety gates or "barriers" that must be satisfied before the perforating gun 750 may be armed.

Figure 20:
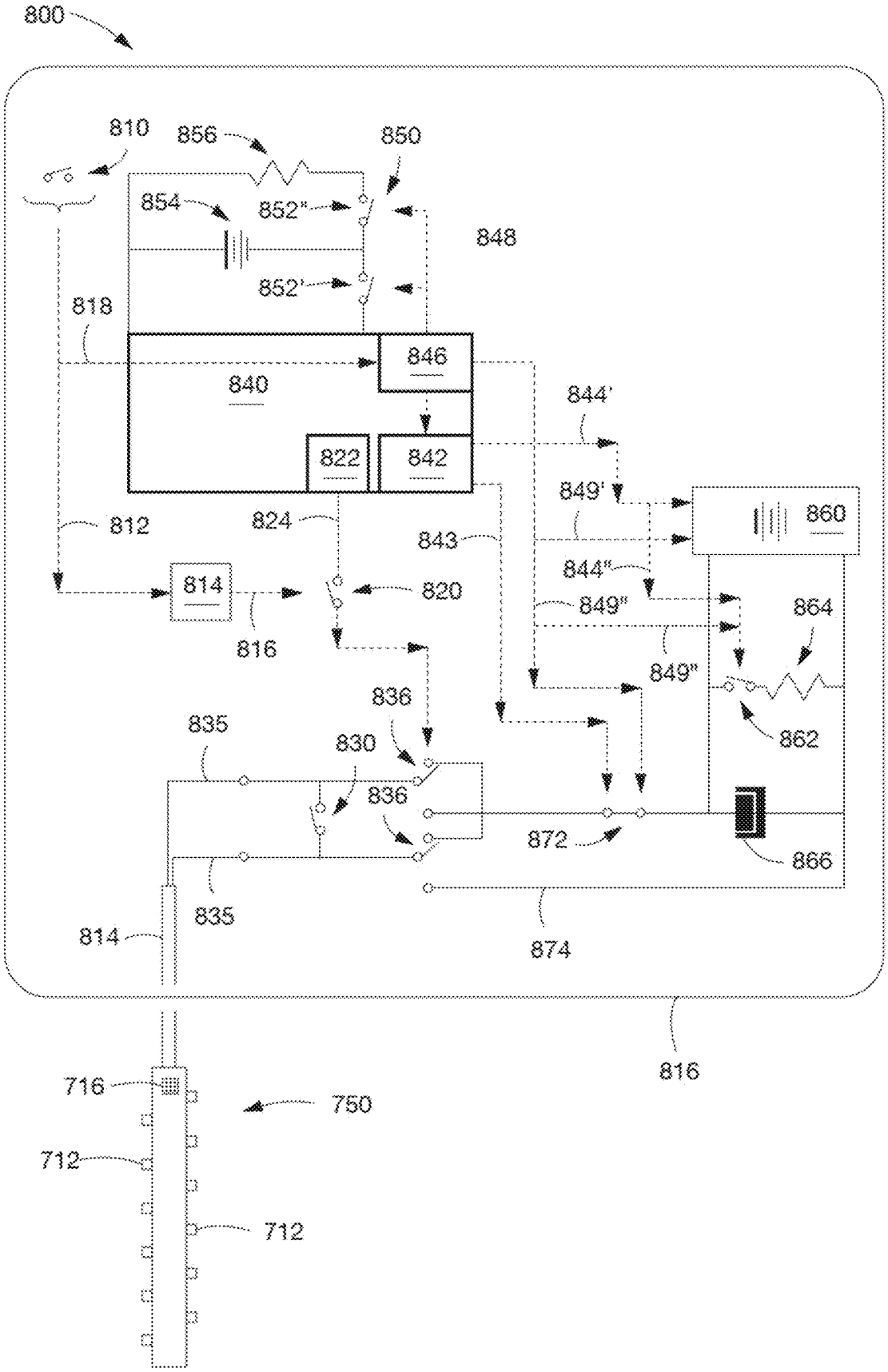
FIG. 20 schematically illustrates an exemplary multi-gated safety system for the disclosed autonomous tools.

FIG. 20 schematically illustrates an exemplary embodiment for a multi-gated safety system 800 for an autonomous wellbore tool. In the safety system 800 of FIG. 8, five separate gates are provided. The gates are indicated at 810, 820, 830, 840, and 850. Each of these illustrative gates 810, 820, 830, 840, 850 represents a condition that must be satisfied in order for detonation charges 712 to be activated. Stated another way, the gated safety system 800 keeps detonators 716 inactive while the completion assembly 700 and its perforating guns 850', 850" are at the surface or is in transit to a well site.

Using the gates 810, 820, 830, 840, 850, electrical current to detonators 716 is initially shunted to prevent detonation of charges 712 caused by stray currents. In this respect, electrically actuated explosive devices can be susceptible to detonation by stray electrical signals. These may include radio signals, static electricity, or lightning strikes. After the assembly is launched, the gates are removed. This is done by un-shunting the detonator by operating an electrical switch, and by further closing electrical switches one by one until an activation signal may pass through the safety circuit and the detonators 716 are active.

In exemplary FIG. 8, a perforating gun is seen schematically at 750. The perforating gun 750 includes a plurality of shaped charges 712. The charges 712 are distributed along the length of the gun 850. The charges 712 are ignited in response to an electrical signal delivered from a controller 816 through electrical lines 835 and to the detonators 716. The lines 835 are bundled into a sheath 814 for delivery to the perforating gun 750 and the detonators 716. Optionally, the electrical lines (depicted at 835) are pulled from inside the completion assembly 700 as a safety precaution until the assembly 700 is delivered to a well site.

The detonators 716 may receive an electrical current from a firing capacitor 866. The detonators 716 (typically including a blasting cap) in turn deliver impact energy to the primer cord to fire the primer cord, which in turn fires delivers impact to the charges 712 to fire the charge to create the perforations. Electrical current to the detonators 716 is initially shunted to prevent detonation from stray currents. In this respect, electrically actuated explosive devices can be susceptible to detonation by stray electrical signals. These may include radio signals, static electricity, or lightning strikes. After the assembly 700 is launched, the gates are removed. This is done by un-shunting the detonators 716 by operating an initial electrical switch (seen at gate 810), and by further closing electrical switches one by one until an activation signal may pass through the safety circuit 800 and the detonators 716 are active.

In the arrangement of FIG. 8, two physical shunt wires 835 are provided. Initially, the wires 835 are connected across the detonators 716. This connection is external to the perforating gun assembly 700. Wires 835 are visible from the outside of the assembly 700. When the assembly 700 is delivered to the well site, the shunt wires 835 are disconnected from one another and are connected to the detonators 716 and to the circuitry making up the safety system 800.

In operation, a detonation battery 860 is provided for the perforating gun 750. At the appropriate time, the detonation battery 860 delivers an electrical charge to a firing capacitor 866. The firing capacitor 866 then sends a strong electrical signal through one or more electrical lines 835. The lines 835 terminate at the detonators 716 within the perforating gun 750. The electrical signal generates resistive heat, which causes a detonation cord (not depicted) to burn. The heating rapidly travels to the shaped charges 712 along the perforating gun 750.

In order to prevent premature actuation and as noted above, a redundant arrangement and/or series of gates may be provided. U.S. Ser. No. 61/489,165 describes a perforating gun assembly being released from a wellhead. That application was filed on 23 May 2011, and is entitled "Safety System for Autonomous Downhole Tool." The application was published as U.S. Publ. No. 2013/0248174. FIG. 20 and the corresponding discussion of the gates in that published application are incorporated herein by reference.

Without duplicating that full discussion, the exemplary gates are generally:

- A first gate 810, which is an optional pull tab mechanically removed by the crew at the well site;
- A second gate 820, which is a timed relay switch that shunts the electrical connections to the detonators 716 at all times unless a predetermined time value is exceeded;
- A third gate 830, which is based upon one or more pressure-sensitive switches;
- A fourth gate 840, which is an electronics module containing digital logic that determines the location of the gun assembly 700 as it traverses the wellbore by processing magnetic readings to identify probable casing collar locations, and compare those locations with a previously-downloaded (and, optionally algorithmically processed) casing collar log; and
- A fifth gate 850, which relates to the installation of a battery pack 854, meaning that the battery pack is not installed to power the controller of the fourth gate 840 until after the completion assembly 700 is at or near the well site. Without the controller, the firing capacitor cannot deliver electrical signals through the wires 835 and the detonators 716 cannot be armed.

In an exemplary embodiment, the completion assembly 700 may include a button or other user interface that allows an operator to manually "arm" the perforating gun 750. The user interface is in electrical communication with a timer within the on-board controller 730. For example, the timer might be 2 minutes. This means that the perforating gun 750 cannot fire for 2 minutes from the time of arming. Here, the operator must remember to manually arm the perforating gun 750 before releasing the assembly into the wellbore 600.

The exemplary safety system 800 may be programmed or designed to de-activate the detonators 716 in the case that detonation does not occur within a specified period of time. For instance, if the detonators 716 have not caused the charges 712 to fire after 55 minutes, the electrical switch representing the second gate 820 is opened, thereby preventing the relay 836 from changing state from shunting the detonators 716 to connecting the detonators 716 to the firing capacitor 866. This feature enables the safe retrieval of the gun assembly 700 utilizing standard fishing operations. In any instance, a control signal is provided through dashed line 816 for operating the switch of the second gate 820.

The electronics module of the fourth gate 840 consists of an onboard memory 842 and built-in logic 844, together forming the controller. The electronics module provides a digital safety barrier based on logic and predetermined values of various tool events. Such events may include tool depth, tool speed, tool travel time, and downhole markers. Downhole markers may be Casing Collar Locator (CCL) signals caused by collars and pup joints intentionally (or unintentionally) placed in the completion string.

In the exemplary arrangement of FIG. 8, a signal 818 is sent when the launch switch representing the first gate 810 is closed. The signal 818 informs the controller to begin computing tool depth in accordance with its operational algorithm. The controller includes a detonator control 842. At the appropriate depth, the detonator control 842 sends a first signal 844' to the detonator power supply 860. In one aspect, the detonator power supply 860 is turned on a predetermined number of minutes, such as three minutes, after the completion assembly 700 is launched.

It is noted that in an electrically powered perforating gun, a strong electrical charge is needed to ignite the detonators 816. The power supply (or battery) 860 itself will not deliver that charge; therefore, the power supply 860 is used to charge the firing capacitor 866. This process typically takes about two minutes. Once the firing capacitor 866 is charged, the current lines 835 may carry the strong charge to the detonators 816. Line 874 is provided as a power line.

The controller of the fourth gate 840 also includes a fire control 822. The fire control 822 is part of the logic. For example, the program or digital logic representing the fourth gate 840 locates the perforating zone by matching a reference casing collar log using real time casing collar information acquired as the tool drops down the well. When the perforating gun assembly 700 reaches the appropriate depth, a firing signal 824 is sent.

The fire control 822 is connected to a 2-pole Form C fire relay 836. The fire relay 836 is controlled through a command signal depicted at 824. The fire relay 836 is in a shunting of detonators 716 (or safe) state until activated by the fire control 822, and until the command path 824 through the second gate 820 is available. In their safe state, the fire relay 836 disconnects the up-stream power supply 860 and shunts down-stream detonators 816. The relay 836 is activated upon command 824 from the fire control 822.

As an alternative to any of gates 810, 820, 830 or 850, a vertical position indicator may be used as a safety check. This means that the on-board controller 730 will not provide a signal to the perforating gun 750 to fire until the vertical position indicator confirms that the completion assembly 700 is oriented in a substantially vertical orientation, e.g., within five degrees of vertical. For example, the vertical position indicator may be a mercury tube that is in electrical communication with the on-board controller. Of course, this safety feature only works where the wellbore 600 is being perforated or the tool 700 is being actuated along a substantially vertical zone of interest. Thus, this type of safety check is not depicted in exemplary FIG. 8.

In yet another alternative, a safety check may be utilized that involves a velocity calculation. In this instance, the perforating gun assembly 700 may include a second locator device spaced some distance below the original locator device. As the assembly 700 travels across casing collars, signals generated by the second and the original locator devices are timed. In its simplest form, the velocity of the assembly may be determined by the following equation:

$$D/(T2-T0)$$

Where: To=Time stamp of the detected signal from the original locator device;

T2=Time stamp of the detected signal from a second locator device; and

D=Distance between the original and second locator devices.

Use of such a velocity calculation ensures both a depth and the present movement of the perforating gun assembly before the firing sequence can be initiated.

In operation, the battery pack (Gate 5) is installed into the perforating gun 750. The gun 750 is then released into the wellbore. The ring removal (Gate 1) triggers a pressure-activated switch (Gate 2) rated to remove the detonator shunt at a predetermined pressure value. In addition, the ring removal (Gate 1) activates a timed relay switch (Gate 3) that removes another detonator shunt once the pre-set time expires. At this point, the detonators 716 are ready to fire and await the activation signal from the control system (the Gate 4 electronics module). The electronics module monitors the depth of the gun assembly 700. After the completion assembly 700 has traveled to a pre-programmed depth, the electronics logic (Gate 4) sends a signal that closes a mechanical relay and initiates detonation.

Additional features of the circuit 800 for the multi-gated safety system are disclosed in the referenced U.S. incorporated patent application that is U.S. Patent Publ. No. 2013/0248174.

Figure 21A:
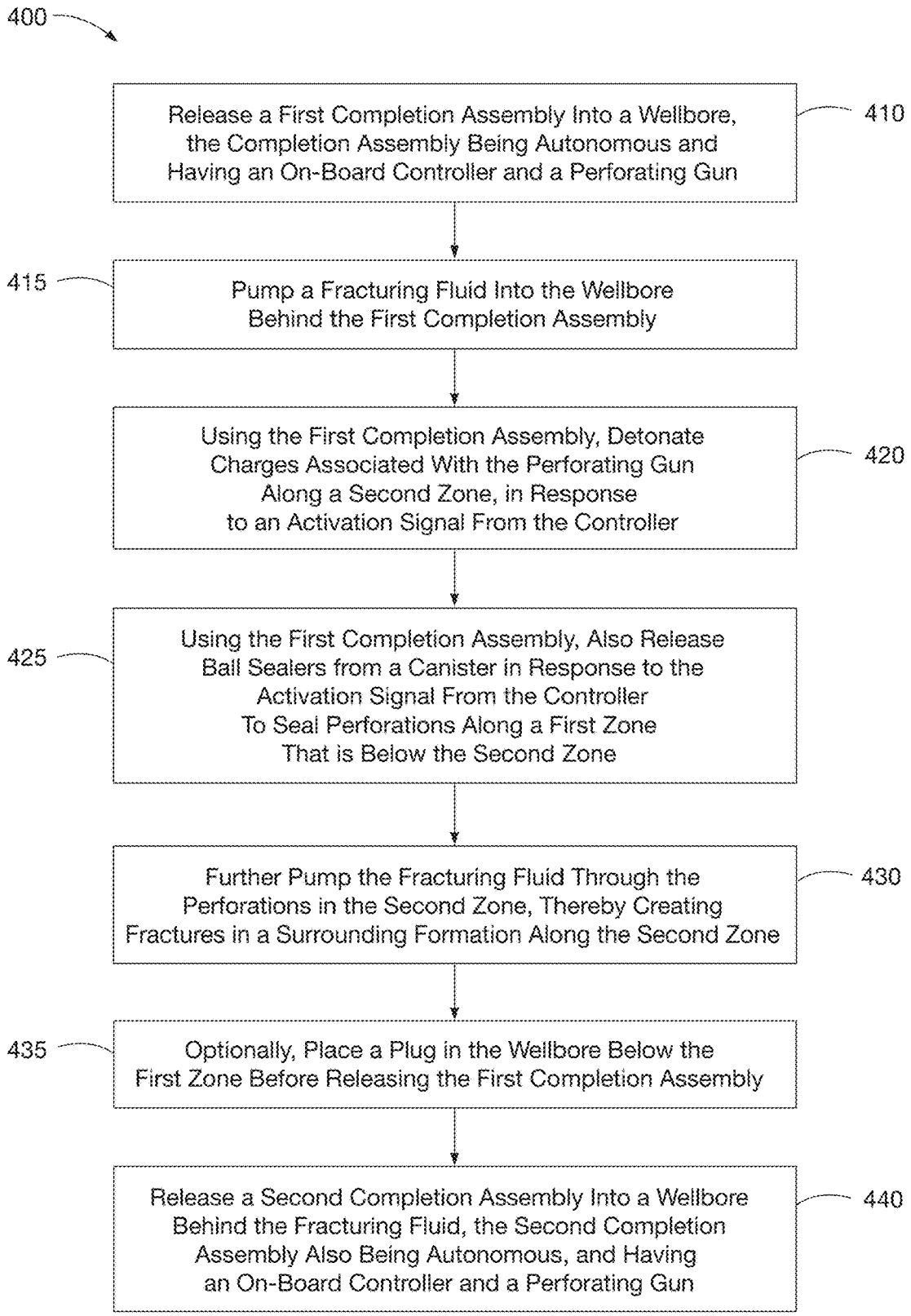
FIGS. 21A and 21B are a single flow chart showing steps for a method of perforating multiple zones along a wellbore, in one embodiment. The method uses the autonomous completion assembly of FIG. 7 and ball sealers in a seamless manner.
Figure 21B:
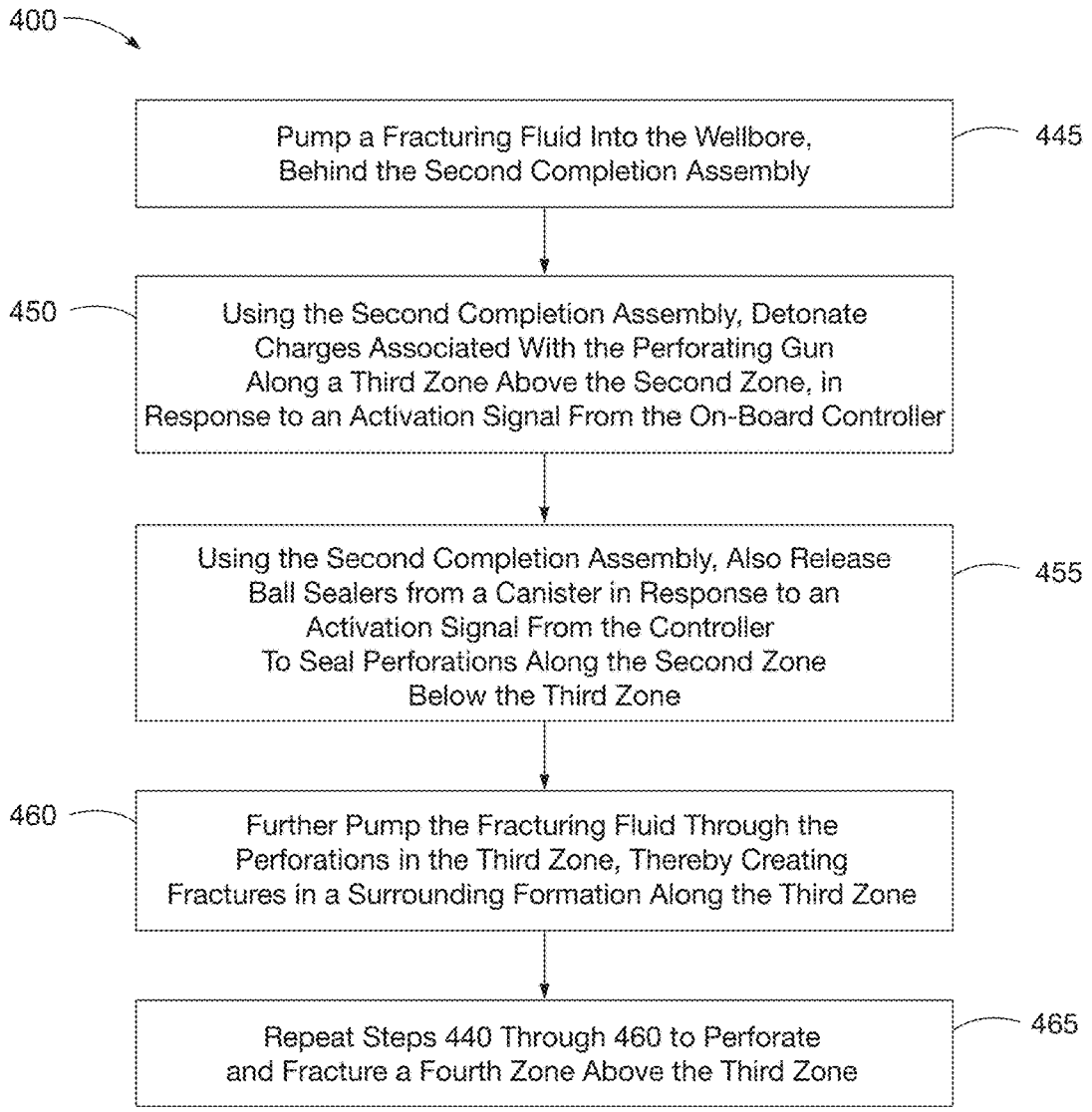

FIGS. 21A and 21B represent a flow chart showing steps for a method 400 of perforating multiple zones along a wellbore, in one embodiment. The method 400 uses the autonomous completion assembly 700 of FIG. 19 for multi-zone fracturing in a seamless manner.

Exemplary method 400 first includes releasing a first completion assembly into the wellbore, as depicted at box 410. The first completion assembly is designed in accordance with the completion assembly for autonomously perforating a section of casing as described above, in its various embodiments. In this respect, the assembly includes a perforating gun, a canister containing a plurality of adaptable perforation sealing devices, a casing collar locator, and an on-board controller. A battery pack may be included to power the on-board controller. The perforating gun, the canister, the locator, and the on-board controller are together dimensioned and arranged to be deployed in the wellbore as a first autonomous unit.

The method 400 also includes pumping a fracturing fluid into the wellbore. This is provided at box 415. The fluid is pumped behind the first completion assembly.

The method 400 next includes detonating charges associated with the perforating gun of the first completion assembly. This is depicted at box 420. The charges detonate in response to an actuation signal from the on-board controller when the locater has recognized a selected location of the completion assembly. More specifically, the signal causes a "cap" to be fired, which activates (concusses or heats, as appropriate) a primer cord, which in turn fires the perforating gun. In this way, the casing is perforated at the selected location as a second zone.

The method 400 additionally includes releasing a plurality of adaptable perforation sealing devices from the canister, as indicated at box 425. The adaptable perforation sealing devices are also released in response to an actuation signal sent by the on-board controller when the locator has recognized a selected location of the completion assembly. Firing or actuation of the perforating guns may accompanied by a complete fragmentation of either (i) at least the gun assembly, and/or (2) maybe both the gun assembly along with the entire autonomous tool assembly, causing release of the adaptable perforation sealing devices, or at least a portion of the tool assembly. In some embodiments, a separate actuation signal may be utilized to fire the guns, release the adaptable perforation sealing devices, destroy the tool assembly, and/or combinations thereof. In some embodiments the separate actuation signals, or various combinations thereof, may be from the same signal or there may be merely one signal that accomplishes all actuations, including tool destruction.

A perforating gun actuation signal and charge design, may be enhanced and/or designed to fragment or destruct desired portions of the autonomous tool assembly into the smallest reasonably desired pieces. Some components, such as plastic components, wire, fasteners, etc., of course will not be fragmented, but will merely be separated into various component waste pieces. The adaptable perforation sealing devices fall down the wellbore and then seal perforations existing in a first zone below the selected location.

In one aspect, releasing the adaptable perforation sealing devices of box 420 also causes a fluid to be released. The fluid may be an acid such as hydrochloric or fluoric acid. Alternatively, the acid may be a pre-cursor or spearhead into the newly created or opened perforations. Alternatively still, the fluid may be a diverter such as a polymer.

In another aspect, a fluid container is provided in the completion assembly. The fluid container comprises a valve having at least one port. The valve is configured to open the at least one port in response to a signal sent from the on-board controller. Alternatively, the fluid is released when the assembly is fragmented.

The method 400 also includes further pumping the fracturing fluid through the perforations in the second zone. This is provided at box 430. The fracturing fluid is pumped under pressure in order to creating artificial fractures in a surrounding formation. Preferably, the fracturing fluid comprises a proppant such as sand.

In one embodiment of the method 400, the method 400 further comprises placing a plug in the wellbore below the first zone. This is given at box 435. The plug is placed before fracturing fluid is pumped in the step of box 415. Placing the plug in the step of box 435 preferably includes actuating a set of slips associated with the plug.

In one aspect, the plug comprises a plug body having an expandable sealing element that is part of an autonomous perforating gun assembly. The autonomous perforating gun assembly has an on-board controller configured to (i) send a first actuation signal that causes the sealing element to expand when the locator has recognized the first selected location of the completion assembly, and (ii) send a second actuation signal to the perforating gun to cause detonators to fire after the plug body has seated, thereby perforating the casing along the first zone.

In another aspect, the expanded sealing element lands on a baffle along the wellbore at or below the first zone. Alternatively, the autonomous perforating gun assembly includes a set of slips that is actuated in response to the first signal.

In one embodiment, the method 400 also includes the steps of:

- releasing a second completion assembly into the wellbore (depicted at box 440);
- pumping a fracturing fluid into the wellbore behind the second completion assembly (depicted at box 445);
- detonating charges associated with the second perforating gun along a third zone above the second zone, thereby perforating the casing along the third zone (depicted at box 450);
- releasing adaptable perforation sealing devices from the second completion assembly to seal perforations along the second zone (depicted at box 455); and
- further pumping the fracturing fluid through the perforations in the third zone, thereby creating additional fractures in a surrounding formation (depicted at box 460).
- the above sequence may then be repeated for opening and treating a fourth or additional zones above the third zone (depicted at box 465). Note that the word "above" is merely used in an exemplary, non-limiting sense, recognizing that the most commonly used completion techniques start near a lower end of the wellbore and work back in an uphole direction, toward the surface. In some completion procedures, it is hereby recognized and included that subsequent zones actually may be downhole, "below" the previously treated zone or "within" a new portion of the presently treated geologic zone.

In the illustrated exemplary instances of the Figures, the second completion assembly also includes a perforating gun, a canister containing a plurality of adaptable perforation sealing devices that are dimensioned to seal perforations, a casing collar locator for sensing the location of the perforating gun within the wellbore based on the spacing of casing collars along the wellbore, and an on-board controller. Here, the on-board computer is configured to send an actuation signal to operatively fire the perforating gun when the locator has recognized a selected location of the completion assembly (box 450), thereby perforating the casing at a third zone above the second zone. The actuation signal may also cause the canister to release the adaptable perforation sealing devices, wherein the adaptable perforation sealing devices then seal perforations existing in the second zone (box 455).

It may be preferred that the casing collar locator and the on-board controller operate with software in accordance with the locating algorithm discussed above. Specifically, the algorithm preferably employs a windowed statistical analysis for interpreting and converting magnetic signals generated by the casing collar locator. In one aspect, the on-board controller compares the generated signals with a pre-determined physical signature obtained for the wellbore objects. For example, a CCL log may be run before deploying the autonomous tool in order to determine the spacing of the casing collars. The corresponding depths of the casing collars may be determined based on the speed of the wireline that pulled the CCL logging device.

Preferably, the fracturing fluid begins to be pumped into the wellbore before the first actuation signal is sent to the canister of the second completion assembly. Preferably, the canister of each of the first and second completion assemblies is fabricated from a friable material such as ceramic. The canisters are then designed to self-destruct in response to the second actuation signal sent to the respective perforating guns. Alternatively, the canisters are designed to self-destruct in response to the first actuation signals such that destruction of the respective canisters causes the release of the respective adaptable perforation sealing devices.

In one arrangement, the signal that releases the adaptable perforation sealing devices involves opening a valve, gate, door, or floor plate. Optionally, the canister holds a fluid, such as an acid, such that opening the valve also releases the fluid before or simultaneously with detonating the charges.

In another exemplary arrangement, a packer may be provided between the first zone and the second zone to seal an annular region between the casing and a surrounding earth formation, intermediate the zones. The process of pumping proppant through the perforations formed in the various zone may create a sand pack in the annular region.

Finally, it is noted that the steps of boxes 410 through 430, or the steps of boxes 440 through 460, may be repeated to perforate and fracture a fourth zone above the third zone.

Figure 22A:
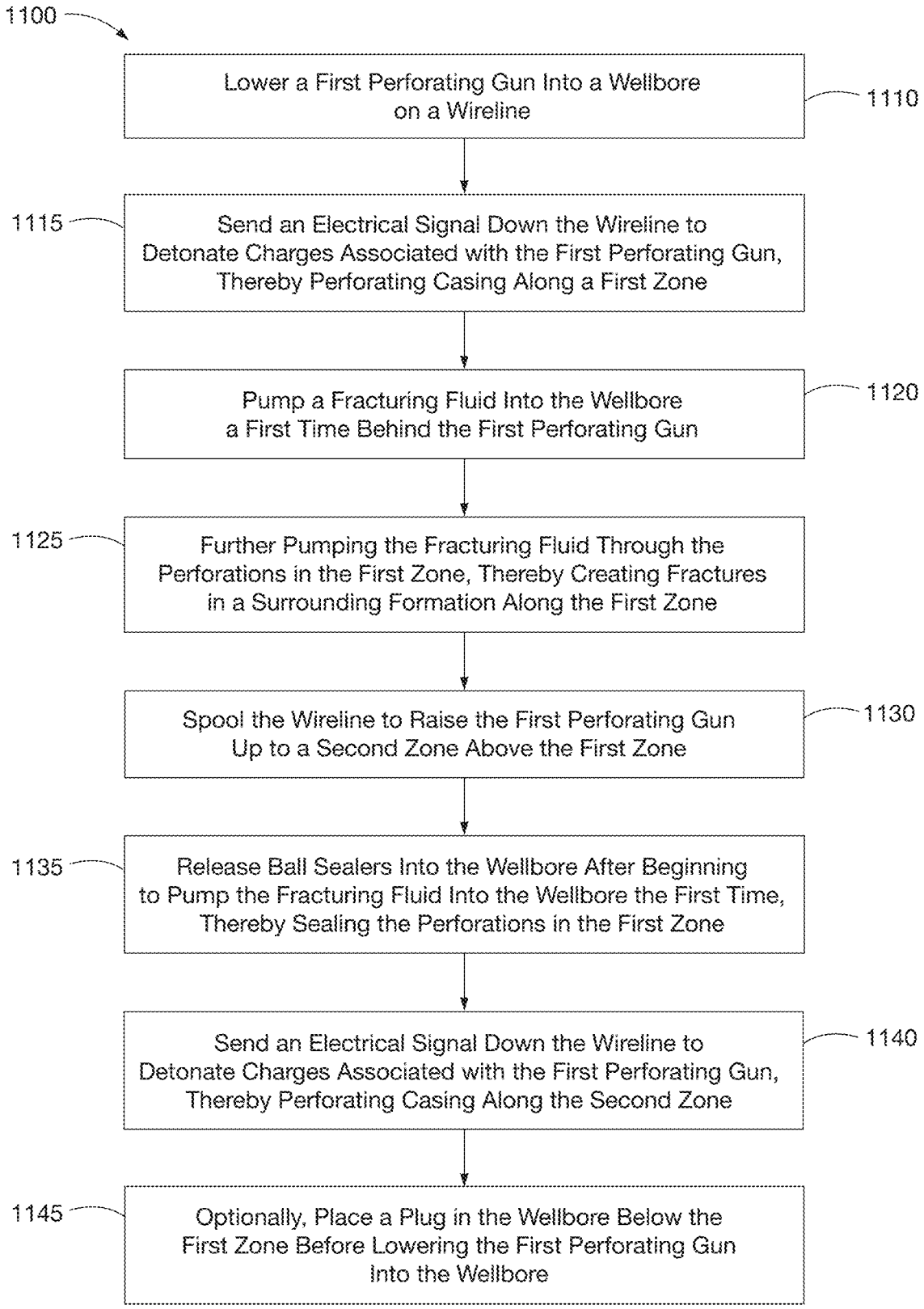
FIGS. 22A and 22B are an exemplary flow chart showing certain steps for a method of perforating multiple zones along a wellbore, in an alternate embodiment. The illustrated exemplary method includes a perforating gun with the autonomously operable tool assembly run into a wellbore on a wireline and separate adaptable perforation sealers.
Figure 22B:
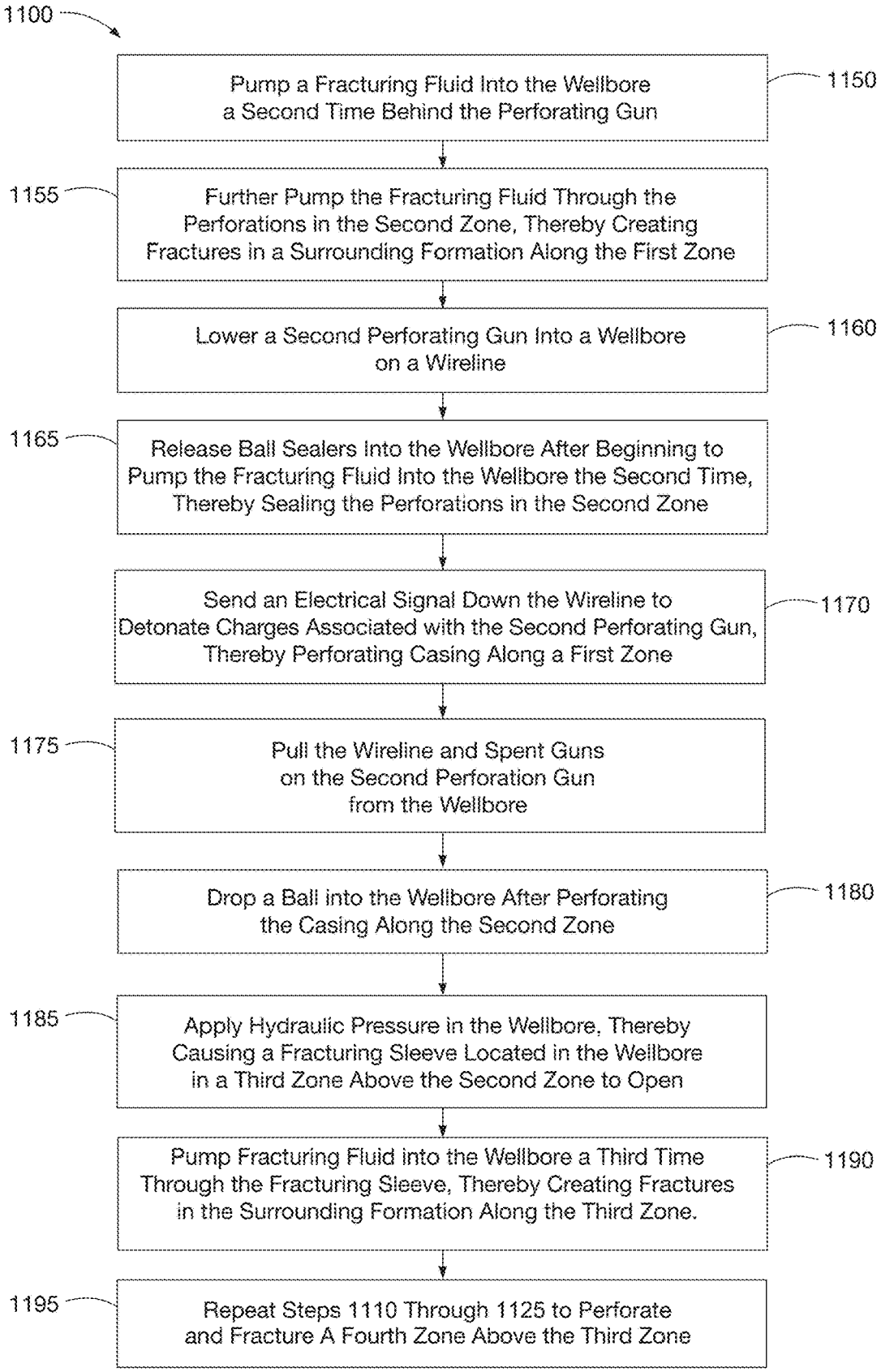

Exemplary FIGS. 22A and 22B represent a flow chart showing steps for a method 1100 of perforating multiple zones along a wellbore, in an alternate embodiment. The exemplary method 1100 uses a perforating gun run into a wellbore on a wireline, and separate adaptable perforation sealing devices for multi-zone fracturing in a seamless manner.

The method 1100 first includes lowering a first perforating gun into the wellbore. This is depicted in box 1110. The gun is lowered on a wireline.

The method 1100 next includes sending an electrical signal down the wireline to detonate charges associated with the first perforating gun. This is provided in box 1115. The result is that perforations are formed in the casing along a first zone.

The method 1100 also includes pumping a fracturing fluid into the wellbore a first time. This is seen at box 1120. The fluid is pumped behind the first perforating assembly. Preferably, the fracturing fluid comprises a proppant such as sand.

The method 1100 then includes further pumping the fracturing fluid through the perforations in the first zone. This is indicated at box 1125. Pumping the fracturing fluid under pressure causes artificial fractures to form in a surrounding earth formation along the first zone.

The method 1100 additionally includes spooling the wireline in order to raise the first perforating gun up to a second zone. This is seen at box 1130. The second zone resides above the first zone.

The exemplary method 1100 also includes releasing adaptable perforation sealing devices into the wellbore. This is provided at box 1135. The releasing step of box 1135 is conducted after beginning to pump the fracturing fluid into the wellbore the first time. The result is that perforations in the first zone are sealed by the adaptable perforation sealing devices.

The method 1100 then includes perforating the casing at a second zone that is above the first zone. This is depicted at box 1140. Perforating the casing is done by sending an electrical signal down the wireline to detonate charges associated with the first perforating gun.

In one embodiment of the method 1100, the method 1100 further comprises placing a plug in the wellbore below the first zone. This is given at box 1145. The plug may be attached to the first perforating gun and is placed before the first perforating gun is fired (per box 1125).

The method 1100 next provides pumping a fracturing fluid into the wellbore a second time. This is seen at box 1150 in FIG. 10B. The fluid is pumped into the wellbore behind the first perforating gun. Preferably, the fracturing fluid comprises a proppant such as sand.

The method 1100 then comprises further pumping the fracturing fluid into the wellbore through the perforations in the second zone. This is provided at box 1155. Pumping the fracturing fluid in under pressure creates additional fractures in the surrounding earth formation along the second zone.

The method 1100 also provides releasing adaptable perforation sealing devices into the wellbore. This indicated at box 1165. The releasing step of box 1165 is conducted after beginning to pump the fracturing fluid into the wellbore the second time. The adaptable perforation sealing devices are dimensioned to seal the perforations in the second zone.

In FIG. 10B, it can be seen that the step of box 1160 provides for lowering a second perforating gun into the wellbore on a wireline. The method 1100 then includes sending an electrical signal down the wireline to detonate charges associated with the second perforating gun. This is depicted in box 1170. In this way, perforations are created in the casing at the second zone. This perforating step 1170 uses the second of a series of guns on the string in a procedure known as select-fire perforating.

It is observed that the steps of boxes 1110 through 1140 may be repeated here in order to perforate and fracture additional zones above the second zone using the same perforating gun in a seamless manner. However, it is understood that the charges of the first perforating gun will be spent after two or three or even ten cycles. In the illustrative flow chart of FIGS. 22A and 22B, it is assumed that the perforating gun that has been lowered into the wellbore in the step of box 1110 has actually already perforated multiple zones below the first zone. In any event, it is eventually necessary for the operator to pull the wireline and the first perforating gun from the wellbore. This is depicted at box 1175.

After the wireline and the first perforating gun are removed, the stimulation treatment may commence and the elecis dropped into the wellbore. This is given at box 1180. The method 1100 then includes applying hydraulic pressure in the wellbore. This is depicted at box 1185. The application of hydraulic pressure causes a fracturing sleeve located in the wellbore in a third zone that is above the second zone to slide into its open position.

Once the frac sleeve is opened, the method 1100 includes pumping a fracturing fluid into the wellbore a third time through the fracturing sleeve. This is depicted at box 1190. In some applications, the steps of boxes 1185 and 1190 are the same actions. In any event, the hydraulic pressure also creates fractures in the surrounding earth formation along the third zone.

The exemplary steps of boxes 1110 through 1125 may be repeated to perforate and fracture additional zones above the third zone, as indicated at box 1195.

It is believed that the disclosure set forth above encompasses multiple distinct inventions with independent utility, but that also provide further expanded utility in combination, such as disclosed herein. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

In the present disclosure, several of the illustrative, non-exclusive examples have been discussed and/or presented in the context of flow diagrams, or flow charts, in which the methods are depicted and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

What is claimed is:

1. A conveyable tool assembly for use in completing a formation penetrated by a wellbore, the tool assembly being conveyable within the wellbore and autonomously actuatable, the tool assembly comprising:

a location sensing device for acquiring information related to the location of the tool assembly within the wellbore;

a plurality of adaptable perforation sealing devices for sealing a plurality of perforations in a wellbore wall, wherein each of the plurality of adaptable perforation sealing devices comprise:

(i) a primary sealing portion that seats on a perforation in the wellbore and forms a primary seal with a respective perforation to at least partially restrict fluid flow through the perforation; and (ii) at least one secondary sealing portion including a secured end engaged with the primary sealing portion and an unsecured end capable of extending radially outward from the primary sealing portion, the secondary sealing portion forming a secondary seal in the perforation between the primary sealing portion and wellbore wall to at least partially restrict fluid flow from within the wellbore through a leakage pathway in the respective perforation between the primary sealing portion and the wellbore wall;

a transport member for supporting the plurality of adaptable sealing devices during conveyance of the tool assembly within the wellbore; and an on-board controller configured to send an actuation signal within the tool assembly to actuate release of the plurality of adaptable perforation sealing devices from the transport member;

wherein the plurality of adaptable perforation sealing devices, the transport member, the location sensing device, and the on-board controller are together dimensioned and arranged to be deployed in the wellbore as an autonomous unit;

wherein the tool assembly comprises a friable material and is prepared to self-destruct within the wellbore in response to a self-destruct signal from the on-board controller; and wherein the actuation signal and the self-destruct signal are distinct signals.

2. The tool assembly of claim 1, wherein the at least a portion of the friable material is destructible into pieces capable to form a debris field within the wellbore, a portion of the debris field affecting a tertiary seal in the perforation to further restrict fluid flow through the leakage pathway.

3. The tool assembly of claim 2, wherein the group of (i) the actuation signal, (ii) the fire signal, and (iii) the self-destruct signal, are comprised of at least two distinct signals separated by a time lag controlled by the controller.

4. The tool assembly of claim 1, further comprising a perforating gun supporting perforating charges therewith and the on-board controller is configured to selectively send a fire signal to the perforating gun to fire the perforating charges.

5. The tool assembly of claim 4, wherein the perforating gun is destructible in response to the fire signal.

6. The tool assembly of claim 4, wherein the controller is configured to selectively send the actuation signal to cause release of the plurality of adaptable sealing devices from the transport member separate from the fire signal that causes the perforating gun to fire.

7. The tool assembly of claim 1, wherein each of the plurality of adaptable perforation sealing devices comprises a destructible shell that confines the secondary sealing portion in a transport condition during conveyance within the wellbore.

8. The tool assembly of claim 7, wherein the destructible shell is destructed in response to at least one of (i) a stimulus generated in response to at least one of the actuation signal and the self-destruct signal, and (ii) impact from the shell engaging on a perforation.

9. The tool assembly of claim 1, wherein the transport member functions as a common protective destructible shell for the plurality of adaptable sealing devices during conveyance and the adaptable perforation sealing devices do not include individual shells.

10. The tool assembly of claim 1, wherein the transport member supports the plurality of adaptable sealing devices by encasement therein and the transport member is destructed in response to the self-destruct signal.

11. The tool assembly of claim 1, wherein at least a portion of the tool assembly comprises a friable material that is formed to create a debris field including at least a determined percentage by mass or volume of particles of a desired distribution according to at least one of size and shape.

12. The tool assembly of claim 1, wherein the portion of the tool assembly comprising a formed friable material tool assembly is formed including at least one of recesses, grooves, varying friability, varying granular composition, selected shape geometry with respect to impact from a shockwave or explosive charge, repeating geometric patterns, tapered thicknesses or shapes, encased beads, aggregated particulates, multi-component mixtures of solids including a substantially continuous binder component and a discontinuous particulate component, compartmentalized materials, and combinations thereof.

13. The tool assembly of claim 1, wherein the transport member comprises at least one of a shroud, compartment, mandrel, bag, tentacle, wire, tubular housing, and combinations thereof.

14. The tool assembly of claim 1, wherein the transport member comprises a housing that includes the plurality of adaptable perforation sealing devices and at least one of the location sensing device and the on-board controller.

15. The tool assembly of claim 1, wherein the transport member further comprises perforation charges such that the transport member includes a perforating gun.

16. The tool assembly of claim 1, wherein the primary sealing portion is at least one of:

(i) bulbous;

(ii) at least partially spherical; and (iii) elongate.

17. The tool assembly of claim 1, wherein the primary sealing portion is at least one of:

(i) rigid;

(ii) compliant;

(iii) resilient; and (iv) flexible.

18. The tool assembly of claim 1, wherein the at least one secondary sealing portion includes a plurality of secondary sealing portions each protruding radially away from the primary sealing portion and the at least one secondary sealing portion is at least one of:

(i) elongate;

(ii) tentacular;

(iii) fibrous;

(iv) dendritic;

(v) branched;

(vi) tendrilous; and (vii) stranded.

19. A method for use in completing a formation penetrated by a wellbore using a tool assembly conveyable within the wellbore and autonomously actuatable, the method comprising:

providing a tool assembly including;

a location sensing device for acquiring measurements related to the location of the tool assembly within the wellbore;

a plurality of adaptable perforation sealing devices for sealing a plurality of perforations in the wellbore wall;

a transport member for supporting the plurality of adaptable sealing devices during conveyance of the tool assembly within the wellbore;

a self-destruct energy source; and an on-board controller configured to send an actuation signal within the tool assembly to actuate release of the plurality of adaptable perforation sealing devices from the transport member;

wherein the plurality of adaptable perforation sealing devices, the transport member, the location sensing device, and the on-board controller are together dimensioned and arranged to be deployed in the wellbore as an autonomous unit;

wherein each of the plurality of adaptable perforation sealing devices comprise:

(i) a primary sealing portion that seats on a perforation in the wellbore and forms a primary seal with a respective perforation to at least partially restrict fluid flow through the perforation; and (ii) at least one secondary sealing portion having a secured end engaged with the primary sealing portion and an unsecured end capable of extending radially outward from the primary sealing portion, the secondary sealing portion forming a secondary seal in the respective perforation between the primary sealing portion and the wellbore wall to at least partially restrict fluid flow from within the wellbore through a leakage pathway in the respective perforation between the primary sealing portion and the wellbore wall;

wherein the tool assembly is prepared and arranged to self-destruct within the wellbore in response to a self-destruct signal from the on-board controller, and wherein the actuation signal and the self-destruct signals are distinct signals; and wherein the tool assembly comprises a friable destructible material that is destructible into pieces forming a debris field within the wellbore;

deploying the plurality of adaptable perforation sealing devices, the transport member, the location sensing device, and the on-board controller in the wellbore as an autonomously actuatable unit into a wellbore comprising at least one perforation within a wellbore wall of a portion of the wellbore within a subterranean formation to be completed; and sending the actuation signal from the on-board controller to cause (i) release of the plurality of adaptable perforation sealing devices and sending the self-destruct signal from the on-board controller to cause (ii) self-destruction of the tool assembly within the wellbore.

20. The method of claim 19, further comprising:

providing a perforating gun supporting perforating charges therewith; and autonomously sending a fire signal from the on-board controller to the perforating charges to create at least one of (i) the at least one perforation, and (ii) at least one another perforation within the wellbore wall.

21. The method of claim 20, further comprising:

configuring the controller to selectively send the actuation signal to cause release of the plurality of adaptable sealing devices from the transport member, separate from the fire signal that causes the perforating gun to fire.

22. The method of claim 19, wherein each of the plurality of adaptable perforation sealing devices comprises a destructible shell that confines the secondary sealing portion in a transport condition during conveyance within the wellbore.

23. The method of claim 22, wherein the destructible shell is destructed in response to a stimulus generated in response to at least one of the actuation signal and the self-destruct signal.

24. The method of claim 19, wherein the transport member functions as a common protective destructible shell for the plurality of adaptable sealing devices during conveyance.

25. The method of claim 19, wherein the transport member supports the plurality of adaptable sealing devices by encasement therein and the transport member is destructed in response to the self-destruct signal.

26. The method of claim 19, wherein at least a portion of the tool assembly comprises a friable material that is formed to create the debris field including at least a determined percentage by mass or volume of particles of a desired distribution according to at least one of size and shape.

27. The method of claim 19, wherein the portion of the tool assembly comprising a formed friable material tool assembly is formed including at least one of recesses, grooves, varying friability, varying granular composition, selected shape geometry with respect to impact from a shockwave or explosive charge, repeating geometric patterns, tapered thicknesses or shapes, encased beads, aggregated particulates, multi-component mixtures of solids including a substantially continuous binder component and a discontinuous particulate component, compartmentalized materials, and combinations thereof.

28. The method of claim 19, wherein the transport member comprises at least one of a shroud, compartment, mandrel, bag, tentacle, wire, tubular housing, and combinations thereof.

29. The method of claim 19, wherein the transport member comprises a housing that includes the plurality of adaptable perforation sealing devices and at least one of the location sensing device and the on-board controller.

30. The method of claim 19, wherein the transport member further comprises perforation charges such that the transport member includes a perforating gun.

31. The method of claim 19, further comprising:

supporting the plurality of adaptable sealing devices by encasement within the transport member.

32. The method of claim 19, further comprising:

supporting the plurality of adaptable sealing devices by encasement within the transport member; and discharging the plurality of adaptable sealing members from the transport member with the actuation signal prior to destructing the transport member by the self-destruct signal.

33. The method of claim 19, further comprising providing a tubular conduit within the wellbore including a perforation seat for receiving one of the plurality of adaptable sealing devices thereon after release of the adaptable sealing device from the tool assembly.

34. The method of claim 19, wherein a portion of the debris field forms a tertiary seal to further restrict fluid flow through the leakage pathway.

* * * * *